US006032915A

United States Patent [19]

Brindisi

[11] Patent Number: 6,032,915

[45] Date of Patent: Mar. 7, 2000

[54] ADJUSTABLE MOUNTING DEVICE

[76] Inventor: Thomas J. Brindisi, 400 S. Detroit St., Apt. 407, Los Angeles, Calif. 90036

[21] Appl. No.: 08/816,784

[22] Filed: Mar. 19, 1997

[51] Int. Cl.[7] ..... A47G 1/24

[52] U.S. Cl. ..... 248/466; 248/477; 248/496

[58] Field of Search ..... 248/475.1, 489, 248/495, 476, 496, 231.21, 466; 24/458, 611; 269/254 CS, 254 R, 261, 1, 3

[56] References Cited

U.S. PATENT DOCUMENTS

| | | | |
|---|---|---|---|
| D. 349,447 | 8/1994 | Daniller | D8/367 |
| 1,017,174 | 2/1912 | Sander et al. . | |
| 1,209,582 | 12/1916 | Hoernegel | 248/490 |
| 1,432,206 | 10/1922 | Poole, Jr. . | |
| 1,908,200 | 5/1933 | Webster . | |
| 2,056,078 | 9/1936 | Slater | 248/243 |
| 2,117,714 | 5/1938 | Funk | 248/274 |
| 2,448,588 | 9/1948 | Greenberg | 248/495 |
| 2,478,256 | 8/1949 | Eysmann | 248/496 |
| 2,723,096 | 11/1955 | Schwartz | 248/495 |
| 2,740,603 | 4/1956 | Wofford | 248/494 |
| 2,757,890 | 8/1956 | Sutton et al. | 248/494 |
| 2,791,388 | 5/1957 | Hirt | 248/495 |
| 2,898,064 | 8/1959 | Scott | 248/496 |
| 2,943,831 | 7/1960 | Goss | 248/495 |
| 2,975,994 | 3/1961 | Goss | 248/496 |
| 3,063,666 | 11/1962 | Morrison | 248/496 |
| 3,112,912 | 12/1963 | Alvarez | 248/223.21 |
| 3,268,195 | 8/1966 | Hoffman | 248/225.21 |
| 3,285,549 | 11/1966 | Cook | 248/495 |
| 3,330,525 | 7/1967 | Weinstein | 248/496 |
| 3,360,229 | 12/1967 | Beyer | 248/496 |
| 3,838,842 | 10/1974 | McCracken | 248/476 |
| 3,895,775 | 7/1975 | Norton | 248/476 |
| 3,945,599 | 3/1976 | Spier et al. | 248/476 |
| 4,220,309 | 9/1980 | Eisen et al. | 248/542 |
| 4,222,544 | 9/1980 | Crowder | 248/495 |
| 4,530,482 | 7/1985 | Berinson | 248/475.1 |
| 4,549,713 | 10/1985 | Magadini | 248/495 |
| 4,557,455 | 12/1985 | Benjamin | 248/496 |
| 4,611,779 | 9/1986 | Leonard, Jr. | 248/476 |
| 4,641,807 | 2/1987 | Phillips | 248/480 |
| 4,863,135 | 9/1989 | Mellor et al. | 248/328 |
| 4,883,247 | 11/1989 | Crandall | 248/542 |
| 4,892,284 | 1/1990 | Kelrick | 248/476 |
| 5,056,954 | 10/1991 | Flux et al. | 403/330 |
| 5,133,526 | 7/1992 | Olmsted | 248/495 |
| 5,303,895 | 4/1994 | Hart | 248/475.1 |
| 5,342,014 | 8/1994 | Wilson | 248/495 X |
| 5,454,542 | 10/1995 | Hart | 248/494 |
| 5,480,120 | 1/1996 | Bruner | 248/477 |

*Primary Examiner*—Ramon O. Ramirez
*Assistant Examiner*—Long Dinh Phan

[57] ABSTRACT

A device that provides automatic, in situ, continuously adjustable mounting of an item on a vertical support, comprising a first portion affixed to the vertical support, and a second portion that fixedly or releasably engages with the first portion and fixedly attaches to or is incorporated in the reverse side of the item. One or both of the two portions is formed to allow automatic, in situ, continuous vertical adjustment and repositioning with respect to the other portion, and one or both portions may also be formed to allow horizontal adjustment and repositioning with respect to the other portion. Also, a device for horizontally extending the available range of mounting positions for items that need to be supported by a stud.

20 Claims, 38 Drawing Sheets

FIG. 1
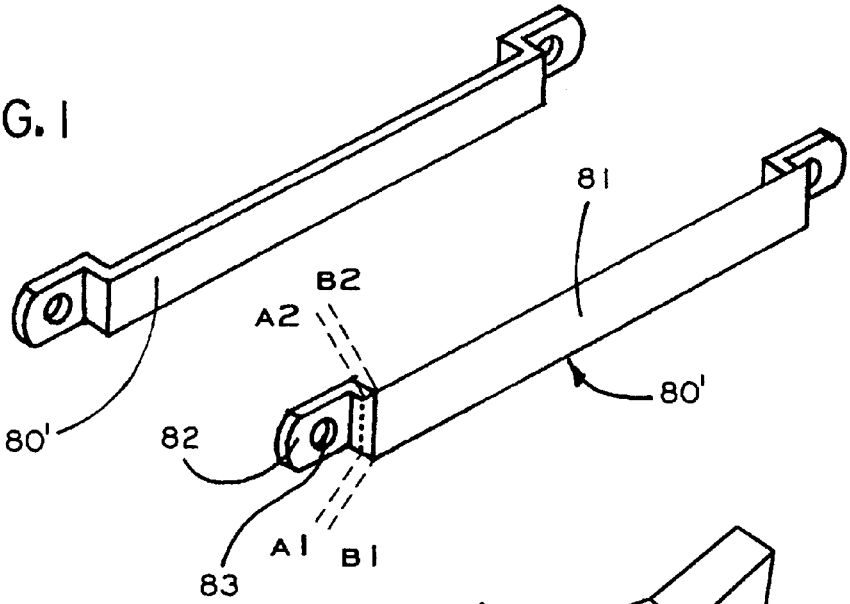
FIG. 1A
FIG. 2
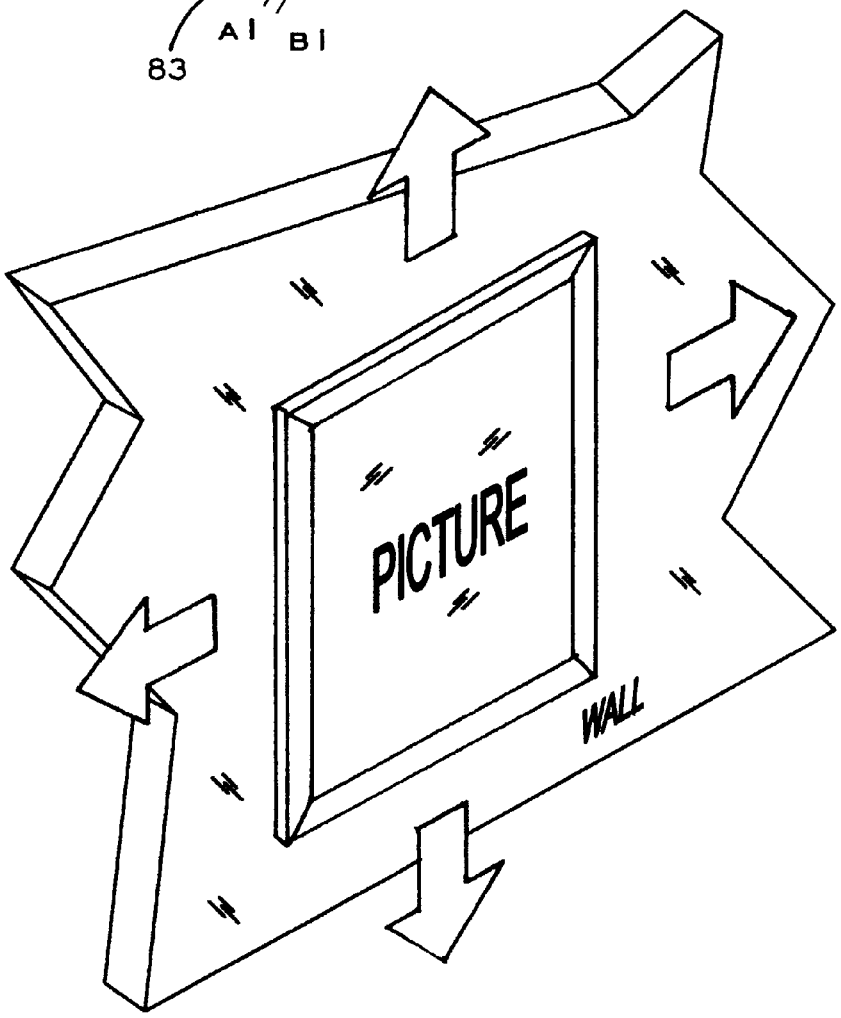

FIG. 9A
FIG. 9
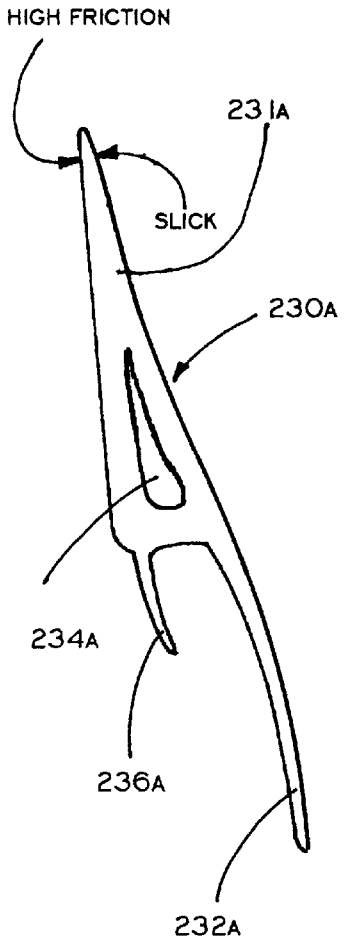
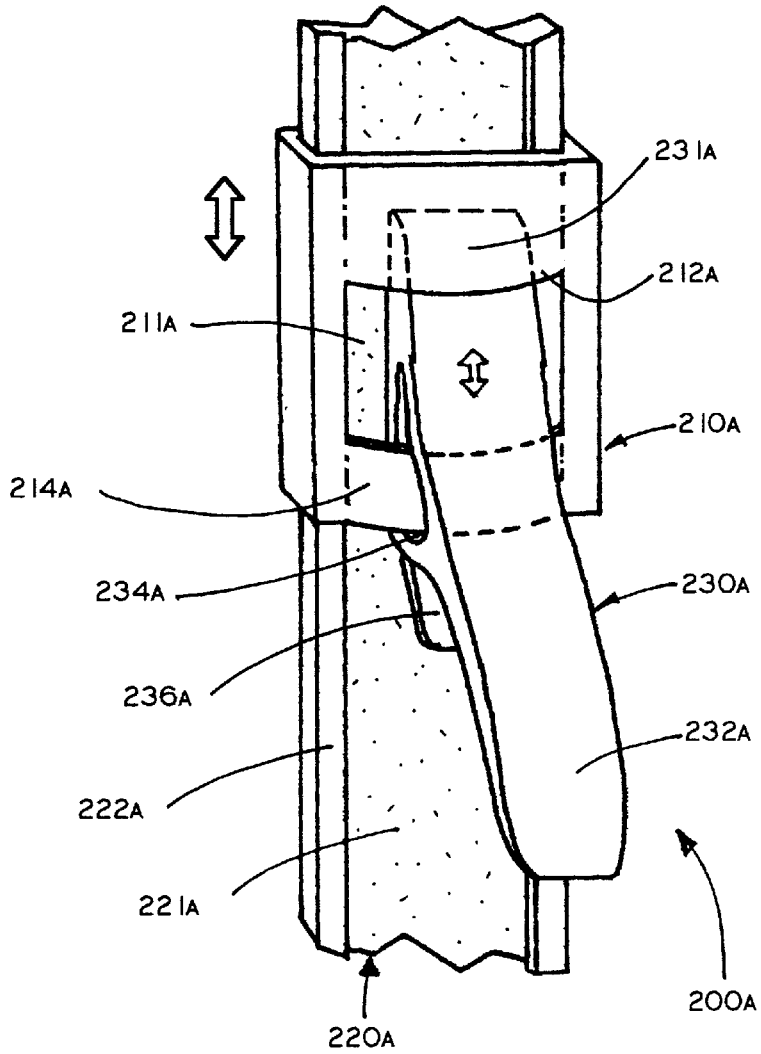

FIG. 12
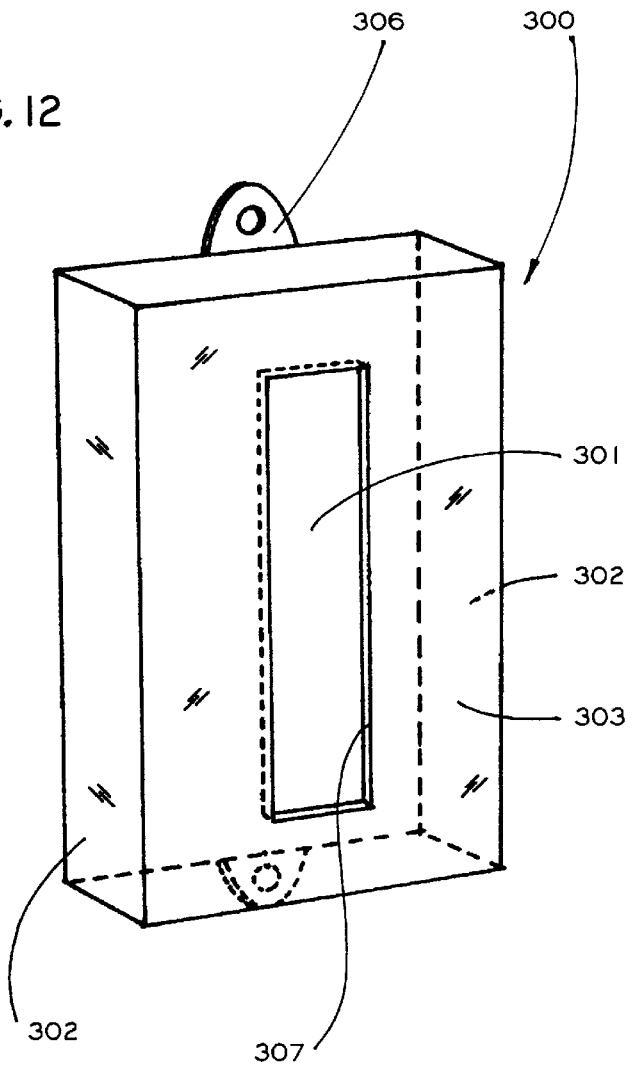
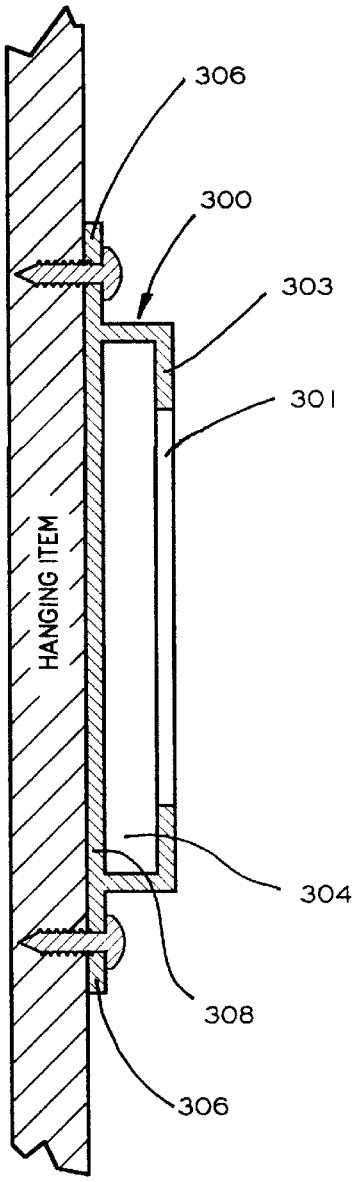
FIG. 12A

FIG. 30
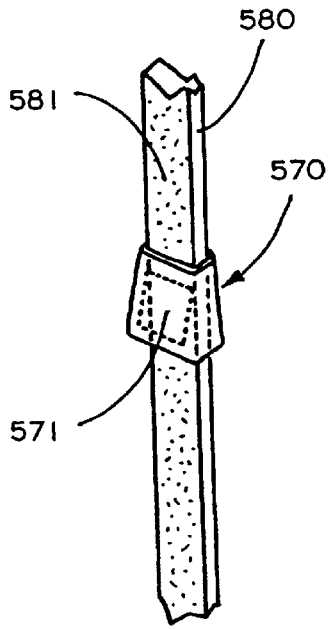
FIG. 30A
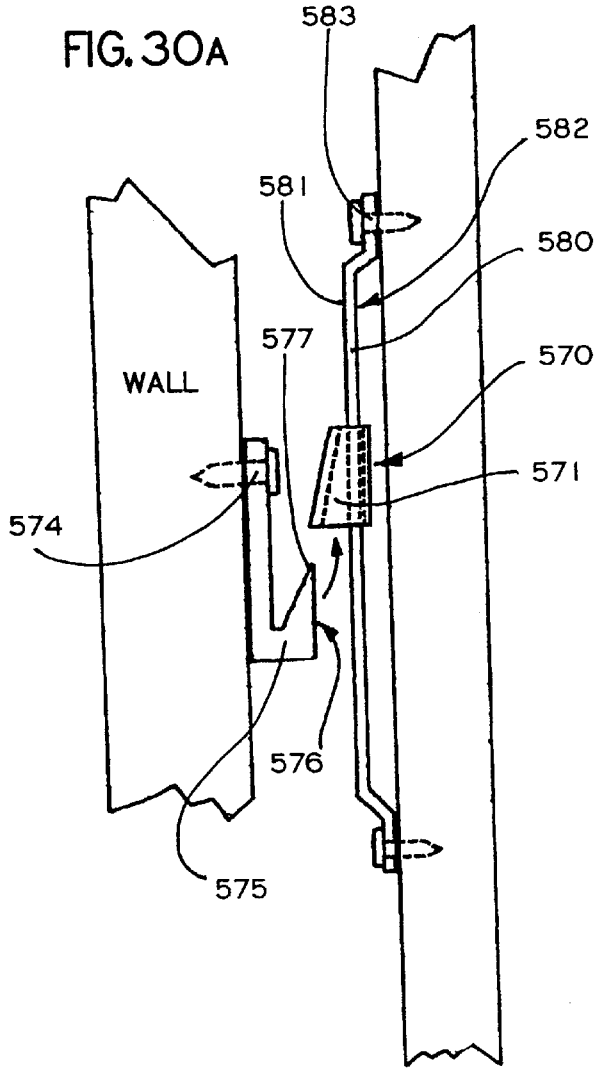
FIG. 31
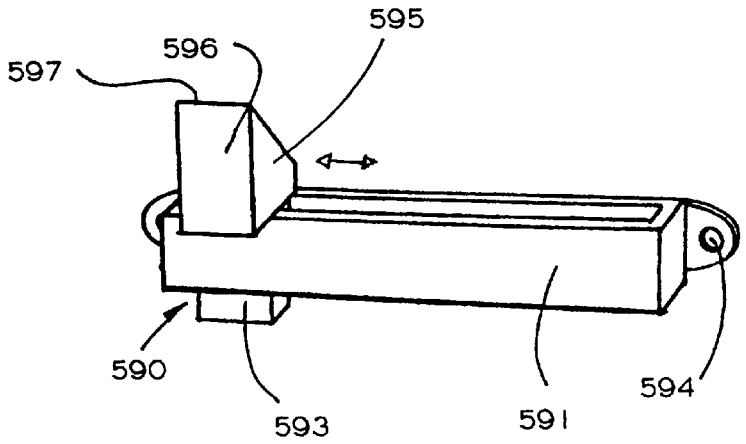
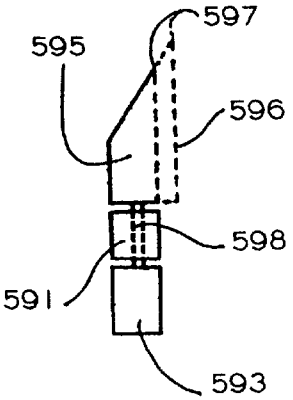
FIG. 31A

FIG. 36
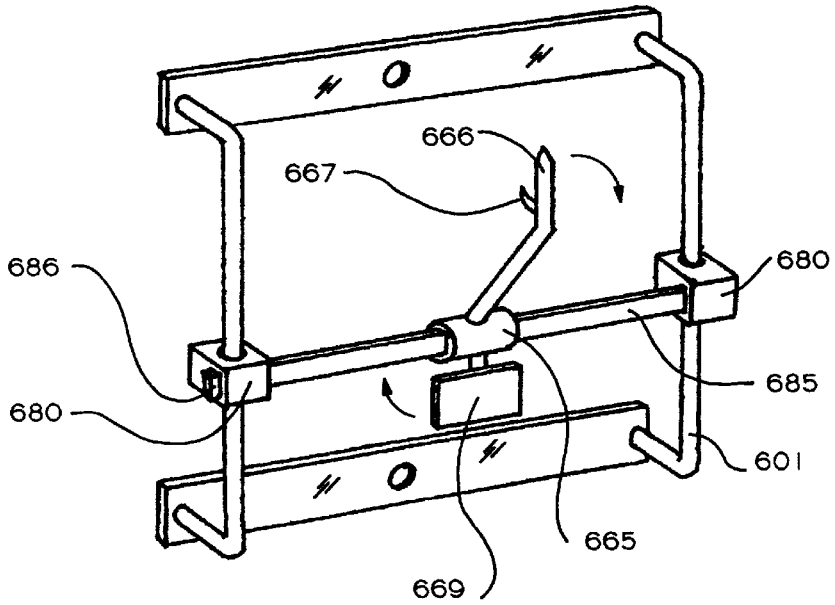
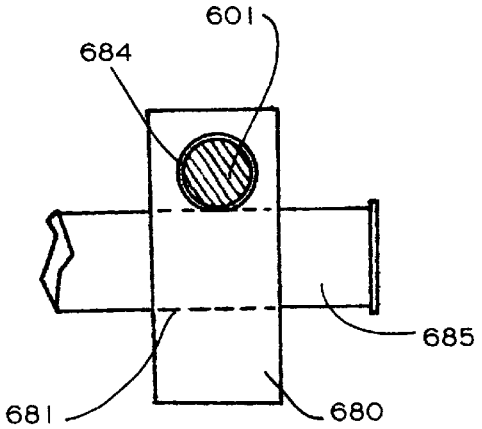
FIG. 36A
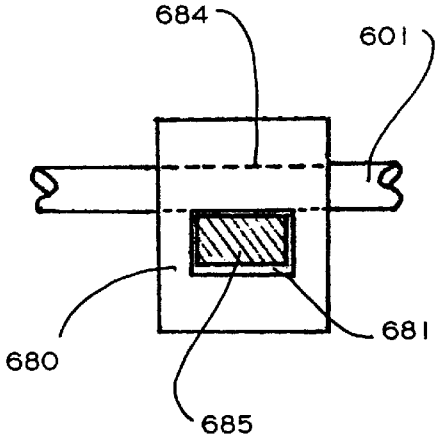
FIG. 36B

FIG. 45A
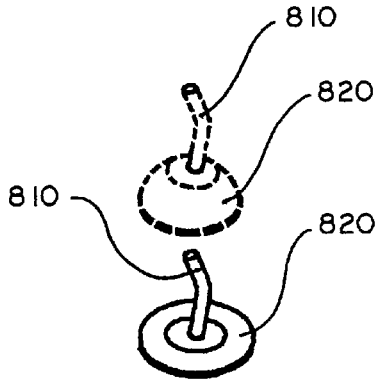
FIG. 45
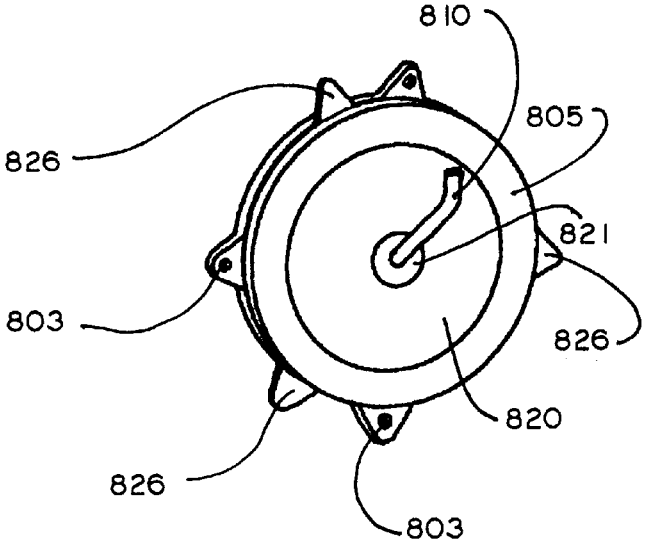
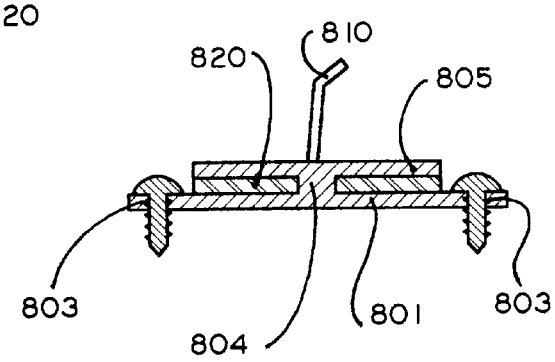
FIG. 45B

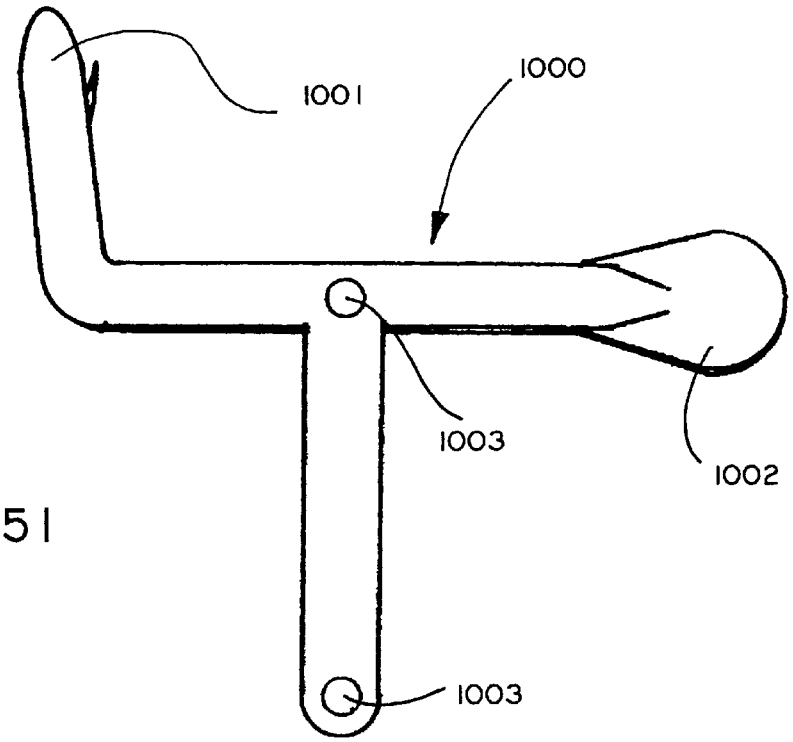
FIG. 51
FIG. 52
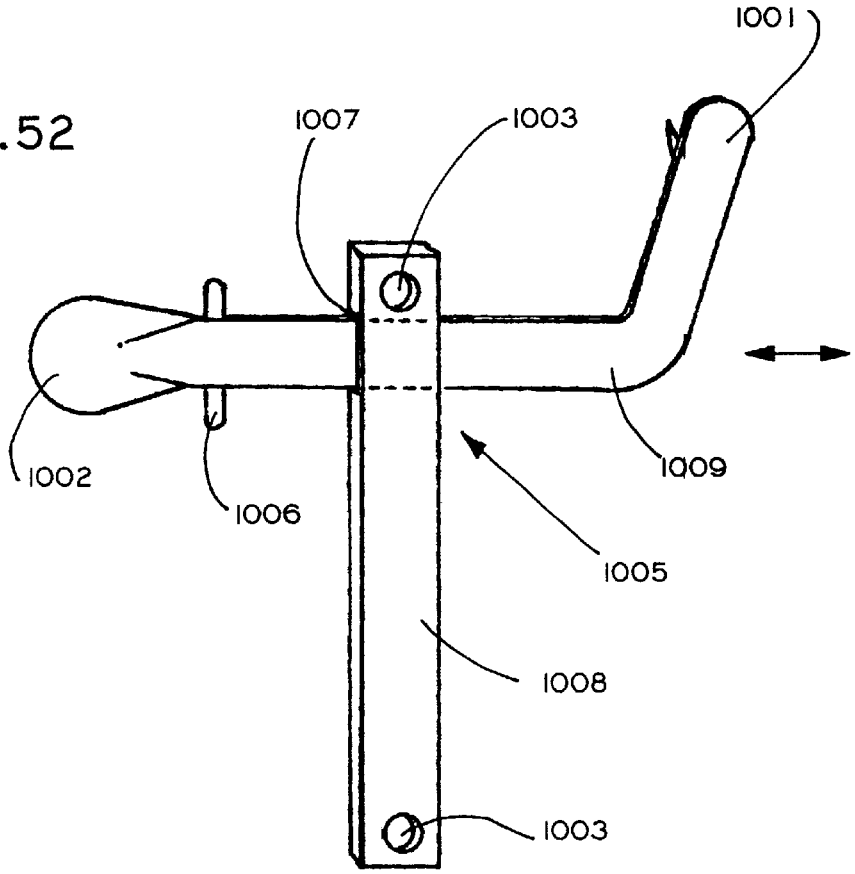

ADJUSTABLE MOUNTING DEVICE

Reference is hereby made to, and the benefit claimed of, Applicant's provisional U.S. Patent Application Ser. No. 60/013,671, which was filed on Mar. 19, 1996, and was entitled "Adjustable Wall Mounting Device."

BACKGROUND OF THE INVENTION

The field of the present invention pertains to the art of picture hangers, and securing devices and mounting devices for items that have a substantial vertical aspect. More particularly, the present invention relates to a mounting or positional securing device that is adjustable in situ, meaning that different fixed positions (of the item vis-a-vis the support that it is secured to) can be achieved without requiring that fastening means be moved and reaffixed.

The prior art reflects a long-standing endeavor to create mounting devices which simplify the process of positioning and mounting an item and which expand the latitude concerning where and how a mounted, hanging, or otherwise secured item can be repositioned. For example, as has been repeatedly noted in a number of patents granted over the last century (including those discussed below, the disclosures of which are incorporated herein by reference), hanging an item such as a picture or painting in a precise desired position on a wall can prove frustrating and time consuming. Removing and reaffixing nails or screws is commonly necessary in order to hone in on the desired hanging position, causing damage to the wall surface or even total failure of support for the hanging item.

While prior artisans in the field have long recognized these difficulties and have created myriad devices aimed at solving them, there has not been a fully satisfactory solution. Heretofore, there has been no teaching or indication that certain of such problems could be solved by providing a device with (1) automatic, (2) in situ (3) continuous vertical adjustability, and (4) ready engageability and disengageability of the hanging item. Likewise, there has heretofore been no suggestion that certain other of such problems could be solved by providing a device with (1) automatic, (2) in situ, (3) continuous, (4) two-way (horizontal and vertical) adjustability.

At the outset, such terminology will be defined. The following definitions generally apply to the defined terms themselves as well as their roots, derivatives and other variants, as long as the same concept is sought to be invoked thereby.

Definitions

First, "in situ" vertical adjustability means that, throughout a range of vertical adjustability, the device allows an item to be adjusted both up and down without requiring disengagement of the item from the support and without requiring any significant change to the item's existing vertical position in order to activate adjustability. In other words, vertical adjustability can be activated, the item moved upward or downward, and the user can then leave the item substantially where it has been adjusted—it is neither necessary to remove the item from the support, nor to move the item into a significantly different vertical position. A similar definition, of course, applies to horizontal in situ adjustability.

Next, "automatic" adjustability means that direct manipulation (by hand or by tool) of any portion of the device residing substantially recessed between the hanging item and the support is not required in order to accomplish adjustment. In other words, adjustment can be achieved simply by the user applying a selected force or series of forces on the item itself, and/or on a part of the assembly that is conveniently accessible (for example, lying flush with an item's frame edge). This definition is not meant to exclude devices which incorporate the automatic nature of the invention taught herein, but simply add a means technically requiring some direct user manipulation of an insubstantially recessed part of the assembly (e.g., a slightly recessed locking means that requires initial unlocking prior to an otherwise automatic adjustment process).

Also, "continuous" adjustability means that adjustment occurs over a substantially continuous range rather than falling into a discrete group of selectable positions.

Further, when it is indicated herein that an embodiment provides for "ready engagement and disengagement of the item," or is "readily engageable and disengageable from the support," or the like, it is meant that an item may be readily hung on a support and removed therefrom as desired, through facile manipulations that do not involve any significant disassembly or any detachment of parts of the assembly affixed to the support or the subject item.

Finally, terms such as "item" and "frame" are used herein with some overlap. For example, depending on the logical context, the term "item" may refer only to an item such as a diploma or picture, or it may also be inclusive of the "frame" in which such an item is framed, and/or inclusive of an attached or incorporated mounting device. Likewise, the term "frame" may refer just to the object in which an item is framed, or it may include the framed item and/or a mounting device. These terms are simply chosen as a convenience in illustrating the concepts of the present invention, and are not meant to limit the types of items that may be adjustably held in position thereby. For example, a chair-back might be considered a "hanging item" for the purposes of the present invention, despite the fact that it does not have a distinct "frame."

The Prior Art

The prior art includes a series of patents directed to devices that provide automatic, (somewhat) in situ, two-way adjustability. These patents include U.S. Pat. No. 5,480,120, issued Jan. 2, 1996 to Bruner; U.S. Pat. No. 3,945,599, issued Mar. 23, 1976 to Spier et al.; U.S. Pat. No. 3,063,666, issued Nov. 13, 1962 to Morrison; U.S. Pat. No. 2,757,890, issued Aug. 7, 1956 to Sutton et al.; and U.S. Pat. No. 2,740,602, issued Apr. 3, 1956 to Wofford. The devices taught in each of these patents essentially comprise a first portion having a series of horizontal slots (or pairs of slots) and a second portion comprising an opposing hook(s) or the like which seats in any member of the series of horizontal slots. Some of the aforementioned patents disclose devices with the first portion attached to the wall and the second to the picture, while the others teach the converse arrangement. In either case, a measure of vertical adjustability is provided by disengaging the hanging item and its associated hanging means from the wall support means, and reseating the hook in a different member of the series of horizontal slots. In most of the devices, horizontal adjustability is provided by the hook(s) or the like being free to slide laterally along the horizontal length of the opposing slot(s) with which it is engaged. Most significantly, however, in each of these patents, the vertical adjustability is not substantially continuous in nature, and instead falls into a group of discrete selectable positions. Also, it should be noted that, in each of these patents, vertical adjustment requires outright disengagement of the hanging item from the wall support, meaning that if the person hanging the item were to let go of the item, it would presumably drop to the floor. Moreover, because the item must be disengaged to be vertically adjusted, it must also be reengaged with the wall support means, which can involve somewhat of a "blind" process.

The prior art also teaches devices which provide for in situ, continuous, two-way adjustability, but none of these devices are automatic inasmuch as they require that adjustments be made directly to the assembly which must be accessed behind the hanging item. For example, U.S. Pat. No. 4,892,284, issued Jan. 9, 1990 to Kelrick, and U.S. Pat. No. 2,791,388, issued May 7, 1957 to Hirt, both teach devices that allow for in situ, continuous, two-way adjustability effected by the manipulation by tool (e.g., screwdriver) of a rack and pinion or the like. These devices clearly present an inconvenience in that the user is required to insert a tool between the hanging item and wall and then, with some precision, locate the adjustment means. In addition, these devices require that the user have a suitable tool handy whenever adjustment to the hanging item is desired, and they also tend to necessitate the existence of a substantial gap between the hanging item and the wall in order to accommodate the device as well as clearance for the tool to be inserted.

Another example of a two-way, (possibly) in situ, continuously adjustable device is found in U.S. Pat. No. 4,549,713, issued Oct. 29, 1985 to Magadini. Magadini discloses vertically disposed rods which slide along a horizontal wall support, and upon which spring biased "L" or "J" shaped metal hanger straps are locked in place against downward vertical movement. This device, however, is not automatically adjustable in that vertical adjustment requires direct manual location, manipulation (i.e., overcoming the spring bias of a hanger strap and moving it to a different position), and resetting of the hanger straps. It should also be noted that in the Magadini device, because the horizontal wall support is (by necessity) at the uppermost position compared to the rest of the assembly, part of the assembly itself is visible, which is generally not aesthetically desirable. Moreover, to the extent that the Magadini device requires the hanging item to be removed from the wall in order to manipulate the hanger straps, then the advantages of in situ adjustability are also precluded.

Another example of a non-automatic, possibly in situ adjustable device is disclosed in U.S. Pat. No. 2,898,064, issued Aug. 4, 1959 to Scott. The Scott device comprises a beaded chain that attaches to the item to be hung, and an assembly that attaches to the wall and includes a horizontally sliding member with slots into which the beaded chain can be connected at various positions along the chain. This device is of course not automatic because the beaded chain must be manually pulled out of the slots and reinserted at a different position in order to accomplish vertical adjustment. Further, the device is not continuously vertically adjustable because the vertical positions correspond to discrete positions on the chain (i.e., between beads). The device may also not be adjustable in situ, because the hanging item may have to be removed from the wall in order for the beaded chain to be reinserted.

The prior art also includes patents which disclose two-way adjustable devices that are neither automatic nor in situ adjustable. Beyond the disadvantages associated with non-automatic adjustability (noted above), non-in situ adjustment is disadvantageous in that repositioning is more tedious and awkward, firstly because the hanging item must be repeatedly removed, set somewhere, and then replaced, and secondly because it involves guesswork as to exactly where an item will hang after the device has been adjusted a given amount. Moreover, the non-in situ adjustment process can involve temporal lapses that undermine the user's ability to mentally compare visual images of the item hanging (in situ) in one position vis-a-vis another position.

An example of a non-in situ adjustable device is U.S. Pat. No. 4,641,807, issued Feb. 10, 1987 to Phillips. The Phillips device comprises a mounting stud attached to a slotted body plate that is secured to the wall by a screw passing through the slot and into the wall. When the screw is loosened, the body plate can be slid along and rotated about the screw; and the body plate remains in position once the screw is retightened. This device is of course non-automatic because it requires direct manipulation of the assembly, but it is also not adjustable in situ because in order to adjust the device, the hanging item must be removed, set somewhere, and then rehung after a new configuration is secured. It should be noted that another disadvantage inherent in the Phillips device is that, because there can be at most one screw securing the body plate to the wall, hanging an item anywhere other than with its center of mass directly above the screw will create a rotational torque in the plane of the wall that will tend to cause the whole assembly to rotate, thereby being unable to maintain a desired position. Thus, horizontal adjustability is undermined.

The prior art also includes patents directed to devices that provide vertical but not horizontal adjustability. One example is U.S. Pat. No. 4,557,455, issued Dec. 10, 1985 to Benjamin, which discloses a toothed latching mechanism that allows for automatic vertical adjustment. Beyond not providing horizontal adjustability, however, this device is not adjustable in situ because the latch mechanism is one-way, i.e., it only allows upward movement when engaged. Thus, with the Benjamin device, in order to adjust a hanging item downwardly, the item must first be moved all the way to the top of its adjustment range, whereat the latch disengages, and then all the way to the bottom of its adjustment range whereat the latch reengages. Then, with the latch engaged, the item is moved upwardly until the desired lower position is reached. Consequently, whenever a hanging item is desired to be moved downwardly at all, it must be moved entirely out of its existing position, the previous position (minus the desired downward adjustment) remembered or marked, and then relocated. Each time an item is adjusted just past its desired position, the entire process must be repeated.

Another type of prior art device providing vertically-only, continuous, (possibly) in situ adjustability, is disclosed in U.S. Pat. No. 3,285,549, issued Nov. 15, 1966 to Cook, and U.S. Pat. No. 2,943,831, issued Jul. 5, 1960 to Goss. These devices are operationally somewhat similar to the Magadini device described above, in that they each require manual manipulation of the assembly in order to effect vertical adjustments (i.e., they are not automatic).

Finally, the prior art includes a patent directed to a marginally relevant device that provides automatic, in situ, continuous, vertical-only adjustability. U.S. Pat. No. 1,432,206, issued Oct. 17, 1922 to Poole, Jr., discloses an adjustable mirror support comprising a clamping portion that is affixed to the mirror and a vertically disposed rod that is affixed to the wall. The clamping portion is essentially permanently secured in sliding relation to the rod (inasmuch as the rod is permanently affixed to the wall and the clamp is permanently affixed to the mirror). When the mirror is disposed in the vertical plane, the clamping portion clamps the rod; when the bottom of the mirror is tilted upward, the clamping portion no longer clamps the rod, allowing it to slide up or down on the rod until the mirror is again disposed vertically by the user. Besides providing only vertical adjustability, however, because of the essentially permanent connection of the clamping portion to the rod, the Poole, Jr. device would not allow a hanging item to be readily engaged or disengaged from the wall support. It should also be noted that, because the portion of the device which provides the range of vertical adjustability (viz, the rod) is attached to the wall, visible overhang of part of the assembly itself (which is generally undesirable) is apparently unavoidable. It should be further noted that the Poole, Jr. device necessitates a significant gap between the hanging item and the wall, both because the clamp must be distanced from the rear of the item to provide clearance for pivoting the item on the rod without hitting the rod, and because the portion of the clamp facing the wall must have clearance from the wall in order to allow pivoting on the rod without hitting the wall.

Thus, there clearly remains a need for an effective mounting device that allows items to be readily hung in a desired position on a wall even though the exact whereabouts of that position may not be easily discernable until the item has already been hung in the approximate vicinity of the desired position, and, from the proper perspective, viewed hanging. There is also a need for a mounting device that can allow an item to be efficaciously hung in a "desired position," and then, perhaps along with adjacent hanging items, be readily moved to new "desired positions." Another need that appears unsatisfied by the prior art is for a mounting device that can effectively and readily compensate for imprecision or errors in measurement that tend to occur even when a desired mounting position is already exactly known. A further need is for a mounting device that allows for readily removably hanging an item with automatic, in situ, substantially continuous vertical adjustability. A yet further need is for a mounting device that provides automatic, in situ, substantially continuous, two-way adjustability, with or without ready removability of the supported item. A still further need is for a mounting device which can increase the usable horizontal hanging area for items that require the support of a wall stud, so that the position of studs is not as determinative of the placement of such items.

SUMMARY OF THE INVENTION

The present invention may comprise a releasably engageable, adjustable mounting device that allows in situ, automatic, substantially continuous adjustment to the vertical position in which an item is mounted. The present invention may also comprise an adjustable mounting device that allows in situ, automatic, substantially continuous, two-way adjustment to the position of a supported item. The present invention may be affixable, in part or in whole, to a vertical flat surface, and may also be affixable, in part or in whole, to the rear of the item that is to be mounted. The present invention may also be formed to utilize existing means of hanging which are frequently provided on the backs of picture frames and the like (e.g., wire, toothed brackets, or universal frame edging). The present invention may also be, in part or in whole, manufactured into, or made for large scale retrofitting into, picture frames, or other objects that can benefit from adjustable mounting or connection.

The above and other objects, features and advantages of the invention will become apparent from the following description of preferred embodiments, taken in conjunction with the accompanying drawings.

BRIEF DESCRIPTION OF THE DRAWINGS

The accompanying drawings, along with the description, serve merely to illustrate and explain the concepts underlying the present invention, and to describe preferred embodiments thereof. Only a few representatives of the many possible different configurations are illustrated, and the drawings are not to be construed as limiting the scope of the invention in any way.

FIGS. 1 and 1A are top front left perspective views of two versions of a generic wall bar that may be part of the two-way adjustable embodiments such as those shown in FIGS. 8–29 and 48–49;

FIG. 2 is a top front left perspective view of an item hanging on a vertical flat surface wherein an automatic, in situ, substantially continuous, two-way adjustable embodiment of the present invention (not shown) is attached to the rear of the hanging item and/or to the flat vertical surface, showing the two-way automatic repositioning of the item that can be accomplished while the item remains hanging in situ;

FIGS. 9 and 9A are a partial side view and partial left top front transparent perspective view of an embodiment similar to that of FIG. 8, showing the wedge nearly trapped in the brake trap;

FIGS. 12 and 12A are a left top front perspective view and cross-sectional side view of a generic box that may be adapted for use in the devices of FIGS. 13–21, showing the attachment of the box to the rear of an item to be hung;

FIGS. 30 and 30A are a partial transparent top front right perspective view and a side transparent view of an embodiment providing vertical adjustability, showing how the hook projecting from the wall is poised to be trapped in the vertically sliding trap;

FIGS. 31 and 31A are a top right front perspective view and a side transparent view of part of an embodiment similar to that shown in FIG. 30 but providing two way adjustability;

FIGS. 36, 36A, and 36B are a bottom front left perspective view and partial side views of an embodiment providing two-way, in situ adjustment activated by inward pressure on the top of the hook, showing how the resilient box coupling locks the rod to the rails when outward or downward pressure is applied;

FIG. 41 is a bottom front right perspective view of an embodiment providing two-way, in situ adjustment activated by inward pressure on the top of the hook, showing how the brake arms are biased, forcing the brake feet/teeth into engagement with the brake pads except when the hook is pushed in;

FIGS. 45, 45A, and 45B are a front left perspective and partial perspective sequential view and side view of an embodiment providing two-way, in situ adjustability, showing how when the hook is pulled outward, the central area of the hook-bearing rubber disk snaps away from the adhering central inside area of the mount, allowing it to move with respect to the mount, and showing how the rubber disk snaps back into engagement with the adhering central inside area of the mount when outward pressure is released;

FIG. 51 is a front view of an embodiment that allows for placement of an item off-center from a stud, showing how the embodiment is fixed and left-oriented and showing the points of attachment to the wall stud and position of the hook; and FIG. 52 shows an embodiment similar to that of FIG. 51 but horizontally adjustable and right-oriented, showing the points of attachment to the wall stud and position of the hook.

DETAILED DESCRIPTION OF PREFERRED EMBODIMENTS

It should be realized that there are many applications for the present invention, and the specific embodiments described herein are not meant to limit such applications. Thus, while the following detailed description focuses on embodiments that may be of a scale and character appropriate to the hanging of pictures, paintings and the like, this is simply for the sake of furthering the clarity of the discussion, allowing standardizable comparisons, et cetera. The invention taught herein, however, is envisaged as encompassing a wide range of applications extending to anything that can benefit by adjustable mounting. Examples include advertising or informational displays, art exhibits, and various other flat or even three dimensional items, including items having utilities or functions other than as a mere display, and items that are intended to have direct or remote interaction with a person or other object.

Even with regard to the particular embodiments of the invention that are described herein in detail, it must be kept in mind that the cross-sectional shapes, thickness, widths and lengths of the various elements, as well as the particular sub-mechanisms and configurations, can readily be varied to afford different combinations of strength, operational dynamics, and overall thickness of the assembly. Only a few representatives of the many possible different configurations are shown.

Proceeding to the figures, FIG. 2 shows generally how the two-way (i.e., horizontally and vertically), in situ, automatic, substantially continuously adjustable embodiments of the invention are movable to different positions while they are hanging on the wall. It should be noted that although two-way adjustability is a further aspect of the present invention, it is not a requisite, and the present invention can be practiced using embodiments that provide vertical adjustability only.

Figure 3:
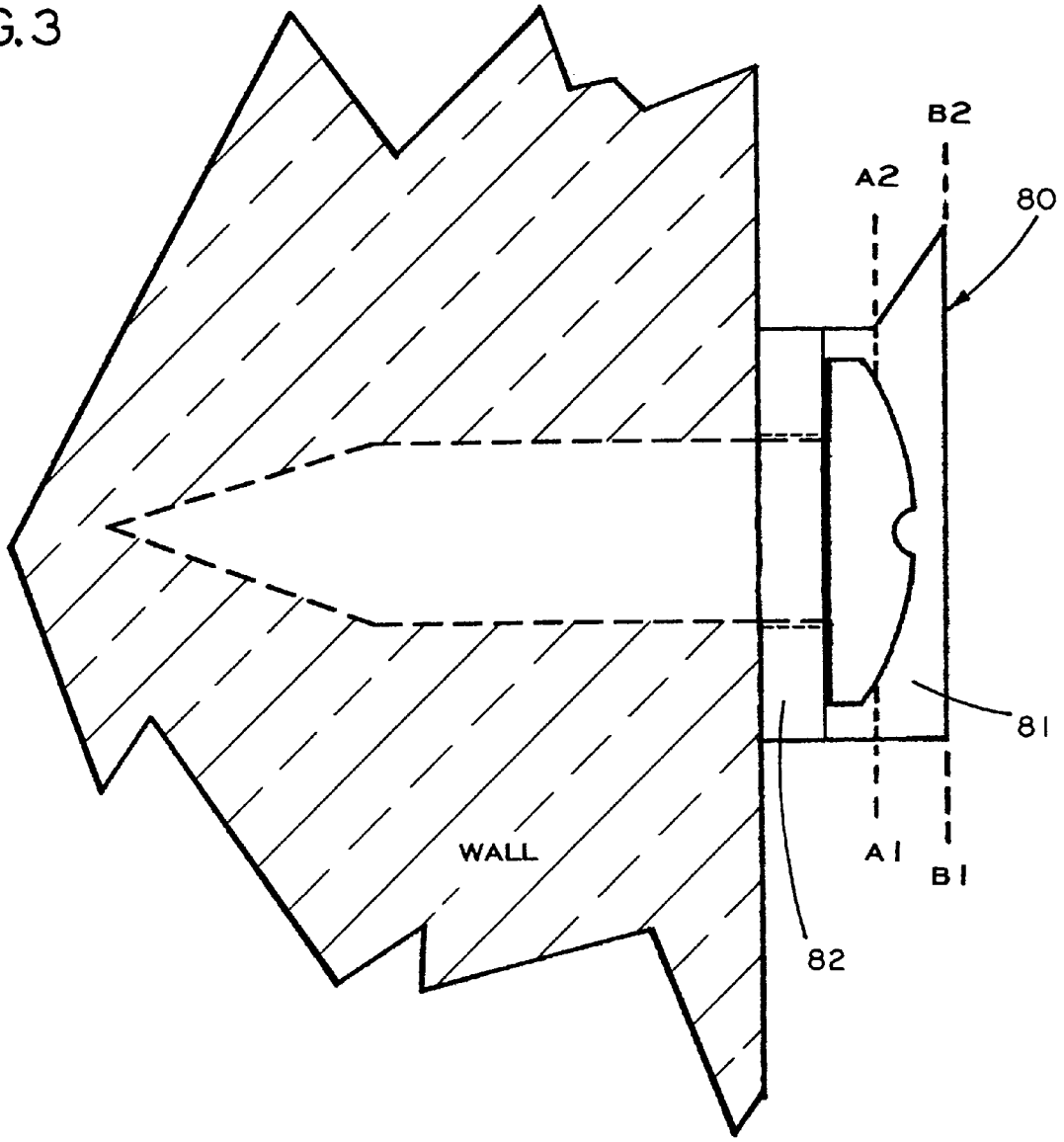
FIG. 3 is a side transparent view of a generic version of the wall bar shown in FIG. 1A viewed along the lines a1–b1 and a2–b2, with the wall bar attached to the wall by screws or nails.
Figure 4:
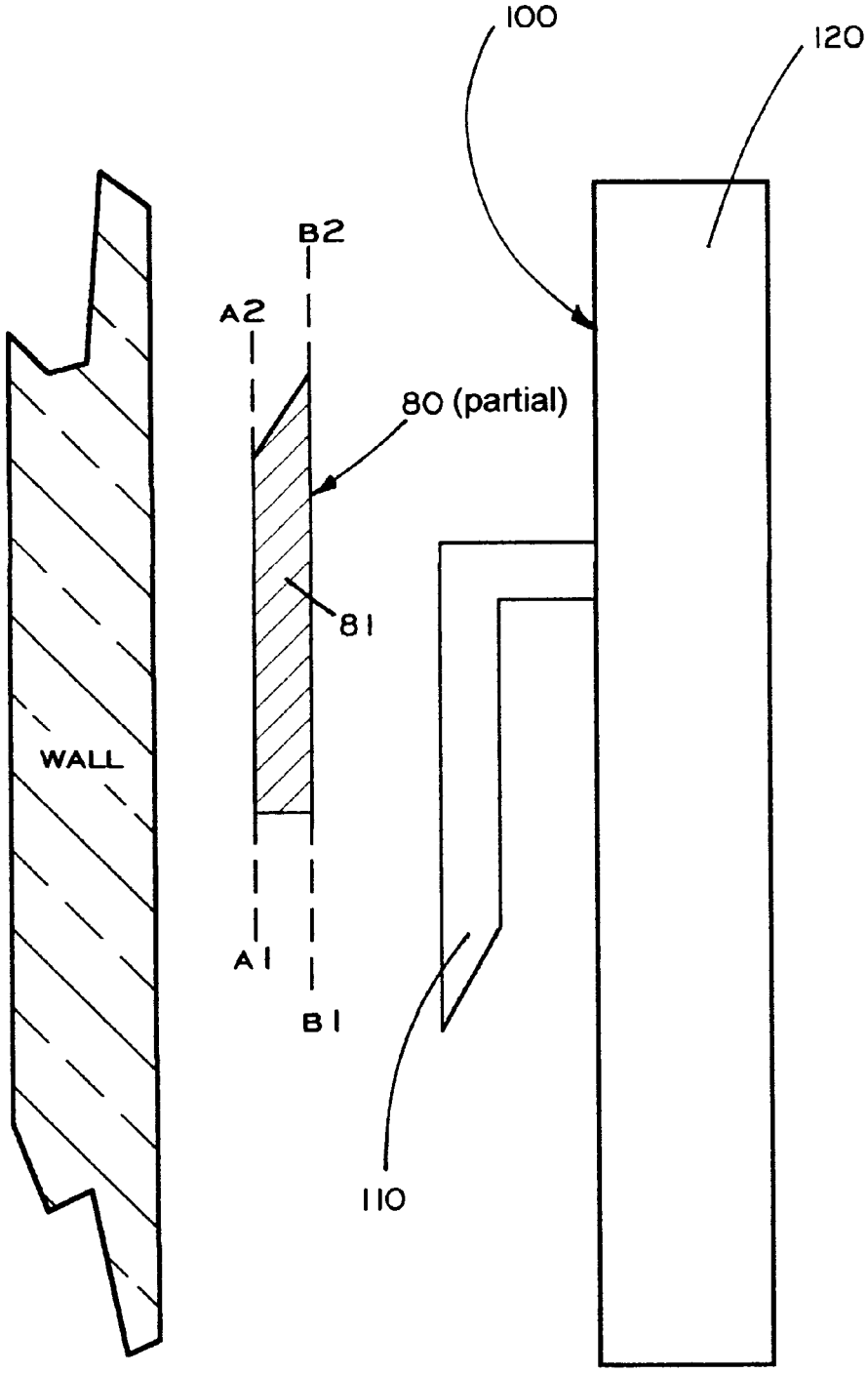
FIG. 4 is a partial side view of part of the wall bar (mounted to the wall) and the rest of the two way adjustable assembly (mounted to an item to be hung, not shown) of an embodiment such as those shown in FIGS. 8–29 and 48–49, with the rest of the adjustable assembly being raised into position (along with the item to be hung) for mounting on the wall bar.
Figure 5:
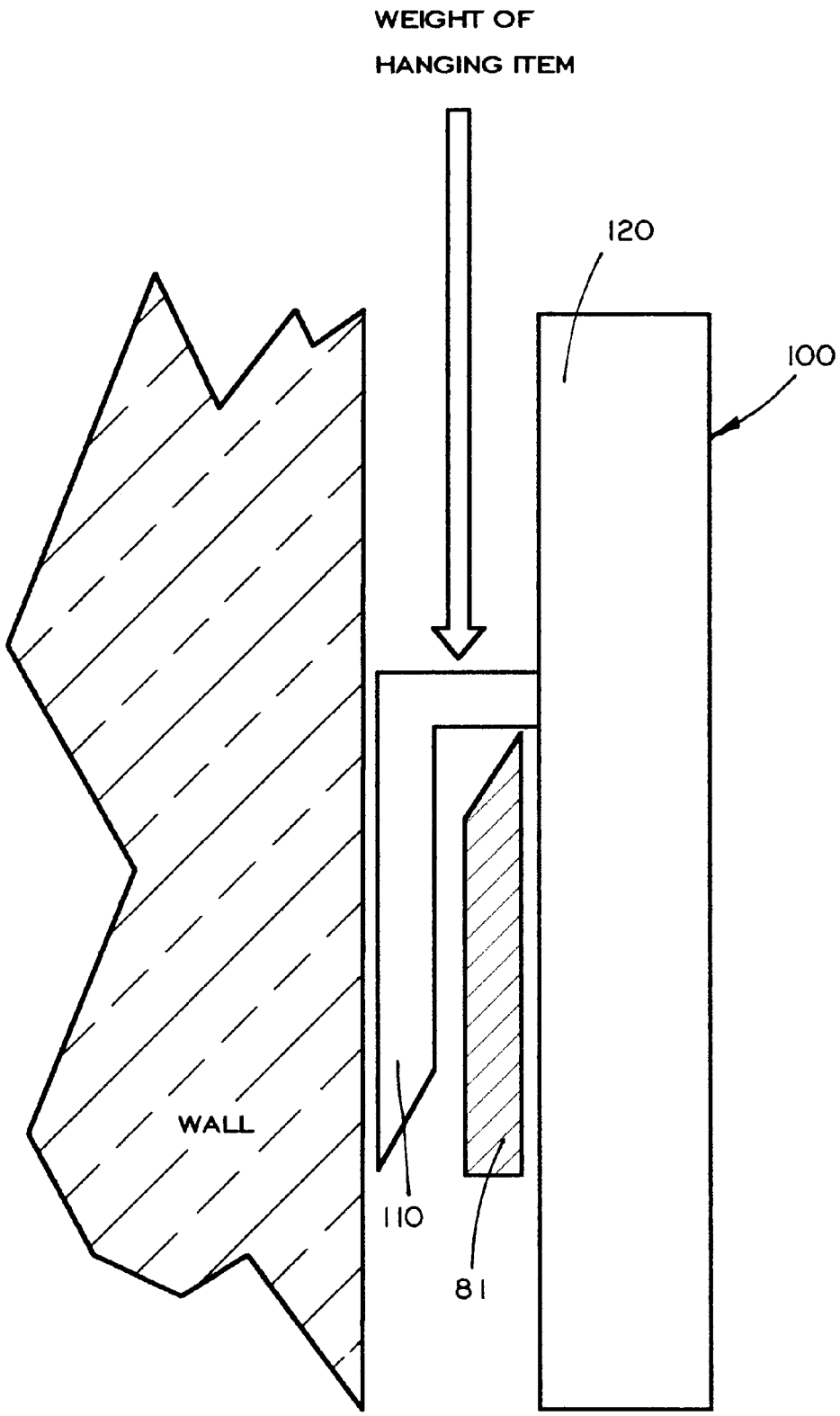
FIG. 5 is a partial side view similar to FIG. 4, except that the assembly is in a mounted position with the weight of the hanging item being supported by the wall bar mounted to the wall.

FIGS. 1 & 1A show a perspective view of a generic wall bar 80 or 80' that attaches to the wall and which may be used in the two-way adjustable embodiments such as those shown in FIGS. 8–29 and 48–49. FIG. 3 shows a side transparent view of generic wall bar 80 viewed along the lines a1–b1 and a2–b2, with wall bar 80 being attached to the wall.

Figure 6:
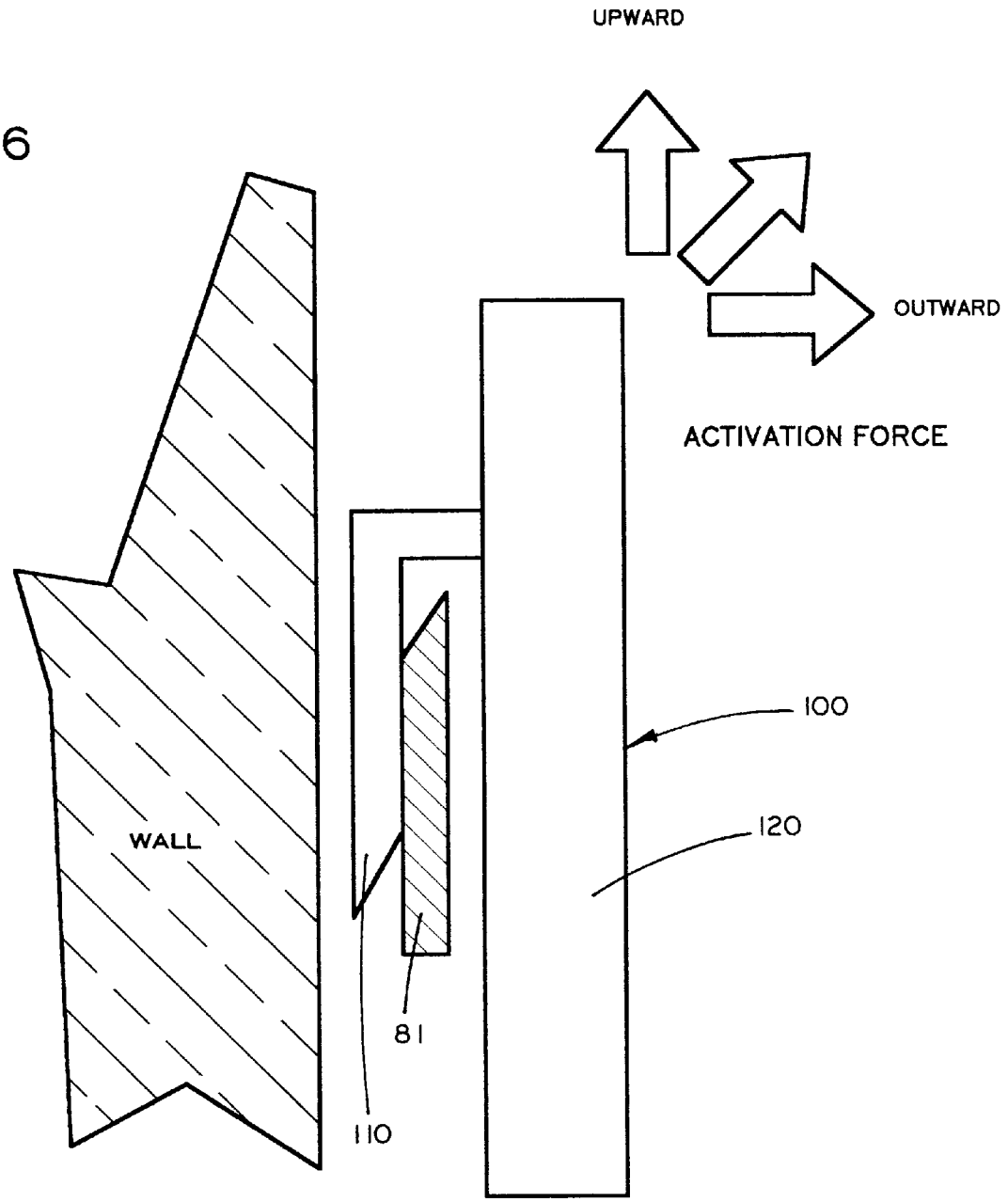
FIG. 6 is a partial side view similar to FIG. 5, except that the assembly is in an activated position caused by pulling upward and outwardly on the hanging item.
Figure 7:
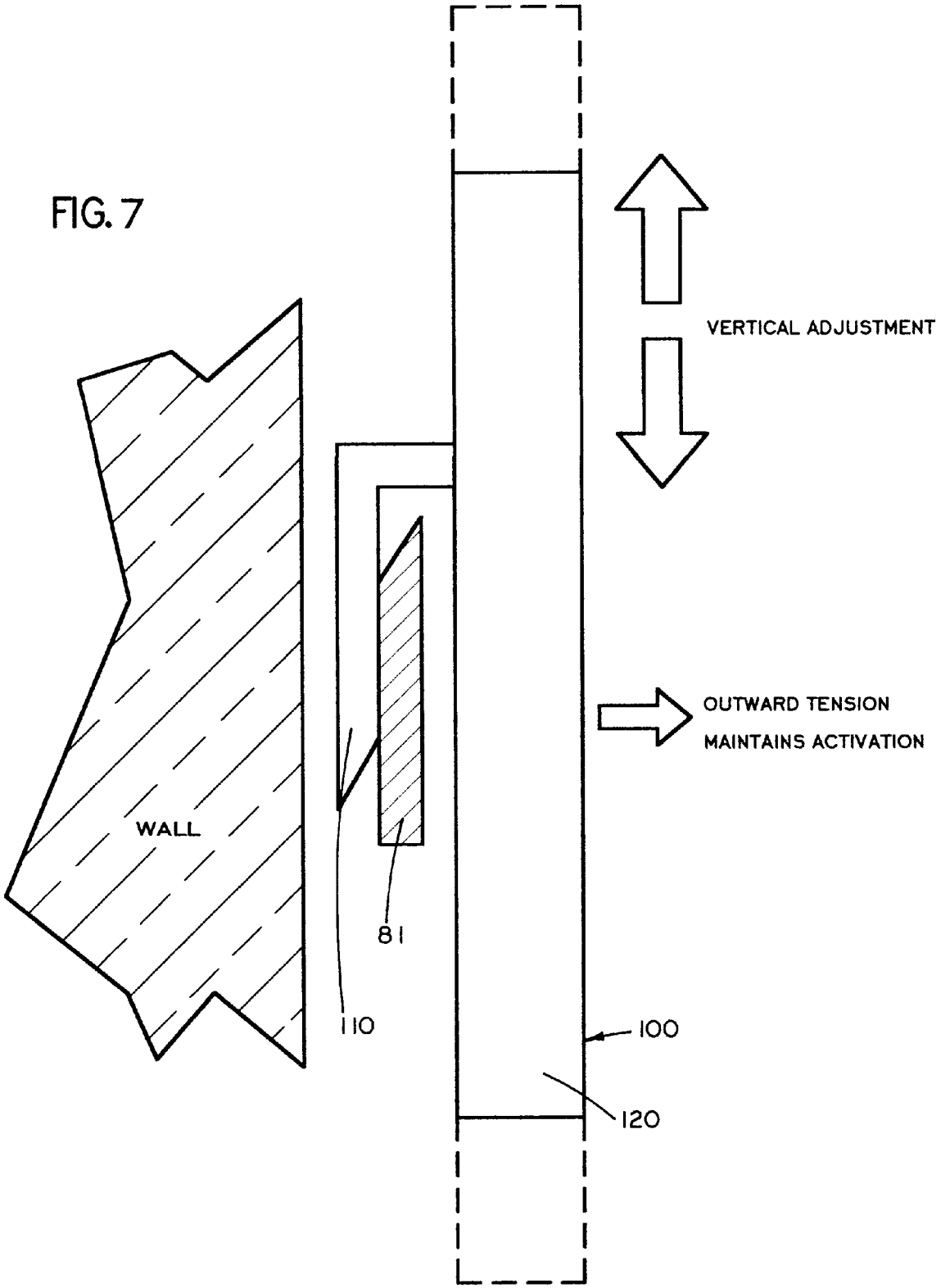
FIG. 7 is a partial side view similar to FIG. 6, with the assembly remaining in its activated position, but also showing vertical adjustment of the assembly (indicated in broken lines)

FIGS. 4–7 show a sequence wherein a generic adjustable mounting device having a downwardly pointing hook mounted on the rear of the item to be hung (such as in the embodiments of FIGS. 8–29 and 48–49) is seated on the horizontal bar 81 of generic wall bar 80 (see FIG. 1) and then activated for vertical adjustment. Typically in the embodiments of FIGS. 10, 11, and 13–21, this activation is achieved by pulling upward and outward on the hanging item, as shown in FIG. 6, and adjustment is typically accompanied by maintaining some degree of outward (away from the wall) tension on the hanging item, as shown in FIG. 7. The operation of the embodiments of FIGS. 8–9 and 22–29 is rather similar, except that they are activated by inward or inward and upward pressure, as discussed below.

FIGS. 8–29 illustrate embodiments of a two-way, in situ, automatic, substantially continuously adjustable mounting device wherein a vertically adjustable, downward pointing hook assembly is mounted on the rear of the item to be hung, and the hook assembly, in turn, mates with and horizontally adjusts on a wall bar 80, shown in FIG. 1, that is mounted to the wall (as shown in FIG. 3). The horizontal bar 81 of wall bar 80 (see FIG. 1) may be provided with stabilizer extensions (not shown) at each end to prevent sideways "wobble" or skew of the hanging item that might occur when the hook assembly slides all the way to one side of the wall bar. In reviewing the Figures, it should be kept in mind that, although the wall bar 80 shown in FIG. 1 presents a further aspect of the present invention, it is not a requisite. In other words, there are readily apparent embodiments of the present invention that are quite similar to many of the embodiments of FIGS. 8–29, but which only provide vertical adjustability.

Figure 8A:
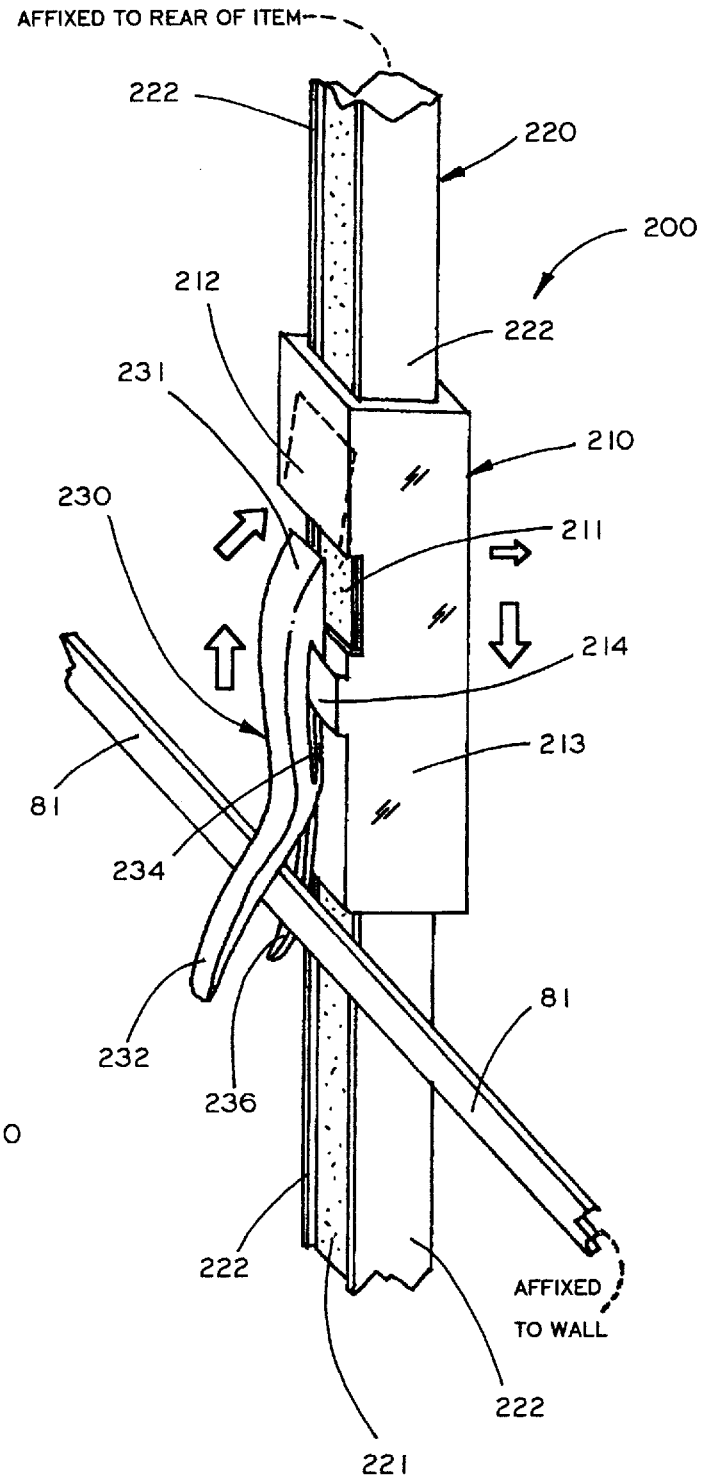
FIGS. 8 and 8A are two right top front perspective views of a two-way in situ adjustable embodiment having a hook and wedge that wedges into a brake trap, showing how the hook seats on the wall bar and showing how the wedge pivots toward and moves up into the brake trap.
Figure 8:
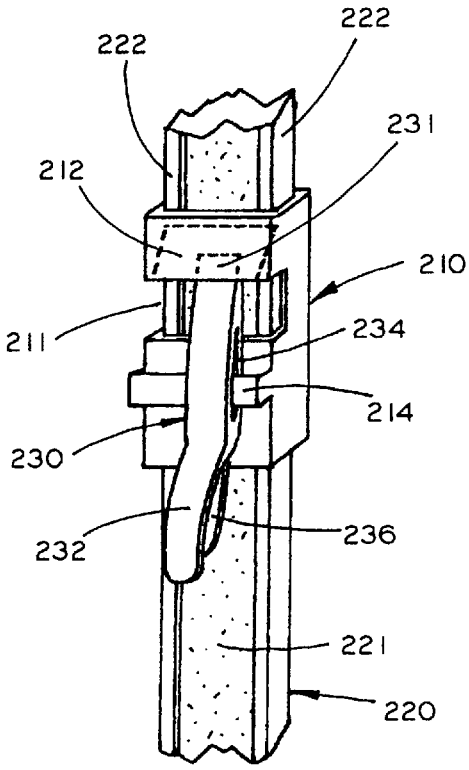

FIGS. 8 and 8A show an adjustable mounting device utilizing a wedge in sliding trap design. Vertical bar 220 is fixedly attached to the rear of the item to be hung, and includes guide rails 222 and brake strip 221. Vertically sliding along guide rails 222 and over brake strip 221 is sliding trap 210. Sliding trap includes body 213, brake trap window 211, trap pocket 212, and hook holder bar 214. Mounted on holder bar 214 is hook and wedge 230. Hook and wedge 230 vertically slides and partially pivots on bar 214 along slot 234. At the upper end of hook and wedge 230 is wedge 231, and at the lower end is hook 232 and wall bar catch 236. On the side of wedge 231 facing brake strip 221 is a high-friction surface, such as rubber or metal grating, chosen to provide the maximum grip with the surface of the material chosen for brake strip 221. The other side of wedge 231 facing the interior of pocket 212 may have a slick surface so that wedge 231 slides as far into pocket 212 as possible to increase wedging (described below). Pocket 212 is shaped with a triangular cross-section, coming close to meeting with bar 220 at the top section of pocket 212, and being its furthest away from bar 220 at its bottom section. Slot 234 extends down far enough in wedge and hook 230 so that holder bar 214 can almost, but not quite, contact the lowest point of slot 234 without wedge 231 being fully jammed in pocket 212. Slot 234 extends up far enough so that when holder bar 214 is proximate to the uppermost extent of slot 234, wedge 231 is fully within window 211 when viewed frontally.

In operation, the item to be hung is lowered with hook 232 above bar 81 (see FIG. 1 regarding the connection of bar 81 to the wall), such that hook 232 catches on bar 81. At this point, the item is pulled just slightly outward to ensure that wedge 231 pivots slightly and is fully within window 211. Then the item is lowered slightly further, causing hook and wedge 230 to slide upwardly on holder bar 214 until wedge 231 inserts into and then jams in pocket 212 between the interior face of pocket 212 and brake strip 221. Wedge 231 jams between pocket 212 and strip 221 because of the complementary shapes (generally wedge-shaped or triangular) of the brake strip facing side of wedge 231 and the interior face of pocket 212. At this point, due to the aforementioned jamming or wedging of wedge 231 between the sliding trap 210 and the vertical bar 220, sliding trap 210 is no longer able to move vertically along bar 220, and is locked in place; consequently, so is the item the weight of which is transferred through the crotch between hook 232 and catch 236 and onto bar 81. The item can however be freely moved horizontally, with the crotch between hook 232 and catch 236 sliding along the top of bar 81. Level hanging can be enhanced by configuring hook 232 to be sufficiently wide to prevent rotation of the item in the plane of the wall and out of alignment with the line of bar 81 (of course, it should first be ensured that bar 81 is hung level, such as through the use of a spirit level).

To adjust the item's vertical position once it is hanging as described above, the user pushes gently inwardly (towards the wall) on the item and then lifts the item up slightly while maintaining gentle inward pressure. This causes catch 236 to be forced into bar 81, exerting torque on hook and wedge 230 and forcing wedge 231 towards the wall, and it also moves the main point of wedging from the high-friction side of wedge 231 and brake strip 221 to the low-friction side of wedge 231 and the low friction interior of pocket 212. The upward pull on the item pulls vertical bar 220 upwards and at first this brings sliding trap 210 with it, because the two are jammed together. Because the high-friction wedging has been replaced with low-friction wedging, however, hook and wedge 230 is allowed to fall out of pocket 212 by its own weight. (The end of catch 236 can be extended and slightly curved so as to allow the user to apply a degree of upward pull through catch 236 and on the bottom of bar 81 to provide further assurance that hook and wedge 230 can become unwedged.) Thereupon, the continuance of inward pressure and upward pulling on the item causes wedge 231 to be lowered fully into window 211 and then to pivot slightly about holder bar 214 and outside of window 211 such that the tip of wedge 231 is physically outside of sliding trap 210. At this point, the vertical position of the item can be freely adjusted. Then, to relock the item once the desired vertical position has been reached, the user applies some outward tension on the hanging item (which causes hook 232 to be in tension with the wall-facing side of bar 81, applying torque on hook and wedge 230 forcing wedge 231 in against the outer surface of the top of trap 210) and pulls up slightly on the item until wedge 231 slips down and back into window 211. Finally, vertical locking is again achieved in the same way that it is right after hook 232 has been lowered onto bar 81, as described above.

Regarding the embodiment of FIG. 8, it might be desirable to place a small awning (not shown) right at the edge of pocket 212 that fronts window 211, for holding the tip of wedge 231 during vertical adjustment. The awning would be shaped with a slight curve such that the tip of wedge 231 would slide directly back to window 211 as soon as there is an outward pull on the hanging item. Note that the depth or thickness of rail 222 is exaggerated for the purposes of illustration, and its thickness should in reality be minimized so as to lessen the overall thickness of the assembly and gap between the hanging item and wall (see discussion below accompanying Tables 1 and 2). Also, the points of contact between sliding trap 210 and bar 220 should be made as slick as possible to allow convenient vertical adjustment.

FIGS. 9 and 9A show an embodiment that is similar to that of FIG. 8, except that the hook and wedge 230*a* is shaped somewhat differently than 230 of FIG. 8, particularly at slot 234*a*; the corresponding holder bar 214*a* is also shaped differently. Reference numbering in FIGS. 9 and 9A is the same as in FIG. 8, except that "a" is appended to the corresponding parts in FIGS. 9 and 9A. Note that guide rail 222*a* is much thinner than rail 222 is shown in FIG. 8, which, as noted, is exaggerated for illustration. FIGS. 9 and 9A also show a side view of hook and wedge 230*a*, and how its side facing brake strip 221*a* may have a high-friction surface while the opposing side (which faces the interior of pocket 212*a*) may have a low-friction surface.

Figure 10:
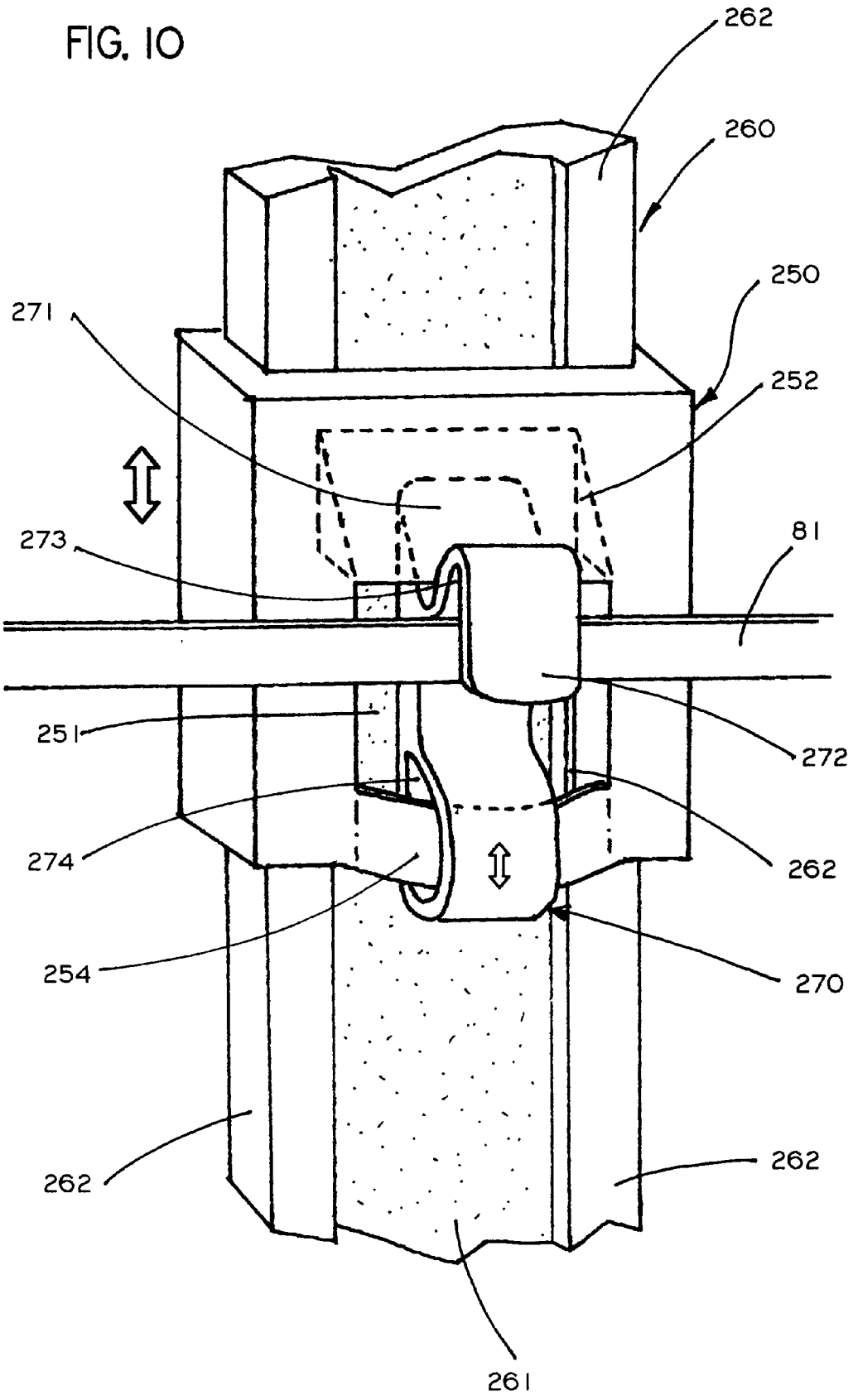
FIG. 10 is a top left front transparent perspective view of an embodiment similar to that shown in FIGS. 8 and 9 but having a hook that is closer to the wedge, showing the wedge nearly trapped in the trap.

FIG. 10 shows an embodiment that is similar to that of FIGS. 8 and 9, except that its configuration and activation forces are different. Activation of the embodiment of FIG. 10 consists of pulling up and out rather than pushing in and pulling up. Parts that correspond to those of FIGS. 8 and 8A are numbered with reference numbers 40 higher than those of FIG. 8 (e.g., guide rails 262 correspond to guide rails 222 of FIG. 8). As in FIGS. 8 and 9, sliding trap 250 slides vertically on guide rails 262 of vertical bar 260, and hook and wedge 270 in turn slides vertically and pivots a small amount via slot 274 on holder bar 254 of trap 250. In this embodiment, because the point at which hook 272 seats on bar 81 is on the same rather than the opposite side of holder bar 254 as wedge 271, pulling wedge 271 out of wedging from between brake strip 261 and the interior surface of pocket 252 requires that the user pull outward and upward on the hanging item rather than pushing inward and pulling upward. In other words, the pivoting action is opposite here because both the point to be moved and the point at which pressure are applied are on the same side of the fulcrum instead of at opposing sides of the fulcrum. Note that in FIG. 10, for purposes of illustration, crotch 273 of hook and wedge 270 is not shown as seated on bar 81. In situ, however, hook and wedge 270 would only be in the illustrated position if forced there by being seated on bar 81. When seated, with the weight of the hanging item transferred through crotch 273 onto bar 81 and into the wall, wedge 271 is jammed between the interior face of pocket 252 and brake strip 261. Similar to what is shown in FIGS.

9 and 9A, the side of wedge 271 facing brake strip 261 may have a high-friction surface.

To activate the assembly for vertical adjustment, the user applies outward tension on the hanging item and then lifts upwardly a bit on the item until wedge 271 unjams from between strip 261 and pocket 252. Because the embodiment of FIG. 10 is configured such that opening 274 does not extend up far enough, wedge 271 cannot entirely leave pocket 252 or escape through window 251.[1] Instead, wedge 271 can simply move down in pocket 252 such that the tip of wedge 271 is in a lower section of pocket 252 which is further from strip 261 (see the above description of the shape of similar pocket 212 of FIG. 8, which is similar to pocket 252). Then, while maintaining a modicum of outward pressure (which keeps wedge 271 pinned against the interior surface of pocket 252 but not jammed, and keeps the interior face of hook 272 pinned against the wall-facing side of bar 81), the user can pull the hanging item up or down, and sliding trap 250 will follow suit, sliding up and down along bar 260. (Optionally, there could be a catch on the lower part of the interior face of pocket 252 to hold onto wedge 271 during adjustment, or some other similar means to hold hook and wedge 270 together with trap 250 during the adjustment process). When adjustment is complete, the user simply releases the outward pressure, and then lowers the item until bar 81 forces wedge 271 (via pressure transmitted through crotch 273) to wedge between sliding trap 250 and brake strip 261. Note that opening 274 must extend downwardly far enough to allow holder bar 254 to move down without hitting the lower extent of opening 274 when wedge 271 is jammed between strip 261 and pocket 252 (i.e., when hook and wedge 270 reaches its highest point with respect to sliding trap 250).

[1] Although it is not shown in FIG. 10, this embodiment could also be configured similarly to that of FIG. 8 inasmuch as wedge 271 could leave pocket 252 entirely so as to be able to escape through window 251.

In this embodiment, to ensure that wedge 271 does not become irretrievably jammed (inasmuch as it cannot be unjammed in situ), a few optional devices could be employed. First, although it is noted above that the sliding trap should generally move as easily as possible along the vertical bar, there may be a modicum of friction between them so that when the item is pulled slightly upward, the whole jammed trap/hook and wedge does not simply follow downwardly on the bar, and instead separates from the bar such that a wiggle or shake on the item will cause the hook and wedge to fall out of the trap by its own weight. Another measure would be to press inwardly and then upwardly on the hanging item if wedge 271 stayed jammed, so that the bottom of bar 81 would hit the upward-facing surface of hook and wedge 270 just above opening 274 (which protrudes outwardly a bit), snapping wedge 271 downwardly and out from between pocket 252 and strip 261. Further, this surface could be fitted with a projection (not shown) which would hit the bottom of bar 81 when the hanging item is pulled upwardly even if the item were not pushed inwardly (although this may make it harder to initially seat crotch 273 over bar 81 when hanging the item).

Figure 11:
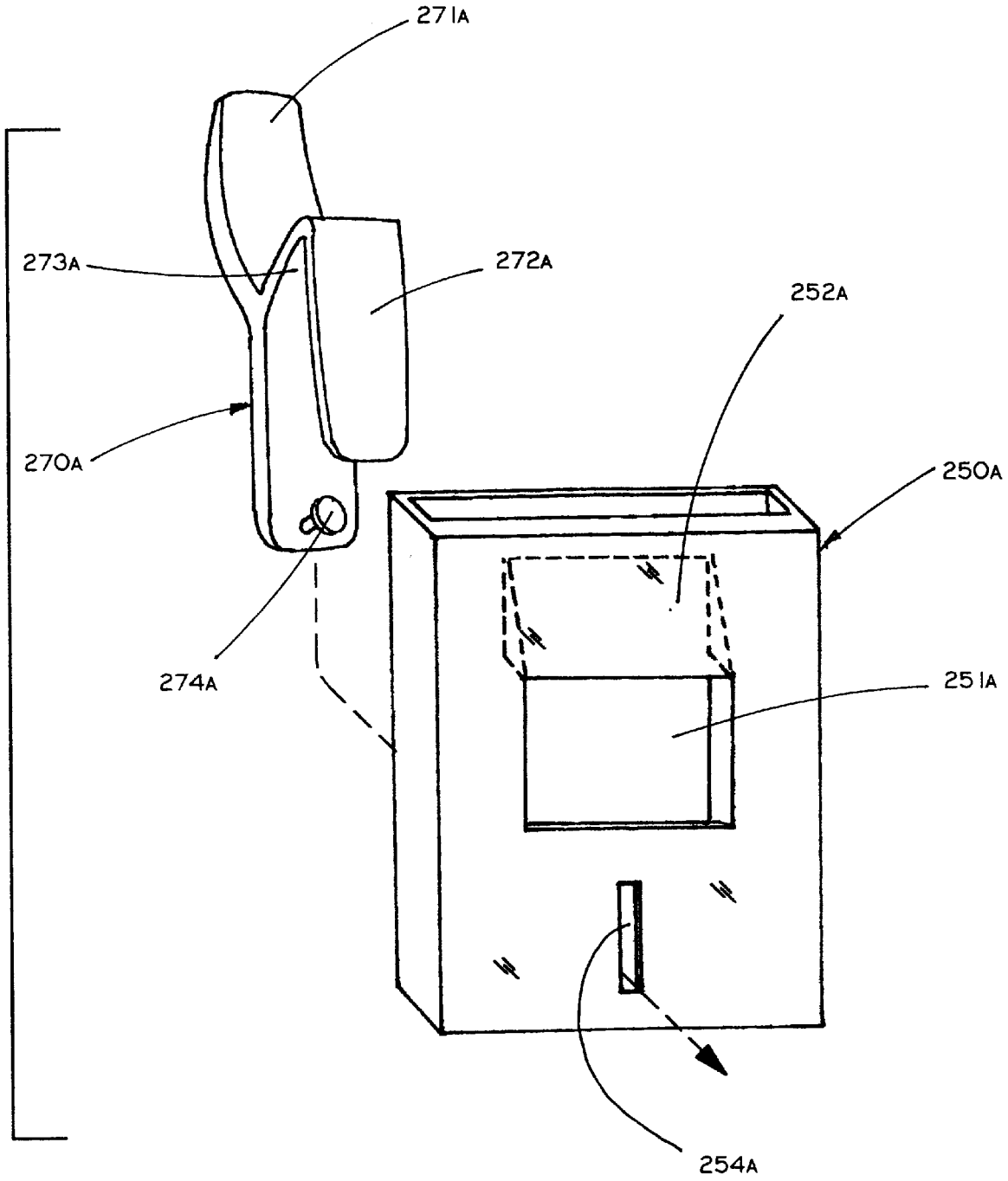
FIG. 11 is an exploded top left front perspective view of an embodiment similar to that shown in FIG. 10 but having a different sliding connection between the hook/wedge and sliding trap.

The embodiment of FIG. 11 is similar to that of FIG. 10, except that instead of having hook and wedge 270 connected to sliding trap 250 with a female/male vertically sliding arrangement (opening 274 on holder bar 254), this embodiment has a male/female sliding arrangement, with disk-capped rod 274*a* sliding through and slightly pivoting within slot 254*a*.

FIGS. 12 and 12A show a generic box 300 that can be adapted for use in the embodiments of FIGS. 13–21. Box 300 is fixedly mounted to the rear of an item to be hung by way of mounting ears 306, and has a hollow cavity 304, and a vertical slot 301. As viewed in FIGS. 12 and 12A, front side 303 of box 300 faces the wall and, in situ, will be adjacent to a mounting point on the wall such as wall bar 80 shown in FIGS. 1 & 3. In each of the embodiments of FIGS. 13–21, a downwardly pointing hook projects out through slot 301, along which it slides vertically during vertical adjustment.

The interior faces of sides 302 are chosen for the highest possible friction contact and gripping with the surface of the particular part of the embodiments of FIGS. 13–21 that will make contact there (discussed below). Conversely, the interior face of front face 303, and the slot sidewalls 307, may be coated with a slick surface such as TEFLON® in order to minimize friction with the downwardly pointing hook.

The interior faces of sides 302 should be of fairly high strength as some significant outward force may be applied to them by the apparatus described in FIGS. 13–21. Front face 303, however, will typically not be required to be as strong, so it can be fairly thin. As will be gathered from Tables 1 & 2 and the accompanying discussion, the overall thickness of box 300 may be very important in certain configurations (unless the box is incorporated or manufactured directly into, and flush with, the rear of a frame or the like). Thus, although the depth of sides 302 is exaggerated in FIGS. 12 and 12A for purposes of illustration, the thickness of front face 303, cavity 304, and rear wall 308 of box 300 should be minimized as much as possible, which means that materials such as case-hardened steel or high-strength polymers may be most appropriate (to withstand the aforementioned forces). As an example, using case hardened steel, front face 303 may be 1/64" thick, and rear wall 308 of box 300 may be 3/64" thick, with each measuring 2" wide by 4" tall; sides 302 may be 1/8" thick (excluding any interior coating such as rubber), and measure 4" tall by 5/32" deep. Such a configuration leaves a cavity 304 with a useable depth of (just less than) 3/32".

Figure 13:
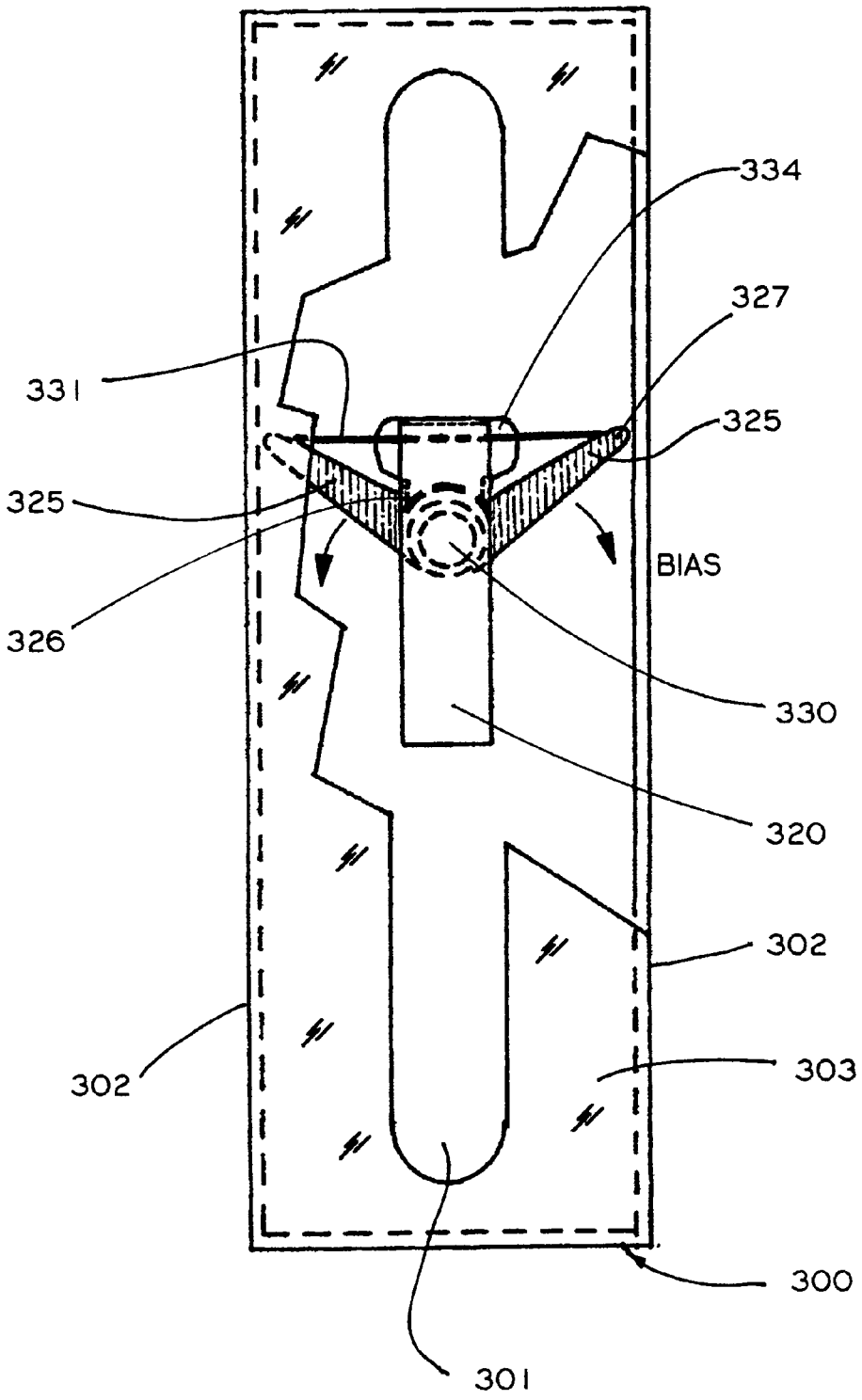
FIG. 13 is a partial left front transparent view of an embodiment providing two-way in situ adjustability and including a version of the box of FIG. 12.
Figure 14:
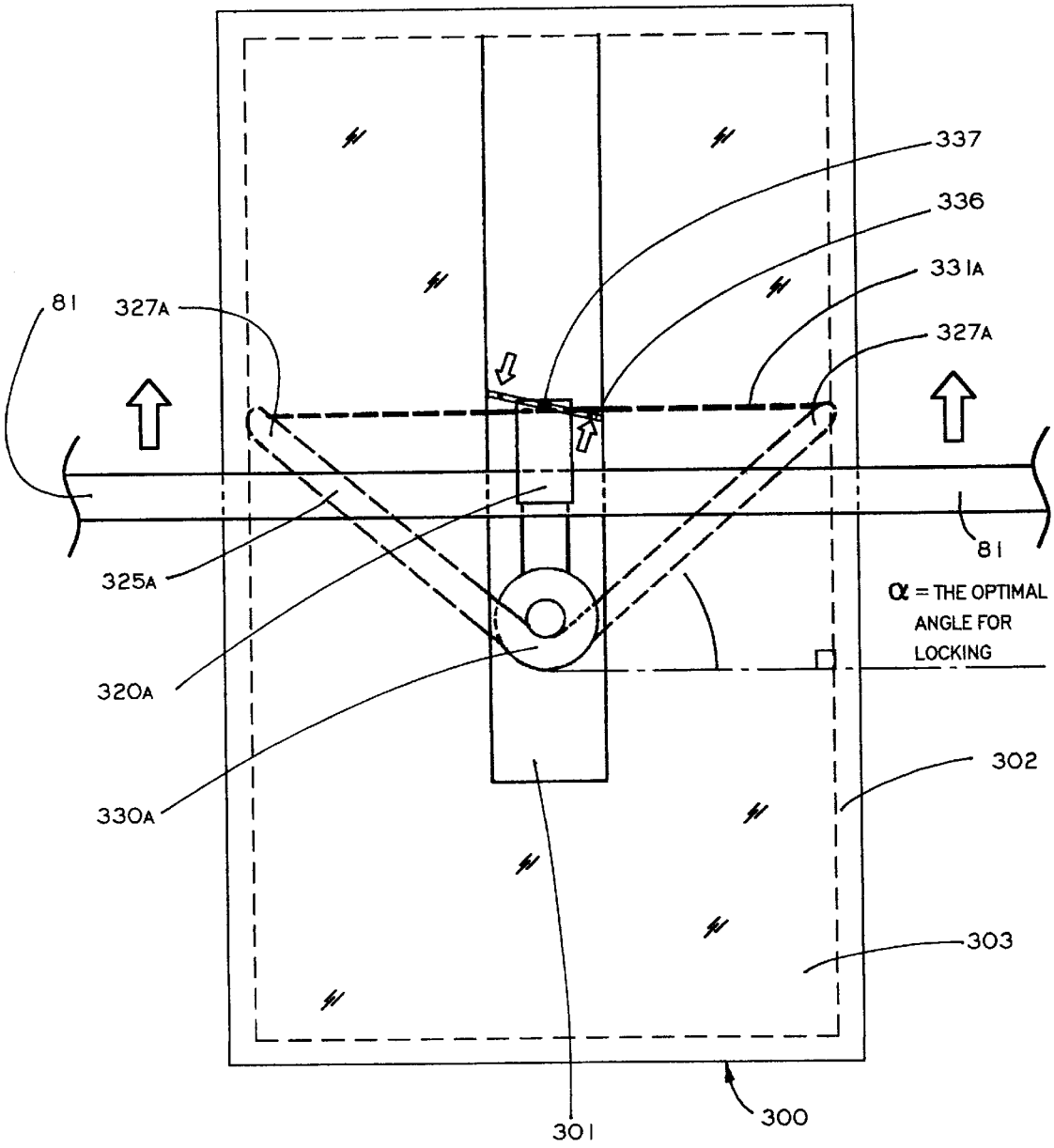
FIG. 14 is a transparent frontal view of an embodiment similar to that shown in FIG. 13.

FIGS. 13 and 14 show embodiments of the invention that are useable with a box similar to that of FIGS. 12 and 12A, and which utilize a bending hook and biased wings or arms assembly that slides vertically within the box during vertical adjustment. FIGS. 15–21 show embodiments of the invention that are also useable with a box similar to that of FIGS. 12 and 12A, and which utilize different configurations of an unbending hook and flippers that vertically adjustably slides within the box.

FIG. 13 shows a hook and wing assembly within a box. Hook 320 is "U" shaped, projects through slot 301, and includes a downwardly pointing portion that extends outside of the box and catches bar 81. The other end of hook 320 is attached to joint 330, which in turn has two wings 325 attached to it. At their inner radius, wings 325 are directly attached to each other with compressed spring 326; near their tips 327, wings 325 are attached by a taut cable 331. Taut cable 331 in turn passes underneath the top part of the upside-down "U" of hook 320. Optional vertical stabilizer lips 334 may be behind cable 331. The operation of this embodiment is partially similar to that of the embodiments of FIGS. 15–21 discussed below, inasmuch as locking is achieved in the same way, and is enhanced with the weight of the hanging item (see discussion below). In this embodiment, however, tips 327 are locked against the interior faces of sides 302 when at rest, and pulling outward on the item causes this locking to be released. Pulling outward on the item releases the locking because the arm of hook 320 which connects to joint 330 is somewhat flexible, and outward tension causes it to bend outward through slot 301 and outside of box 300, taking part of cable 331 with it. Since cable 331 tautly connects tips 327 of wings 325, pulling outward on cable 331 pulls tips 327 toward each other and away from engagement with the inner surfaces of sides 302. Releasing tension allows them to relock. As is discussed regarding some of the vertically sliding assemblies of the embodiments of FIGS. 15–21 below, when outward tension is maintained on the hanging item, pulling up or down on the hanging item causes the vertically sliding assembly of this embodiment to follow suit, sliding up or down within cavity 304 and slot 301 of box 300.

FIG. 14 shows a bending hook embodiment that is quite similar to that of FIG. 13, except for its substitution of arms 325*a* for wings 325 and the substitution of sprung joint 330*a* for joint 330 and spring 326, and the addition of rotating safety catch 336. As a consequence of the addition of rotating catch 336, the operation of this embodiment is partially different than that of FIG. 13, in that pulling outward will not activate vertical adjustability unless the hanging item is first pulled upwardly a slight amount. That is because when the hanging item is hanging, bar 81 has the top of hook 320*a* and also catch 336 resting on it. This forces catch 336 to rotate on axle 337 into a flat horizontal position that cause its arms to physically lie behind and obstruct the edges of face 303 adjacent to slot 301. When the item is pulled upwardly, however, catch 337 no longer rests behind any part of face 303 and is fully visible in slot 301, because axle 337 is biased to rotate catch 336 out of the horizontal position, and this occurs as soon as bar 81 is no longer in contact with it. Consequently, after this upward pull on the item, applying outward tension on the item will cause hook 320*a*, unrestrained, to pull on taut cable 331*a*, causing tips 327*a* to disengage from the interior surfaces of sides 302, allowing adjustment as described regarding FIG. 13.

Figure 15:
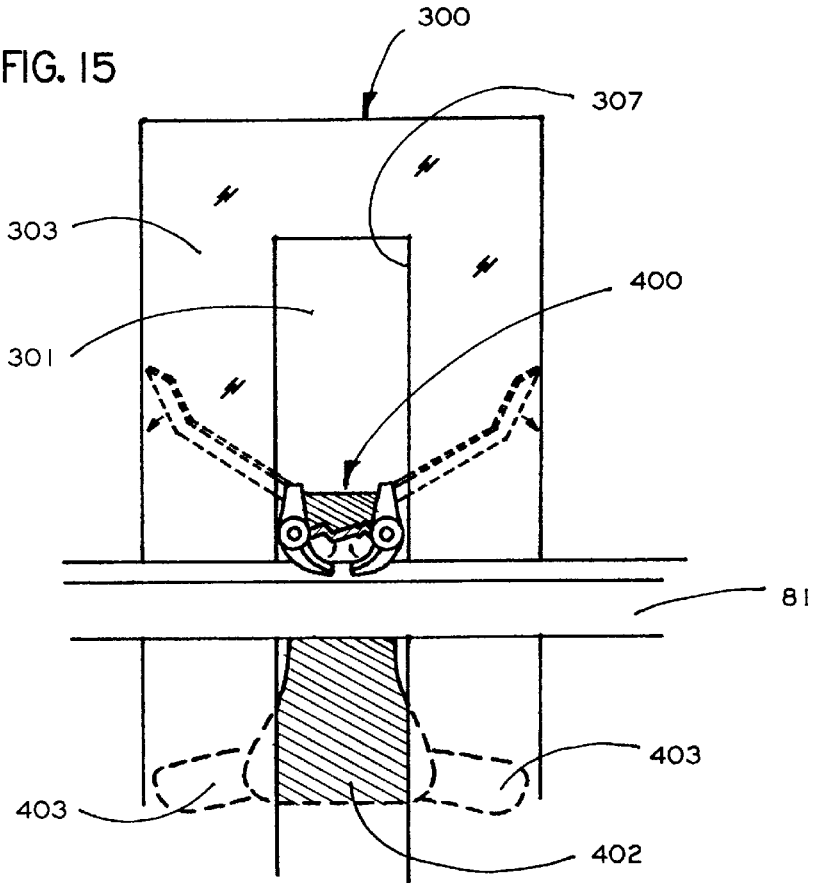
FIGS. 15 and 15A are a top front perspective cutaway transparent view and a close-up view of part of an embodiment providing two-way in situ adjustability, showing its actuators hitting the wall bar and the attached biased flippers moving towards the inner walls of the box.
Figure 15A:
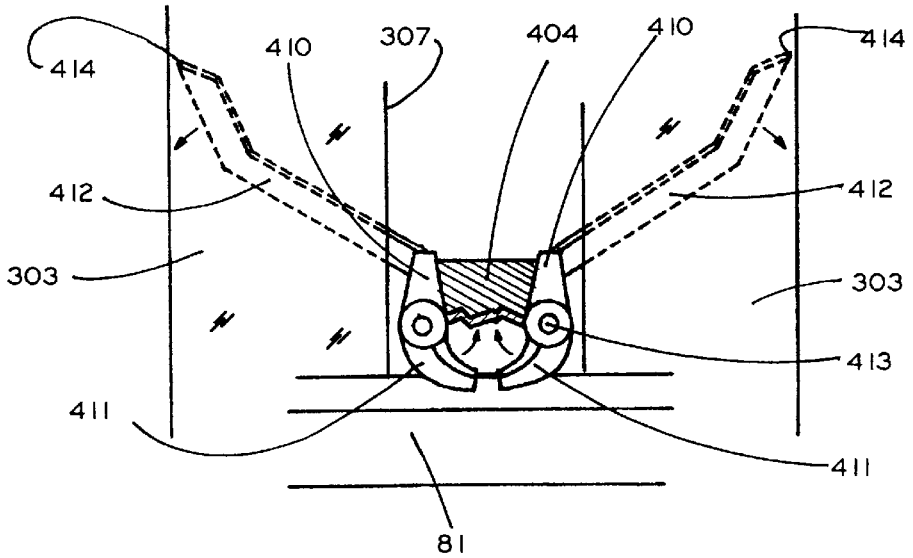
Figure 16:
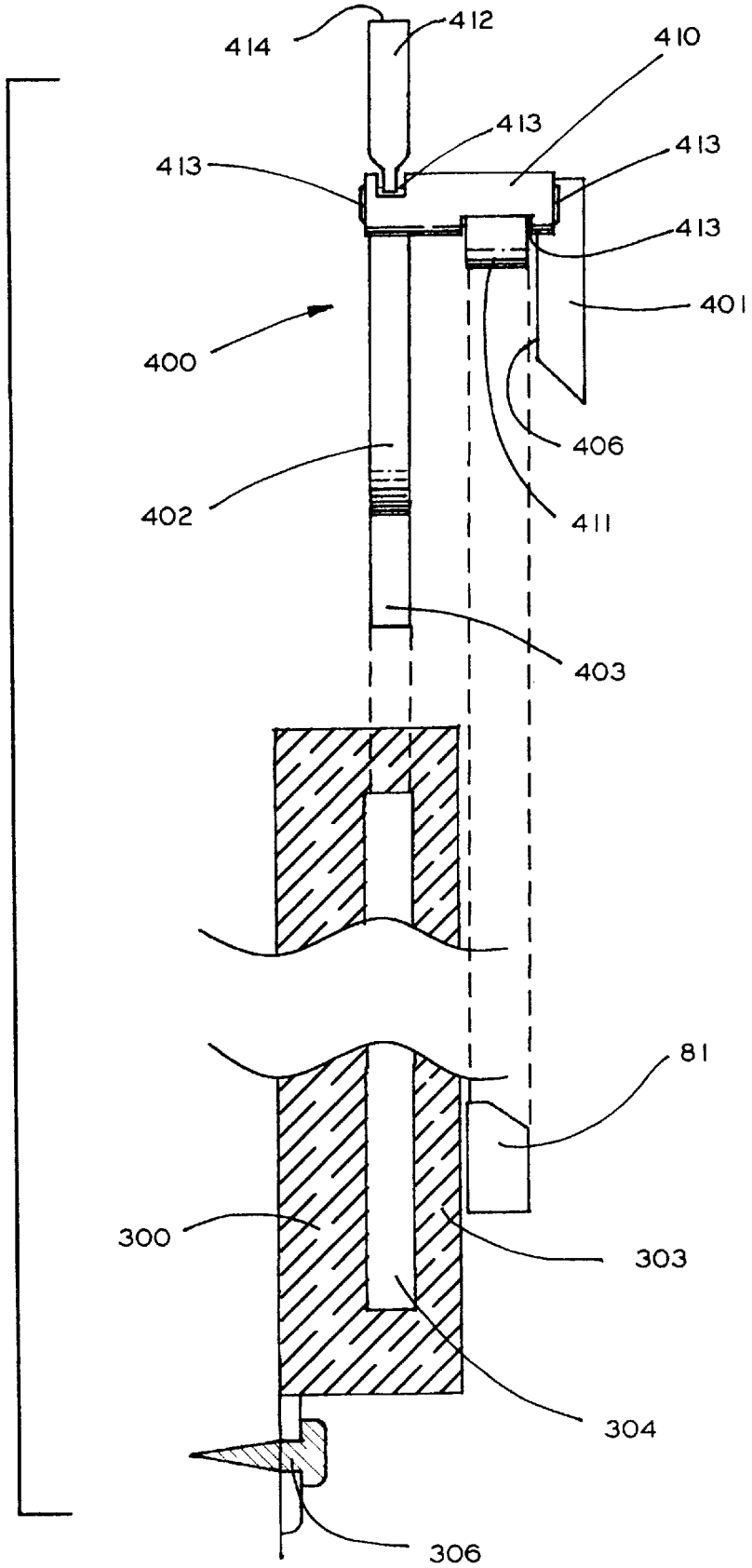
FIG. 16 is an exploded partially transparent side view of the embodiment of FIG. 15, showing how the sliding hook assembly resides in the cavity of the box and how the flipper actuators rest on the wall bar and how the hook resides behind the wall bar.
Figure 17:
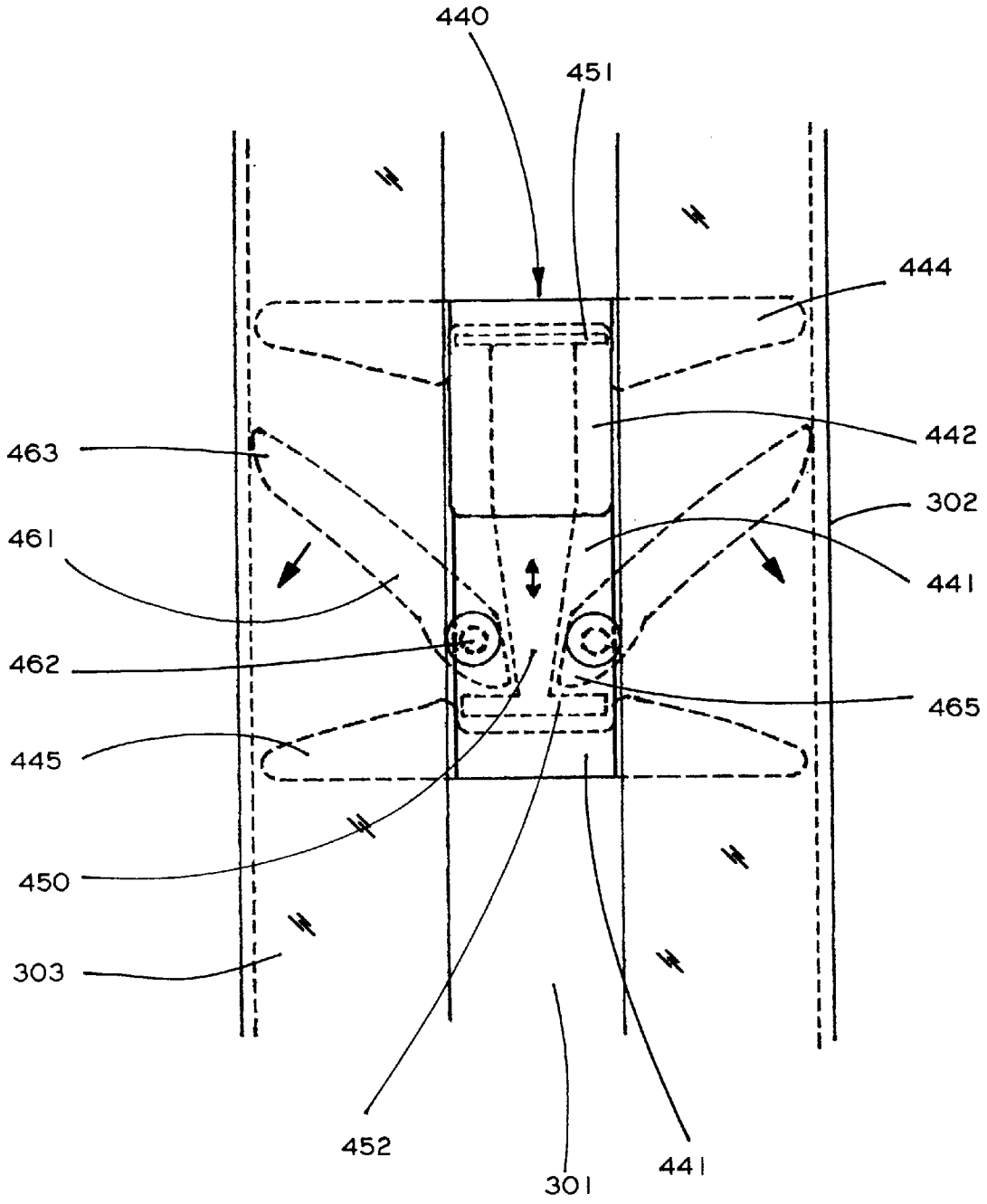
FIG. 17 is a transparent frontal view of an embodiment similar to that shown in FIGS. 15 and 16 but having a hook that is above the flippers.
Figure 18:
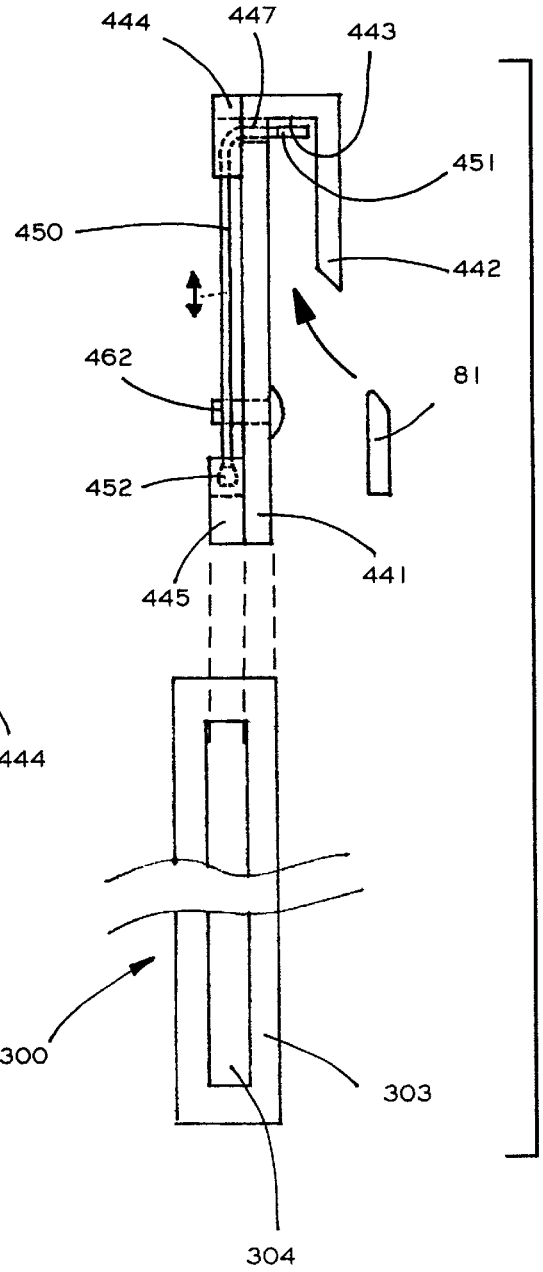
FIG. 18 is an exploded partial side transparent view of the embodiment shown in FIG. 17, showing how the sliding assembly resides primarily in the box, and showing where the hook rests on the wall bar.
Figure 19:
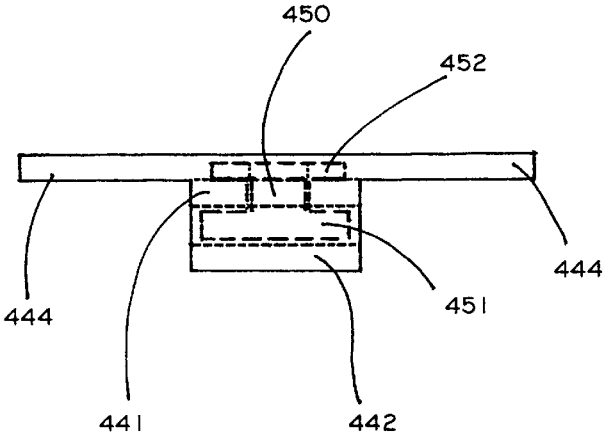
FIG. 19 is a partial transparent top view of the embodiment shown in FIGS. 17 and 18.
Figure 20:
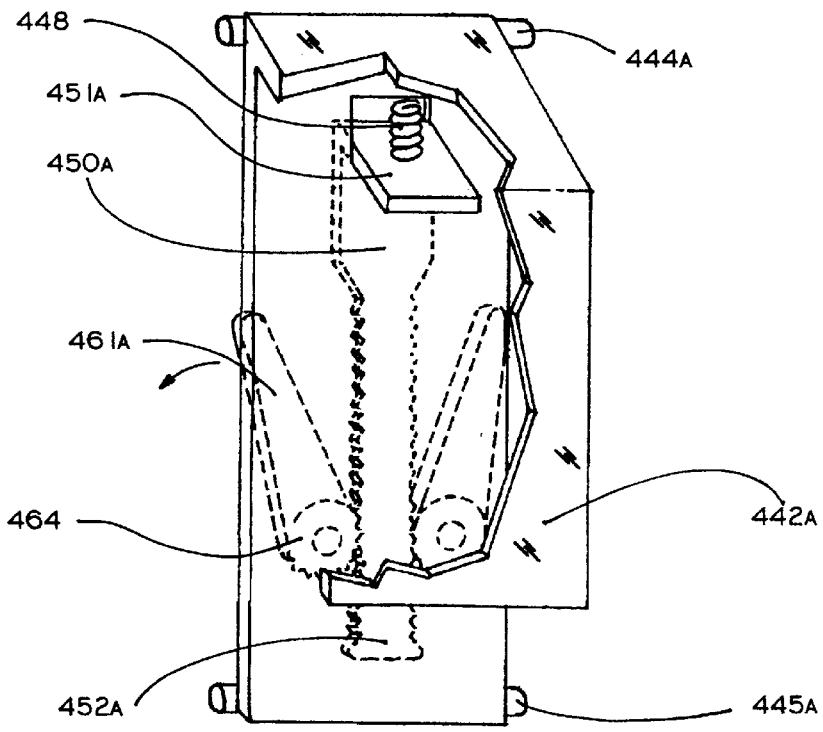
FIG. 20 is a partial left top front transparent perspective view of an embodiment similar to that shown in FIGS. 17–19, but having a different actuator.
Figure 21:
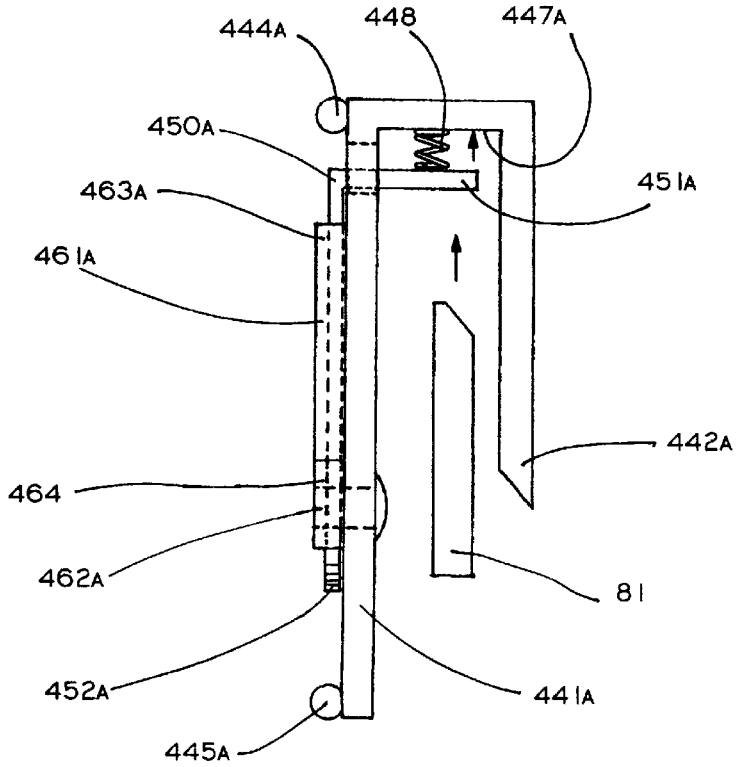
FIG. 21 is a partial transparent side view of the embodiment shown in FIG. 20.

FIGS. 15, 15A, and 16 show an unbending hook and flippers embodiment wherein the hook is below the flippers, while FIGS. 17–19 show a similar embodiment wherein the hook is above the flippers. FIGS. 20 and 21 illustrate an alternative embodiment to that of FIGS. 17–19.

FIGS. 15, 15A, and 16 show that vertically sliding hook assembly 400 resides primarily in cavity 304 of box 300. Therein, it may slide up and down with part projecting through slot 301, as can be seen from FIG. 16. Assembly 400 includes hook 401 (which is cutaway in the Figure where it connects to upper body 404 near the front, top region of assembly 400) which points downwardly and may be wedge-shaped to facilitate easy "finding" of bar 81 (which is attached to the wall as part of wall bar 80) when the hanging item is hung. Likewise, the top of bar 81 may be complementarily wedge-shaped in part (although not too much, as it may get stuck behind actuator 411) as shown in FIG. 16. Hook 401 connects to upper body 404 which connects axle housings 410. Upper body 404 is also connected to lower body 402 which includes wings 403 which serve to prevent rotation of assembly 400 within cavity 304 in the plane of the hanging item. Lower body 402 is completely contained within cavity 304, and part of upper body 404 passes through and outside of front face 303 of box 300. Axle housings 410 run orthogonal to the plane of the hanging item and box 300, and contain axles 413 which rotate freely therein. Near the front end of axles 413 are connected downwardly facing flipper actuators 411. Near the rear end of axles 413 are connected upwardly facing flippers 412. Flippers 412 include wedging tips 414 which are designed to readily wedge into and grasp the interior faces of sides 302 of box 300 under a small amount of force. Axles 413 are biased within housings 410 such that, at rest, tips 414 of flippers 412 are just slightly away from the interior faces of sides 302, and actuators 411 each form an acute angle with the plane of upper body 404.

Accordingly, when hook 401 of the item to be hung is positioned over and lowered onto wall bar 80, actuators 411 hit the top surface of bar 81, causing them to counterrotate with their tips moving upwardly (indicated by arrows in FIG. 17). At the same time, this causes axles 413 to counterrotate, and flippers 412 to rotate their tips 414 downwardly (indicated by arrows in FIGS. 17 and 17A) and into the interior surfaces of sides 302. Thereupon, wedging tips 414 bite into sides 302 (which may be, for example, rubber coated); any further downward force on the hanging item, such as that due to its own weight, simply causes tips 414 to bite even more strongly, and hook 401 of assembly 400 is locked in its vertical position. Further downward force on the hanging item may increase the locking bite of tips 414 through at least two mechanisms; first, any added rotation at actuators 411 will further rotate tips out towards sides 302; second, the added downward force on tips 414 applied by sides 302 simply applies further leverage at tips 414 causing them to attempt to rotate further outward.

To accomplish in situ, automatic, vertical adjustment, the user pulls slightly upwardly on the item, which allows the bias of axles 413 to unlock tips 414 from the interior faces of sides 302. The user then pulls slightly outwardly on the hanging item, such that hook inside face 406, which may have a somewhat high-friction surface, is in tension with the wall-facing side of bar 81. Maintaining this tension, the user then simply pulls the hanging item up or down to a desired level and then releases the outward tension. When the user is pulling the hanging item up or down, sliding assembly 400 follows suit, sliding vertically in cavity 304 and slot 301. When outward tension is released, the user holds the vertical position of the hanging item, whereupon sliding assembly 400 falls downwardly by its own weight and onto the top of bar 81, causing actuators 411 to rotate axles 413 and drive tips 414 into sides 302. Then, as the user lets go of the hanging item, the weight of the hanging item locks tips 414 into sides 302, as described above.

FIGS. 17–19 show an embodiment that operates somewhat similarly to that of FIGS. 15, 15A, and 16, except that the area on which the hook rests on the wall bar is above the flippers. In this embodiment, sliding hook assembly 440 consists of three layers, which can best be seen in FIG. 18 (which omits the flippers for clearer illustration). One layer resides entirely in cavity 304 of box 300, the second layer, adjacent to the first, resides in slot 301, and the third layer, adjacent to the second, resides outside of box 300. The first layer includes lower tabs 445 and upper tabs 444 which keep the assembly 440 aligned, and it includes flippers 461 and part of flipper axles 462. The second, middle, layer includes mid-body 441 of assembly 440, trigger channel 449, and part of axles 462. The third, outside, layer includes hook 442 and hook ceiling 447.

Also, trigger 450 runs through all three layers, starting with actuator bar 452 in the first layer just below axles 462, running up to and through trigger channel 449 in the middle layer, and into the third layer where it ends with trigger plate 451 which is parallel to and just below hook ceiling 447. Trigger 450 does not fall out of assembly 440 because trigger plate 451 is wider than channel 449, and because actuator bar 452 cannot rise above actuator tips 465 which are almost the same thickness as cavity 304. Also, trigger 450 has enough strength to substantially retain the right angle bend at its top adjacent to plate 451 when under pressure from bar 81.

Operation of this embodiment is similar to that of the embodiment of FIGS. 15, 15A, and 16, except that trigger plate 451 is lowered down onto bar 81, whereupon trigger plate 451 rises (channel 449 having enough vertical leeway for it to do so) close to or adjacent to ceiling 447. As it does so, trigger 450 pulls actuator bar 452 upwards whereupon it strikes actuator tips 465 at the bottom of flippers 461, causing wedging tips 463 to drive into the interior faces of side 302, locking the vertical position in box 300 of assembly 440. As in the embodiment of FIGS. 17 and 18, flippers 461 and/or axles 462 are preferably biased toward the unlocked position, and the weight of a hanging item increases their locking once they have "bitten" (which is accomplished by lowering hook 442 down behind bar 81 whereupon trigger plate 451 is pressed upwards, raising actuator bar 452 into actuator tips 465 sufficiently to overcome the aforementioned bias).

A major advantage of this embodiment is that hook ceiling 447—which is substantially the vertical point that rests atop bar 81—is very close to the top of assembly 440. Assembly 440, in turn, can come very close to the top of box 300, assuming slot 301 is extended up sufficiently. Accordingly, the range of vertical adjustability is enhanced, and the preferable range of adjustment which is closer to the top of the hanging item (see Tables 1 and 2 and accompanying discussion) is not wasted.

FIGS. 20 and 21 show an embodiment similar to that of FIGS. 17–19, with the main difference being the addition of geared axle heads 464 at the ends of axles 462*a*, and the substitution of toothed actuator rod 452*a* for actuator plate 452. The teeth of actuator rod 452*a* mesh with the gears of axle heads 464. As shown, rod 452*a* may also increase in width towards its bottom. Further differences in this embodiment are the addition of springs 448 between ceiling 447*a* and the top of plate 451*a*, and the substitution of guide rods 444*a* and 445*a* (which may be, for example, TEFLON®-coated), for tabs 444 and 445, respectively.

Figure 22:
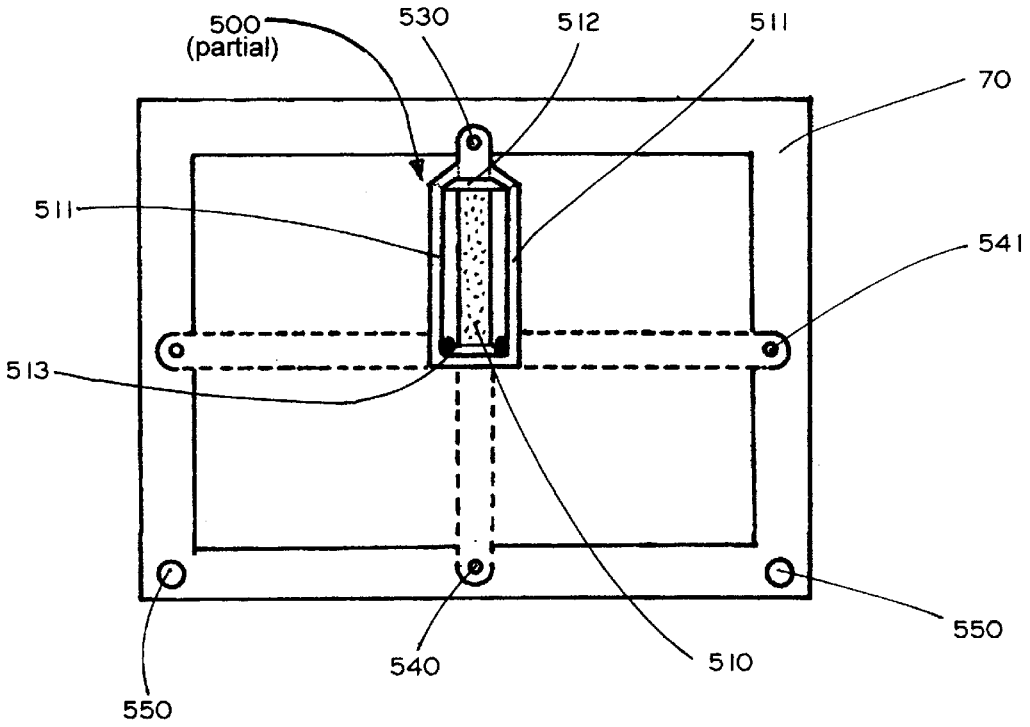
FIG. 22 is a frontal view of part of a two-way, in situ adjustable embodiment that attaches to the rear of a frame or the like, showing how the brake pad and rail assembly may be attached.

FIG. 22 shows an embodiment having two parallel guide rails 511 attached on either side of a brake pad 510. Brake pad 510 can be rubber, grooved metal or plastic, or other like means that are well known in the art. Relative to rails 511, brake pad 510 is depressed towards the rear of the item to be hung. Assembly 500 is preferably positioned on frame 70 so as to extend from the top portion to about the midpoint of the frame 70; attachment may be by nail, pin, glue, et cetera. A small extension 530 can project from the top for nailing to the top of frame 70 of the item to be hung. Additionally, a manually adjustable-lengthed (or one sized to fit standard frames) bottom extension 540 can be used to attach to the bottom of the frame, or, alternately, a horizontal bar 541 (manually adjustable or in stock lengths) can be provided at the bottom of assembly 500, to allow attachment to the sides of frame 70. Another alternative is to provide a flat-backed assembly that can be glued or similarly adhered to a suitably flat rear surface of an item to be hung. Such an adhesive could be preapplied to the back of the assembly, and covered with a peel-off plastic liner.

Because assembly 500 may create some physical obstruction between the frame 70 and the wall, felt spacer pads 550 can be provided for placement at the bottom corners of frame 70 to allow equalization and control of the distance from the wall. Also, such pads could be placed at the top corners of frame 70, although they may need to be slightly compressible to accommodate the inward force which activates vertical adjustability (discussed below). Further, such pads, if placed at the top of frame 70, could serve as a biasing means to urge the top of frame 70 just slightly further away from the wall than assembly 500 would dictate, ensuring that the hanging item would not accidentally unlock (locking and unlocking is described below).

Figure 23:
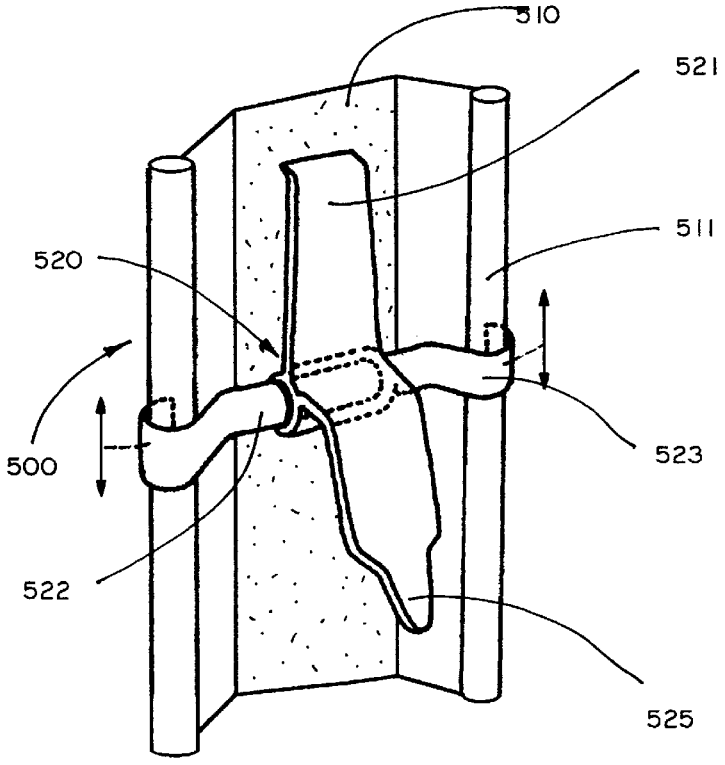
FIG. 23 is a top left front perspective view of part of the embodiment of FIG. 22, showing how the vertically sliding hook attaches to and moves relative to the brake pad and rail assembly.

Finally, there may be a projection 512 at the top of brake pad 510 that serves as an upper stop for the brake foot 521 (see FIG. 23), and there may be projections 513 at the bottom of guide rails 511 to serve as lower stops for sliding grips 523 (see FIG. 23).

In FIG. 23, the connection of vertically sliding hook assembly 520 to guide rails 511 and brake pad 510 is shown. Hook assembly 520 can travel up and down rails 511, unless brake foot 521 is engaged with brake pad 510. It can be seen that brake pad 510 is attached to guide rails 511 down their length, however, this attachment could alternatively just be at the top and bottom (similarly to the embodiment of FIG. 30), allowing sliding grips 523 to fully enclose or wrap around rails 511.

Figure 24:
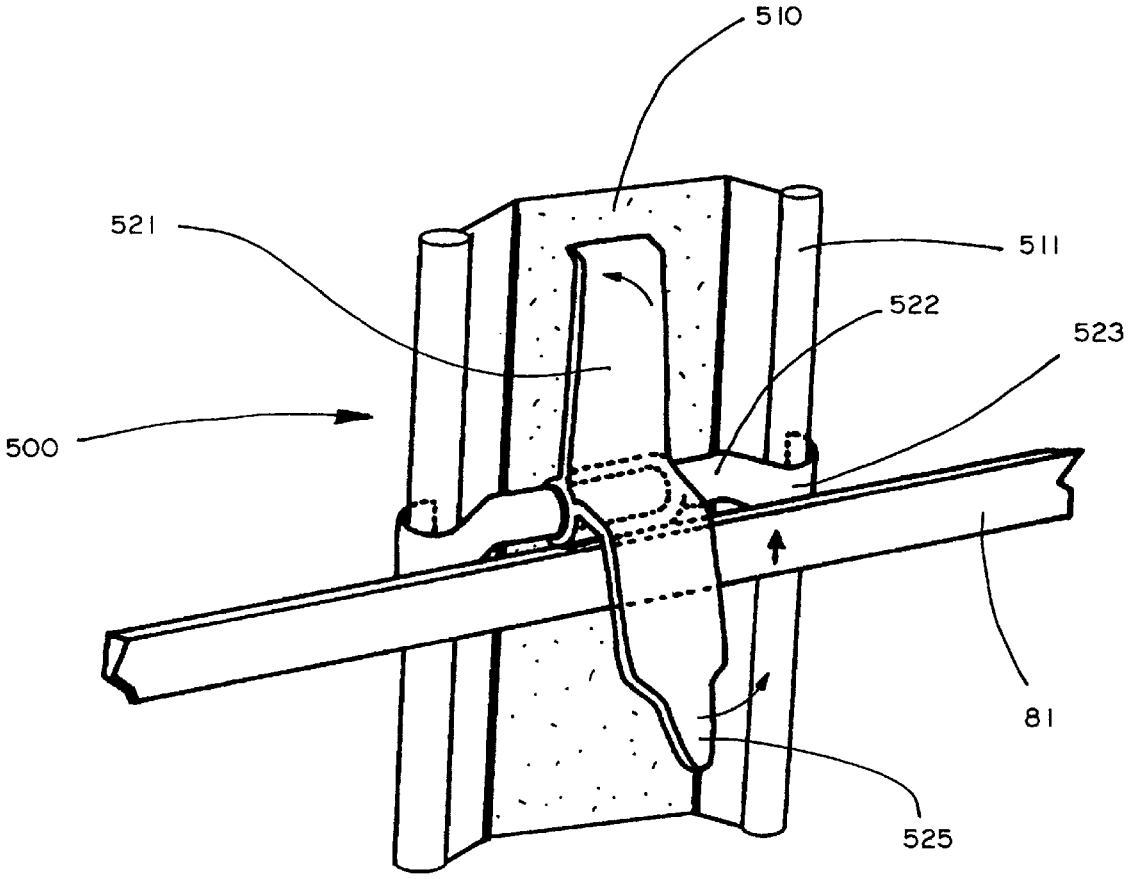
FIG. 24 is a top left front perspective view of the embodiment of FIGS. 22 and 23, showing how the hook seats on and mates with the wall bar, causing the brake foot to catch in the brake pad under load.

As shown in FIGS. 23 and 24 (indicated with arrows), when loaded with a hanging item, hook 525 rotates counterclockwise as viewed from the left side perspective, causing engagement of brake foot 521 with brake pad 510. FIG. 24 shows how the bar 81 of wall bar 80 (not fully shown), which is statically connected to the wall (see FIGS. 1 and 3), applies a relative upward force in opposition to the load of hook 525, causing hook 525 to rotate about axis 522, forcing the distant end of brake foot 521 to rotate into brake pad 510. It can also be seen from FIG. 24 that hook assembly 520 can freely slide left or right upon bar 81. In applications where a single mounting device is to be used, it may be desirable to provide axle 522 with some means (e.g., opposing locking nuts) of manually adjusting and locking hook 525 and brake foot 521 at some lateral position between sliding grips 523 so as to allow for compensation of centering errors in attachment of assembly 500 to frame 70, ensuring that the item hangs level. Leveling may also be induced by sliding grips 523 resting on bar 81 at either side of hook 525.

Figure 25:
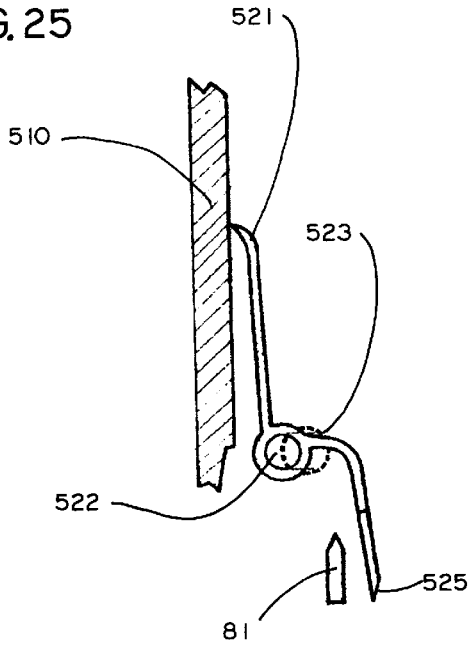
FIGS. 25 and 25A are a partial side view of the embodiment of FIGS. 22–24, with a sequence showing how the hook seats on and mates with the wall bar, causing the brake foot to lock in the brake pad under load.
Figure 25A:
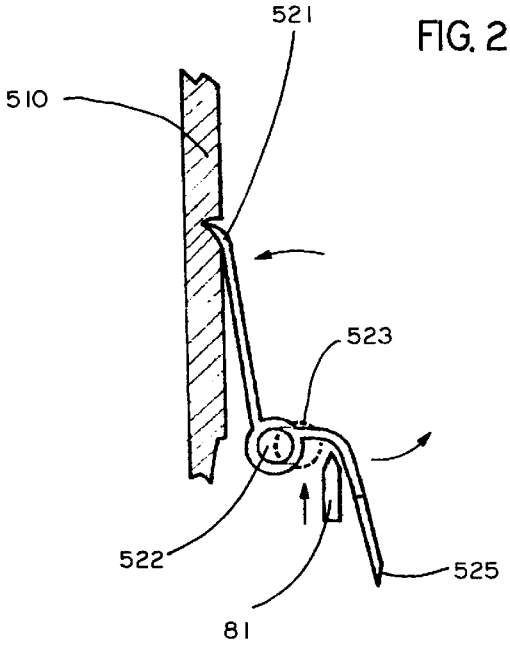

FIGS. 25 and 25A show a sequence wherein hook assembly 520 is seated over bar 81, causing engagement and locking. Bar 81 nests between hook 525 and the front extent of sliding grips 523 (shown in phantom). To facilitate insertion and seating of hook 525 behind bar 81, it may be beneficial to form hook 525 at somewhat of an angle. But, to prevent that angle from causing the tip of hook 525 to excessively impinge on the wall, the portion of hook 525 that extends below bar 81 may comprise an easily flexible but resilient material such as plastic, and simply act as an insertion guide.

Figure 26:
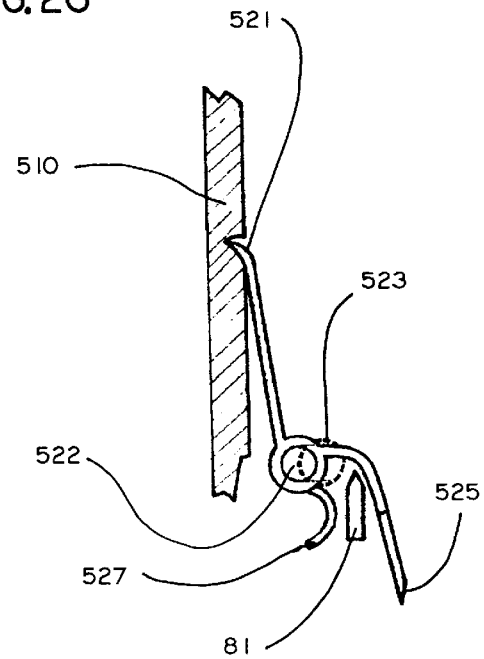
FIGS. 26 and 26A are a partial side view of an embodiment similar to that shown in FIGS. 22–25 but also having an activation catch, with a sequence showing how the catch ensures unlocking of the brake when the frame is moved towards the wall.
Figure 26A:
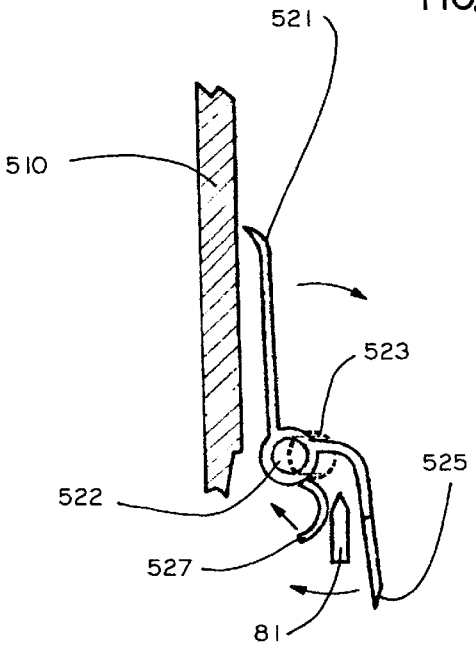

FIGS. 26 and 26A show a second sequence wherein the engaged and locked assembly is activated for adjustment. In the depicted embodiment, when the top of frame 70 is pushed inward (i.e., towards the wall) and upward, brake foot 521 disengages from brake pad 510. This disengagement is ensured through the force of gravity acting on hook 525 and/or the force exerted through hook 525 as it impinges more immediately against the wall.

FIGS. 26 and 26A also show an optional catch mechanism 527 which provides further insurance that, when desired, brake foot 521 can be unlocked from brake pad 510. When locked, catch 527 does not impinge on bar 81; however, when the top of frame 70 is pushed marginally towards the wall, bar 81 hits catch 527, helping brake foot 521 to rotate out of engagement.

Figure 27:
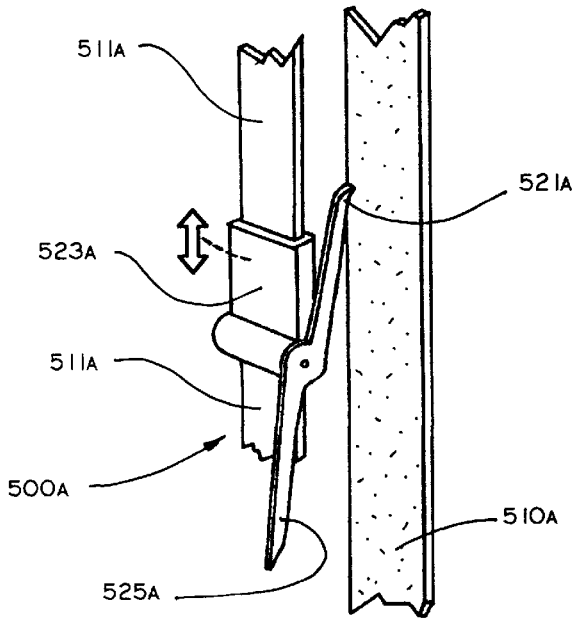
FIG. 27 is a top front right perspective view of part of an embodiment similar to that of FIGS. 22–26 but having only one guide rail and a brake pad articulated therefrom, showing how the hook forces the brake pin/foot into the brake pad under load.

FIG. 27 shows a single guide rail embodiment wherein brake pad 510*a* is separated from guide rail 511*a* except at the top and bottom (not shown). An embodiment such as this could be used in dual, opposing fashion, to better distribute the weight of the hanging item. Embodiments could also readily be imagined with one or more guide rails, wherein the rails were not directly attached to brake pad 510*a* at all, but instead independently attached to the rear of the hanging item. In such an embodiment, brake pad 510*a* may also be glued to the rear of the hanging item.

Figure 28:
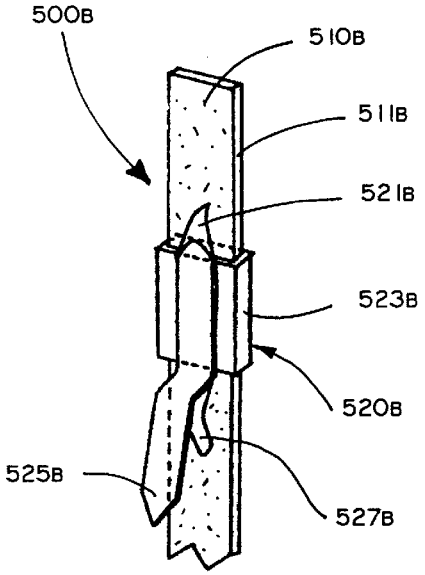
FIG. 28 is a top front right perspective view of an embodiment similar to that of FIG. 27 but having the brake pad and guide rail integrated, showing how the hook forces the brake tooth into the brake pad under load.

FIG. 28 shows a simplified mechanism 500*b* wherein hook 525*b* is integrally connected to a sliding grip 523*b* and brake tooth 521*b*, and brake pad 510*b* is integrated into guide rail 511*b*. Similarly to what is shown in the previous Figures, loading hook 525*b* causes brake tooth 521*b* to engage brake pad 510*b*. It should be noted that the underside of an optional activation catch 527*b* (similar to that shown in FIGS. 26 and 26A) should be formed so as not to catch in brake pad 510*b*.

Figure 29:
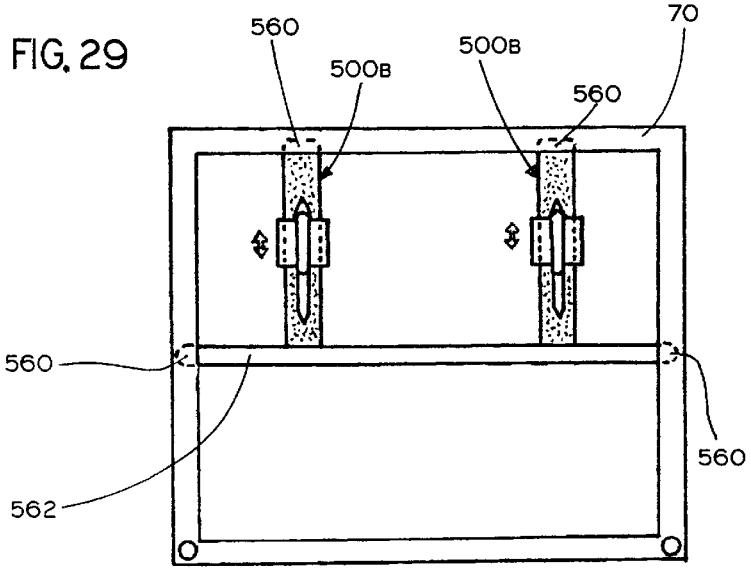
FIGS. 29 and 29A are a top front right perspective view and side top perspective view of an embodiment similar to that of FIG. 28 but integrated with a frame, and dual, showing how the devices are integrated with the frame, and how the hooks engage the wall bars mounted to the wall.
Figure 29A:
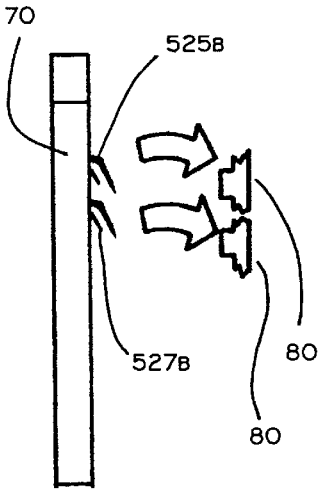

FIGS. 29 and 29A show how the invention can be integrated into the rear of a frame 70. The invention could be designed to be manufactured into frame 70, or it could be designed for retrofitting in bulk based on standard frame sizes. For example, it could be provided with knife edges 560 which wedge into the inner edge of frame 70, and/or it could be provided with a lower cross member 562 with similar knife edges 560. It should be noted that this integration helps minimize the degree to which there is a physical obstruction between frame 70 and the wall. It also provides the consumer with an easier, more professional approach. It is also noted that, as shown, the invention can be doubled (or more) so as to provide a further measure of leveling, stability and strength. It should also be noted that it is not only this embodiment of the invention that is susceptible of being incorporated into a frame-back either by a manufacturer, retrofitter, or consumer, and many other embodiments discussed herein are clearly envisaged as being so adaptable.

FIGS. 30 and 30A show an embodiment providing vertical adjustability, wherein upwardly pointing hook 575, mounted on the wall via nail/screw eyelet 574, is trapped by trap 570 which slides vertically along vertical bar 580 which may preferably have an elliptical or rectangular cross-section. Trap 570 includes pocket 571, which is placed over tip 577 of hook 575 and lowered until frictional region 576 of hook 575 hits frictional strip 581 (indicated by an arrow in FIG. 30A) of vertical bar 580 (which is mounted to the rear of the item to be hung at pin/screw eyelets 583) and hook 575 wedges between the interior face of pocket 571 and strip 581. When hook 575 is thus trapped, vertical movement of the trap along bar 580 is prevented, keeping the hanging item in its vertical position. When the item is pulled upwardly, however, trap 570 moves up just slightly with respect to hook 575, loosening its grip thereon. At this point, pulling outwardly on the hanging item causes frictional region 576 to lose contact with frictional strip 581; it also causes tension to be applied to trap 571 at frame-facing side 582 of bar 580. The frame-facing side 582 of vertical bar 580 may be a slick surface so as to foster vertical sliding of trap 570 along bar 580 when hook 575 is not trapped in trap 570. In this fashion, while an outward tension is maintained on the hanging item, hook 575 can be used to pull or push trap 570 upwardly or downwardly (respectively) along bar 580. When adjustment is completed, outward tension on the hanging item is discontinued, and a slight push inward on the hanging item is applied along with a slow and firm downward nudge to lower the trap 570 over hook 575. A slight shake may also encourage the trap to "set." Hook 575 should be at least as long in its vertical upward extent as the vertical length of pocket 571 to ensure that sufficient wedging action is available (rather than being obstructed when the lower extent of trap 570 hits any lower parts, projections, or attachments of hook 575). Also, simplified versions similar to the embodiment of FIGS. 30 and 30A can readily be imagined, such as one wherein trap 570 is simply a heavy rubber ring, bar 580 is simply a rod, and hook 575 has a fish-hook shape and a cylindrical cross-section.

FIGS. 31 and 31A show part of an embodiment that is similar to that shown in FIGS. 30 and 30A, but which also provides horizontal adjustability. Upwardly pointing hook 595 is slidably mounted in horizontal slider 590, which is affixed to the wall. Horizontal slider 591 includes slotted slider 591 and nail or screw eyelets 594. Slotted slider 591 has slot 592 in which hook 595 slides horizontally. Hook 595 is connected by connector 598 (which may be embedded in hook 595) to endpiece 593 which prevents hook 595 from rotating or being pulled upwardly and out of slot 592. As with the hook in the embodiment of FIGS. 30 and 30A, hook 595 includes a frictional region 596 and a tip 597. As shown in phantom in FIG. 31A, the side of hook 595 where frictional region 596 resides may extend further out than the face of slider 591 so that hook 595 may be trapped in pocket 571 without the face of slider 591 impinging upon vertical bar 580.

FIGS. 33–47 illustrate some upwardly pointing adjustable wall-hook embodiments of the invention, most of which are activated by inward or inward and upward pressure. Of the inward pressure activated variety of embodiments, some may require that any upward pull from the frame be met with a catch (or similar frame-adhering device) on the front face of the hook, so that the whole sliding assembly does not simply[2] fall downwards and out of engagement with the frame.

[2] Some of the embodiments depicted in FIGS. 33–47 may be fairly reliable and have the advantage that they also work with the hanging means that are often already provided on the backs of frames (e.g., wire, brackets, or universal frame edging). The problem, however, with trying to use existing hardware is that the configurations and relative depths of frame versus picture back versus wire or bracket will vary. As a result, some frames may not have enough clearance to activate by pushing in, while others will not be appropriate for activation by pulling out because they will exert a component of outward pull at rest.

On the other hand, the type of embodiment depicted in FIGS. 8–31 (which have the vertically adjustable mechanism mounted on the rear of the item to be hung rather than on the wall) obviates these problems by defining the relative depths of the rear of the frame by affixing the assembly (which has known dimensions) to the frame. In addition, such embodiments are advantageous in that the vertically adjustable locking interface cannot, during activation, be induced by gravity to drop downward and out of engagement, because it resides above rather than below the vertically static member with which it is engaged.

Figure 32:
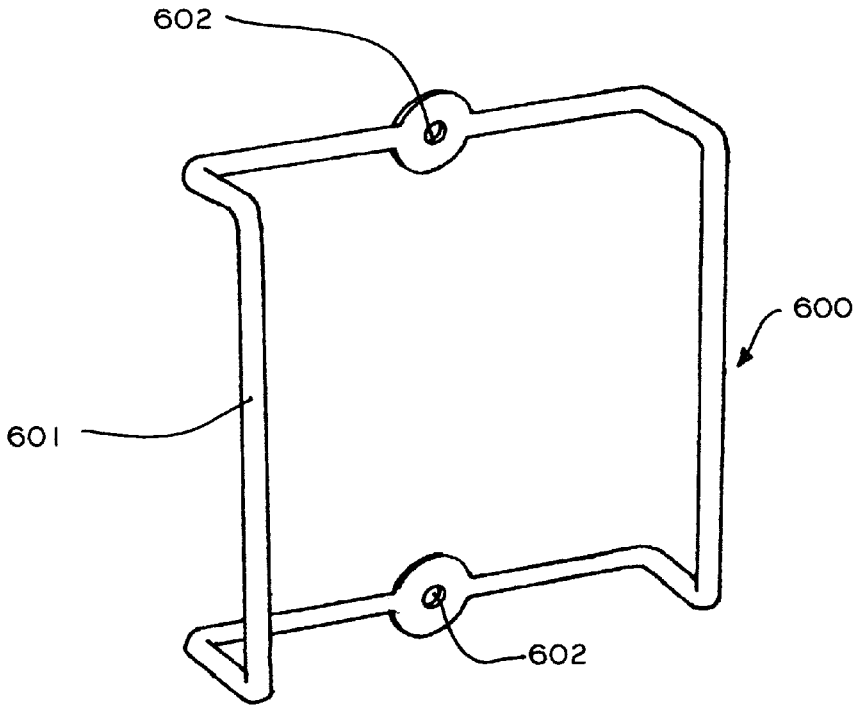
FIG. 32 is a front view of a generic wall rail assembly adaptable for use in the embodiments of FIGS. 33, 34–38, and 41–42, showing how it attaches to the wall and provides two tracks that are spaced a uniform distance from the wall and a uniform distance from each other.

FIG. 32 shows a generic wall rail assembly 600 that, at least in a modified form, can constitute part of many of the embodiments shown in FIGS. 33–47. Wall rail assembly 600 attaches to the wall with nails or screws through eyelets 602 and provides two rails 601 (which can be modified to include slots or the like, depending on the mechanism of the particular embodiment) which are spaced a first uniform distance from the wall and second uniform distance from each other.

Figure 33:
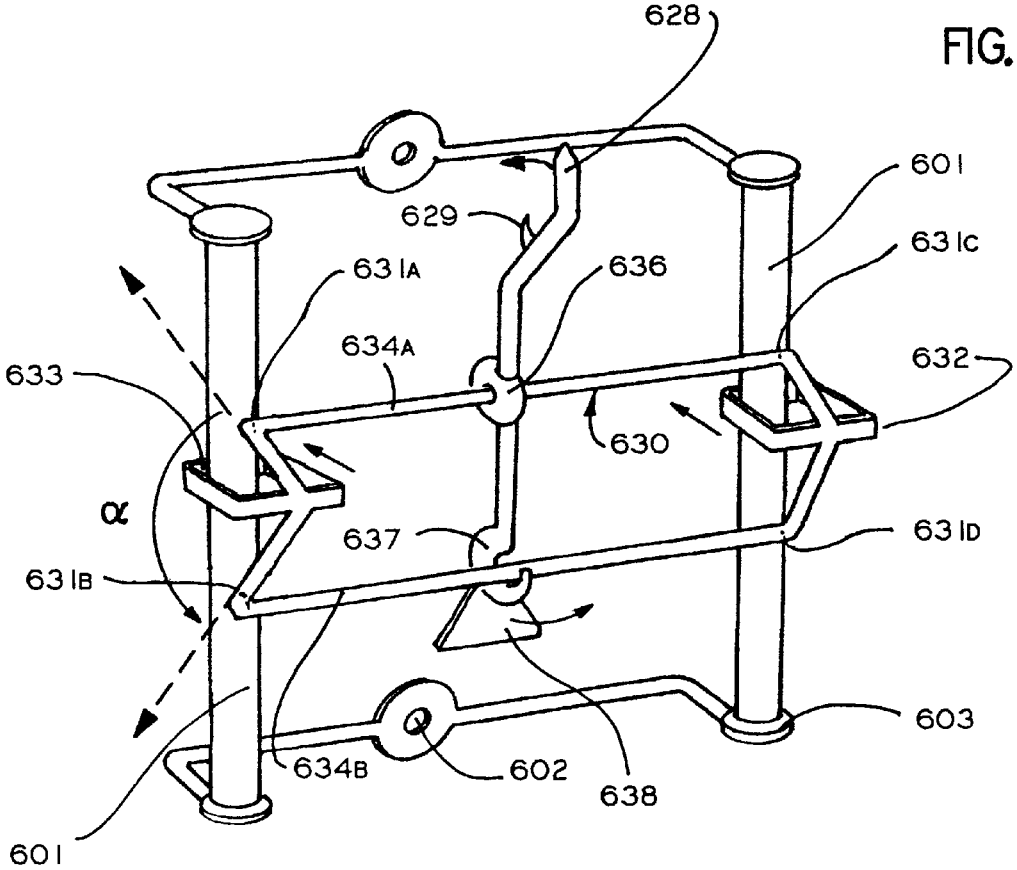
FIG. 33 is a top front left perspective view of an embodiment providing two-way, in situ adjustment activated by inward pressure on the top of the hook, showing how the three-point vertical clamping is relieved during activation.

FIG. 33 shows an embodiment that incorporates a wall rail assembly similar to that shown in FIG. 32, although it further includes vertical stoppers 603 which prevent the vertically sliding part of the assembly from detaching at the upper and lower extents of rails 601. This embodiment is activated by inward (i.e., orthogonal to the plane of the wall) pressure from a hanging item (not shown) the reverse side of which is hung atop hook 628. A three-point clamping action maintains the vertical position of the hanging item at rest, but is relieved when activated by inward pressure on hook 628, allowing vertical adjustment. The vertically sliding clamp 630 includes two horizontal parallel bars 634 that have sliding contact points 631*a* to 631*d* which slide along the outward facing sides of rails 601. Between sliding contact points 631*a* and 631*b* and between points 631*c* and 631*d*, vertically sliding clamp 630 consists of a resilient biased material urging parallel bars 634 toward each other. At the center of each of these resilient regions is attached a loop 632 encircling rail 601. The inner circumference of loops 632 is greater than the girth of rails 601, affording the play necessary to allow activation and clamping. The inner sides of loops 632, and/or the wall-facing sides of rails 601 may be grooved or may consist of or be coated with a high-friction material such as rubber, to ensure that the clamping provided by loops 632 and sliding points 631*a* to 631*d* is sufficient to prevent vertical slippage when the assembly is not activated. Freely sliding horizontally along vertically sliding clamp 630 is hook 628 which is upwardly pointing to receive a wire, bracket, universal frame edge or the like mounted on the reverse side of an item to be hung. Hook 628 is connected to sliding eye 636 which freely slides horizontally along the upper bar 634*a*. Pointing downward and also connected to hook 628 and sliding eye 636 is catch 637 and wall pad 638. When the hanging item is pushed inwardly against hook 628, torque is generated at eye 636 around upper bar 634*a*, causing catch 637 to move outwardly and apply outward pressure on lower bar 634*b*. Consequently, the angle $\alpha$ between the portions of clamp 630 on either side of loops 632 becomes more obtuse, causing loops 632 to move inwardly so that the inside of loops 632 no longer contacts the wall-facing sides of rails 601. Because these points of contact are the frictionally movement inhibiting ones, clamp 630 is now free to vertically slide along contact points 631*a–d* on rails 601. Wall pad 638 may be provided as a flat surface to spread any force against the wall that might be applied by catch 637 when hook 628 is under the load of a hanging item, preventing damage to the wall. Unwanted rotation in a plane parallel to the wall by hook 628, eye 636, and catch 637, can be prevented by widening eye 636, or by putting hook 628 closer to eye 636. Also, adjacent to hook 628 there may be placed a barb 629 to prevent a bracket, hanging wire or the like from sliding down too far and interfering with the operation of sliding clamp 630.

Figure 34:
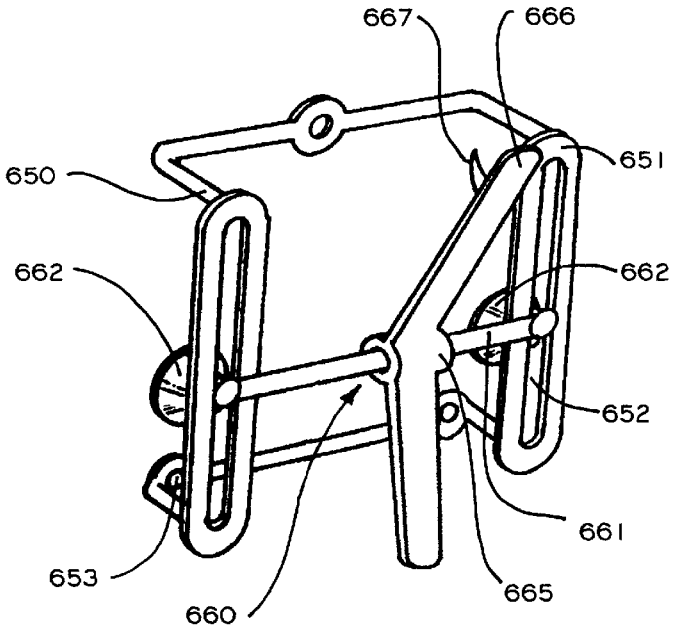
FIGS. 34 and 34A are a front left perspective view of an embodiment providing two-way, in situ adjustment activated by inward and upward pressure on the top of the hook, showing how the brakes lock into the vertical slots when outward or outward/downward pressure is applied.
Figure 34A:
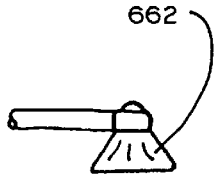

FIGS. 34 and 34A show an embodiment that is activated by inward and slight upward pressure on the top of the hook. In this embodiment, durable rubber conoidal brakes 662 are placed at each end of vertically sliding bar 661. Conoidal brakes 662 lock into vertical slots 652 when outward or outward/downward pressure (which is exerted by the loading force of hanging item) is applied on bar 661 via hook 666. This locking is achieved by the wedging of conoidal brakes 662 into slots 652, with the side of brakes 662 facing the wall twisting upward relative to their other side. When inward and slight upward pressure is applied on hook 666, however, hook 666 rotates counterclockwise viewed from the left about bar 661 on sliding tube 665 to which it is connected. At the same time, tube 665 exerts inward and upward pressure on bar 661 which causes brakes 662 to untwist to a normal horizontal posture and to unwedge from slots 652. Hook 666 is free to slide horizontally at all times because tube 665 freely slides along bar 661. Hook 666 includes a barb 667 similar to those already discussed relative to other embodiments.

Figure 35:
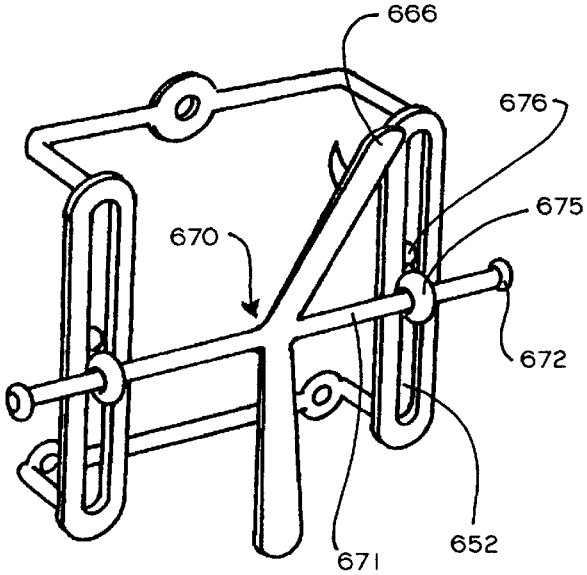
FIGS. 35 and 35A are a front left perspective view of an embodiment similar to that of FIG. 34, showing how the balls and sliders lock and wedge into the vertical slots when outward or outward/downward is applied.
Figure 35A:
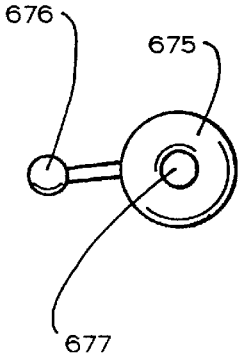

FIGS. 35 and 35A show another embodiment that is activated by inward and upward pressure on the top of the hook. In this embodiment, balls 676 and toroidal sliders 675 lock and wedge into vertical slots 652 when outward or outward/downward pressure (which is exerted by the loading force of the hanging item) is applied. The operation is similar to that of the embodiment of FIGS. 34 and 34A, except that hook and bar assembly 670 is integrally connected, with bar 671 freely sliding horizontally through openings 677 in toroidal sliders 675. This horizontal sliding is stopped at its left- and right-most extents by stoppers 672. Also, the wedging action of balls 676 and sliders 675 can be thought of as somewhat like what occurs when certain types of hanging curtains are pulled by hand so as to cause a jam in the curtain rod.

FIGS. 36, 36A, and 36B show an embodiment that is activated by inward pressure on the top of the hook. In this embodiment, a deformable and resilient box coupling 680 locks the rod 685 to the rails 601 when outward and/or downward pressure (which is exerted by the loading force of the hanging item) is applied. The box couplings 680 can be generally prism shaped with a two orthogonal conduits 684 and 681 passing through it and communicating with each other in the center of the box couplings 680. Rails 601 slidingly pass through conduits 681, while the ends of bar 685 pass through conduits 684 but are prevented from sliding horizontally by stops 686 placed at each end of bar 685. When downward and outward pressure is applied on hook 666, it is conveyed to bar 685 through sliding eye 665. This causes boxes 680 to twistingly deform and tightly cinch bar 685 against rails 601 on the interior or boxes 680. To ensure the locking action, a highly frictional surface may be placed at the interior region of boxes 680 in alignment with rails 601 whereat rails 601 contact the interior of boxes 680 only during locking. Likewise, a highly frictional surface may be applied to the surfaces of rails 601 facing rod 685 and vice versa. Also, wall pad 669 serves to blunt the force applied against the wall by the end opposite eye 665 of hook 666.

Figure 37:
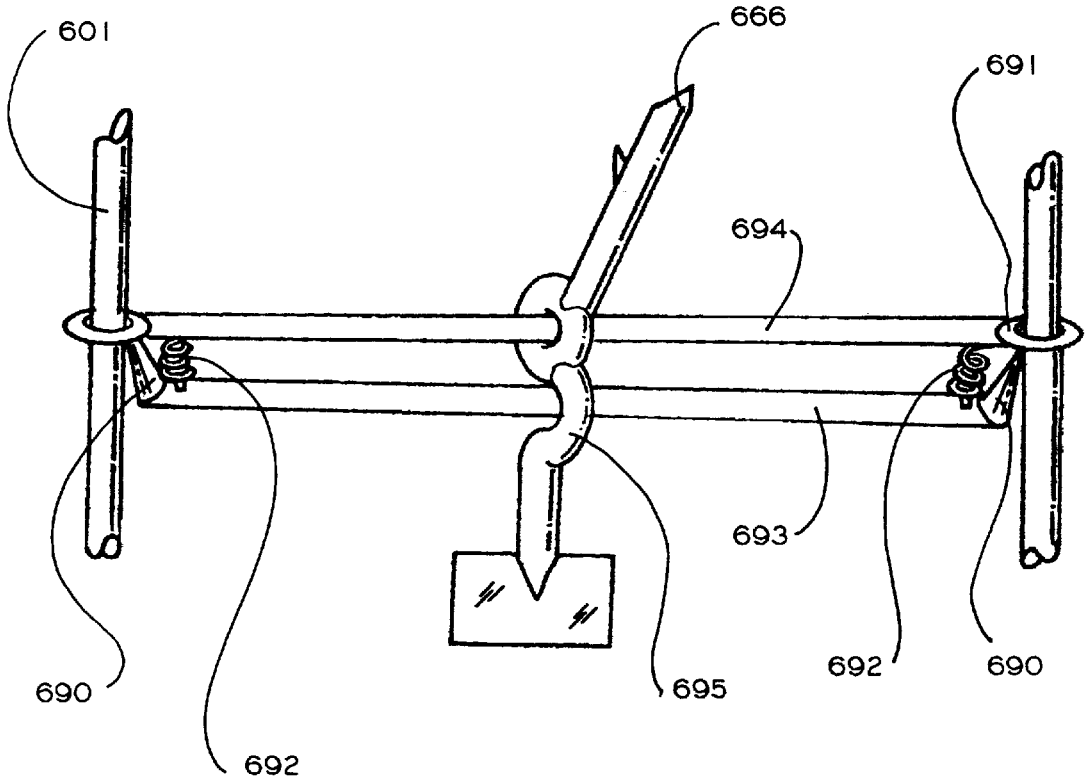
FIG. 37 is a front left perspective view of an embodiment providing two-way, in situ adjustment activated by inward pressure on the top of the hook, showing how the brakes are biased away from engagement with the eyes but engage when the hook is pulled outwardly or downwardly.

FIG. 37 shows an embodiment that is also activated by inward pressure on the top of the hook. In this embodiment, conical brakes 690 are biased away from engagement with eyes 691 by virtue of springs 692, but insert into eyes 691 when hook 666 is pulled outwardly or downwardly (which occurs under loading). Conical brakes 690 are placed at each end of sprung bar 693, and eyes 691 are placed at each end of slide bar 694. With outward or downward pressure on hook 666, sprung bar 693 is forced inward against the bias of springs 692 by point 695, causing locking and prevention of vertical movement.

Figure 38:
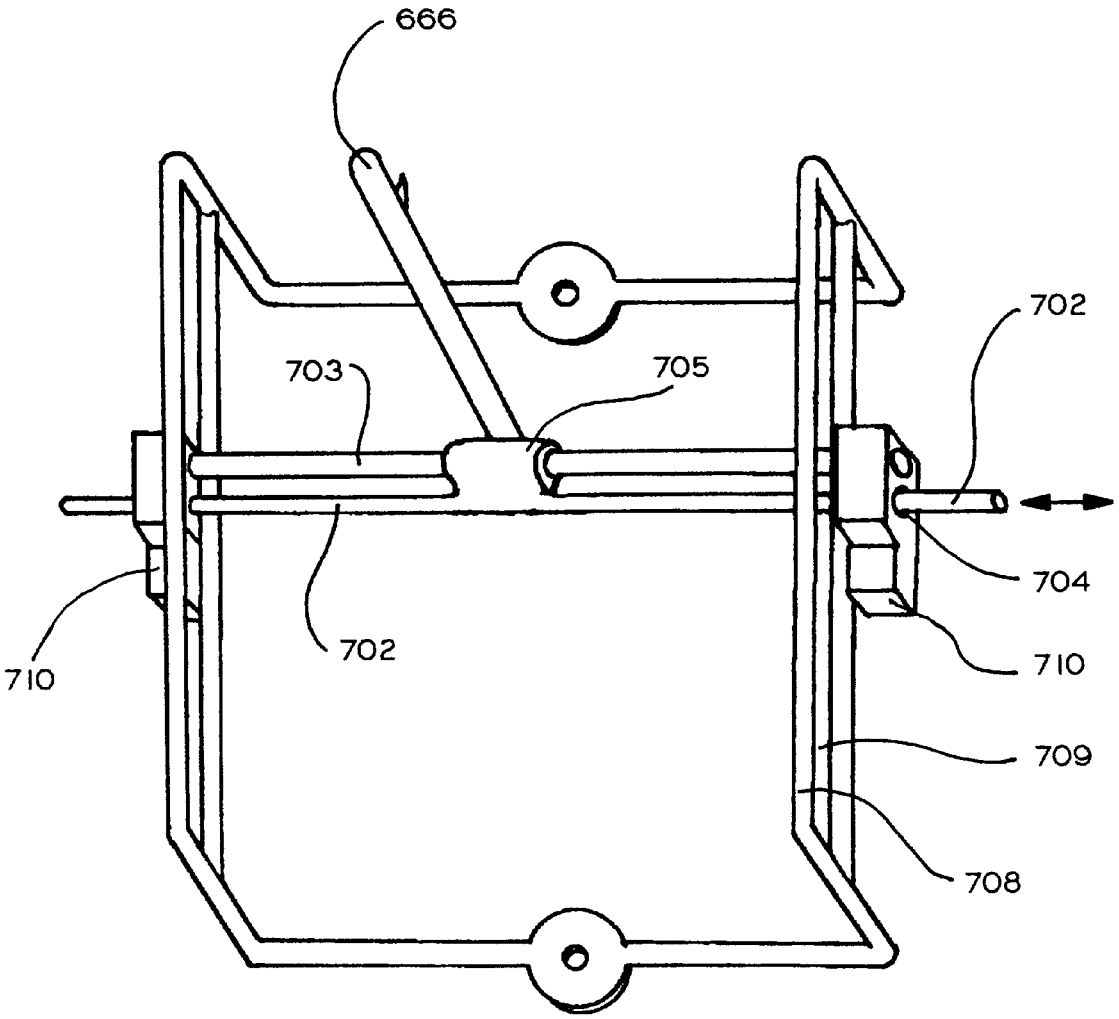
FIG. 38 is a bottom front right perspective view of an embodiment providing two-way, in situ adjustment activated by inward pressure on the top of the hook, showing how the rod floats through the coupling apertures and showing how the axle is attached to the coupling, and showing how the rod wedges in under the axle ends in the slots when under load.

FIG. 38 shows an embodiment that is also activated by inward pressure on the top of the hook. In this embodiment, rod 702 floats through coupling apertures 704, and axle 703 is attached to deformable coupling 710. Hook 666 slides horizontally on slider 705 over axle 703. When activated for adjustment, axle 703 and rod 702 slide vertically through slots 709 in slotted rails 708. Under load, however, deformable coupling 710 twists under the torque exerted by slider 705, axle 703, and rod 702, causing rod 702 to wedge in slots 709, under the ends of axle 703.

Figure 39:
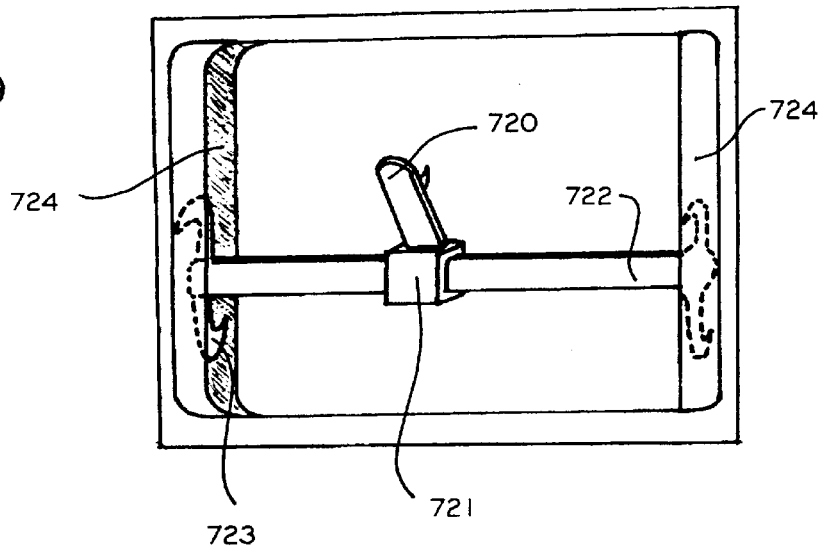
FIG. 39 is a top front right transparent perspective view of an embodiment providing two-way, in situ adjustment activated by inward pressure on the top of the hook, showing how the barbs at the ends of the crossbar lock into the interior of the slots under load.
Figure 40:
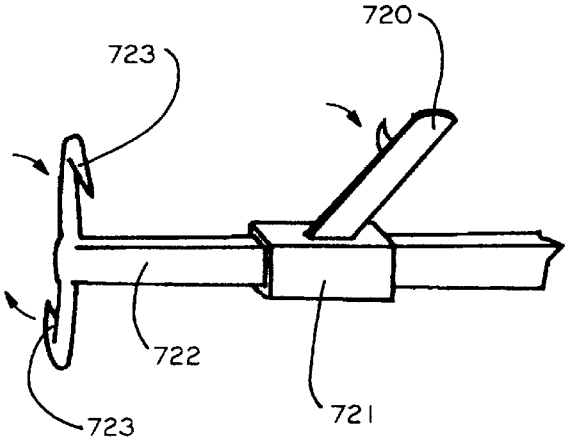
FIGS. 40 and 40A are a partial front top left perspective view and partial side sequence view of an embodiment similar to that of FIG. 39 but having a solid crossbar instead of a slotted one, showing how downward and outward pull on the hook causes the crossbar to rotate, engaging the barbs at its ends.
Figure 40A:
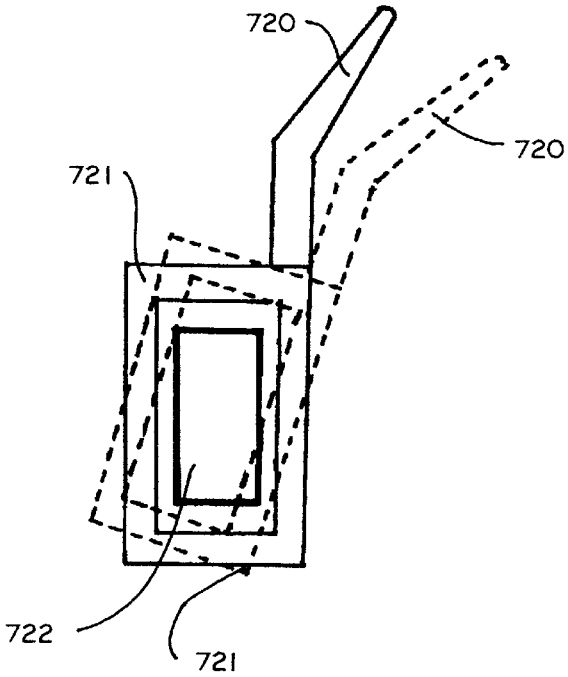

FIGS. 39, 40, and 40A show an embodiment that is also activated by inward pressure on the top of the hook. In this embodiment, opposing rotary barbs 723 at each of the ends of crossbar 722 lock into the high-friction interiors of pockets 724 when under load. Pushing inward toward the wall on hook 720, however, exerts torque on crossbar 722 rotating barbs 723 out of engagement with the interior of pockets 724, allowing vertical adjustment of crossbar 722 and thus hook 720. Hook 720 freely slides horizontally at slider 721 along crossbar 722. FIGS. 40 and 40A show a close-up view of the crossbar 722 and barbs 723, and a cross-sectional view of the crossbar 722, slider 721, and hook 720, demonstrating the difference between loaded and activated states. As shown in the cross-sectional view, the inner perimeter of slider 721 can be made larger than the girth of crossbar 722 so as to increase gripping of crossbar 722 under load and to increase the conversion of downward force on hook 720 into torque available to rotate barbs 723.

Figure 41:
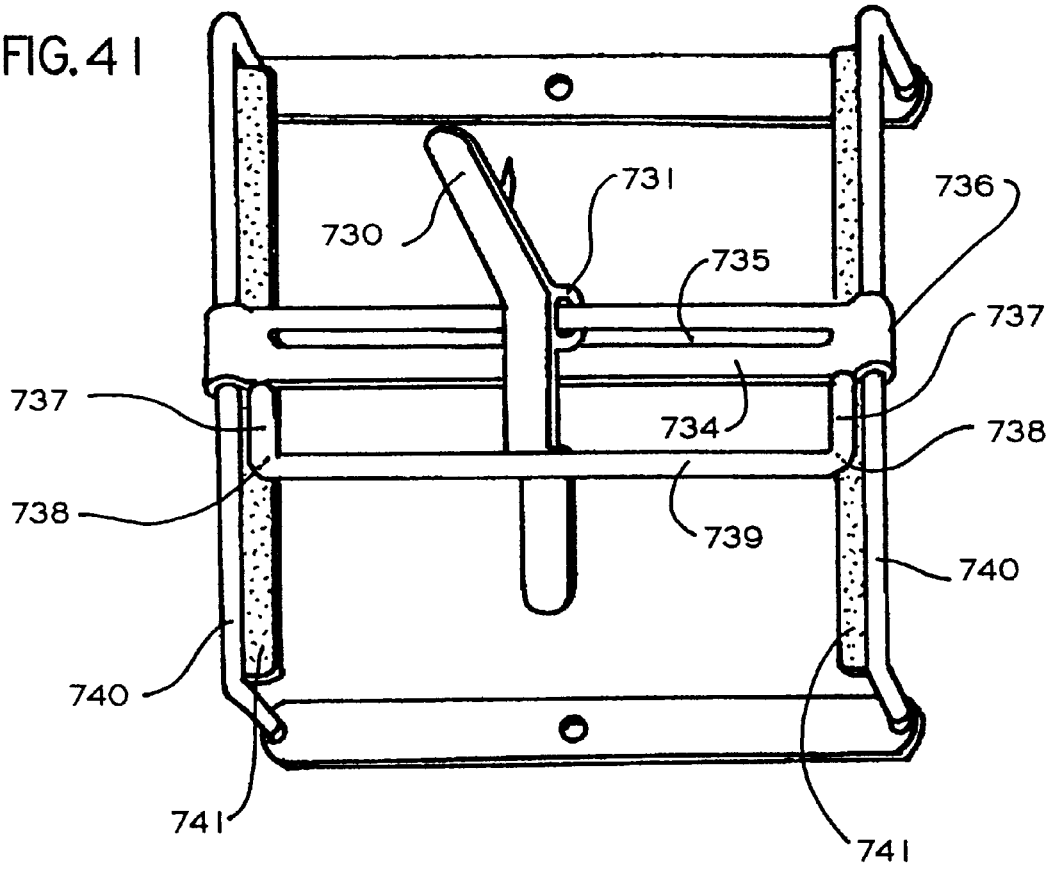

FIG. 41 shows an embodiment also activated by inward pressure on the top of the hook. In this embodiment, brake arms 737 are biased so as to urge brake feet/teeth 738 into engagement with brake pads 741 except when hook 730 is pushed inwardly. When that occurs, torque is applied at slider ring 731 (which horizontally slides freely along slider bar 734 through slot 735), forcing the lower, distant end of hook 730 outward into brake bar 739. The outward force on brake bar 739 removes teeth/feet 738 from engagement with brake pads 741, allowing slider grips 736 to vertically slide along rails 740 (the contact between grips 736 and rails 740 can be made low-friction).

Figure 42:
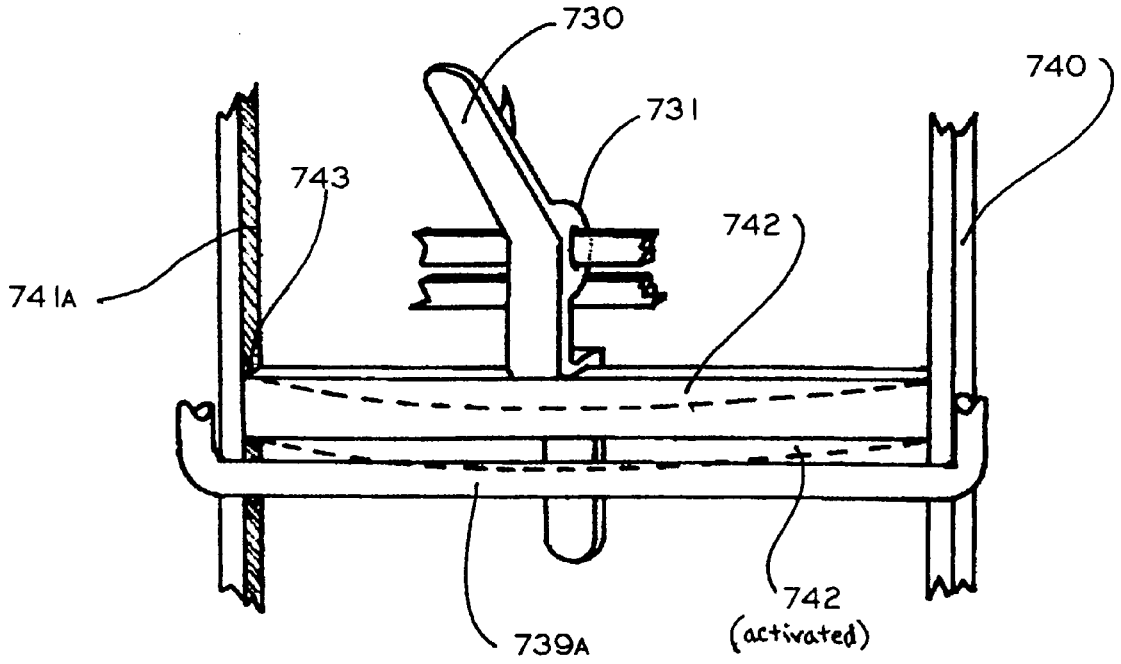
FIG. 42 is a partial right front perspective view of an embodiment similar to that shown in FIG. 41 but having a bar and a biased leaf with brakes at its ends, showing how the leaf is biased towards engagement with the brake pads except when inward pressure on the hook depresses the leaf, causing the leaf to bend and effectively shorten horizontally.

FIG. 42 shows an embodiment similar to that of FIG. 41 but having a bar 739*a* and a biased leaf spring 742 with brake feet/teeth 743 at its tips which directly oppose inwardly facing brake pads 741*a* which in turn are integrally attached to the insides of rails 740. In this embodiment, leaf spring 742 is biased towards engagement with inwardly facing brake pads 741 a except when inward pressure on hook 730 impinges on leaf spring 742 causing it to bend (as shown in phantom) and effectively shorten its horizontal length, snapping it out of engagement with pads 741*a*. In this embodiment, bar 739*a* does not include the brake feet/teeth 738 of the embodiment of FIG. 41.

Figure 43:
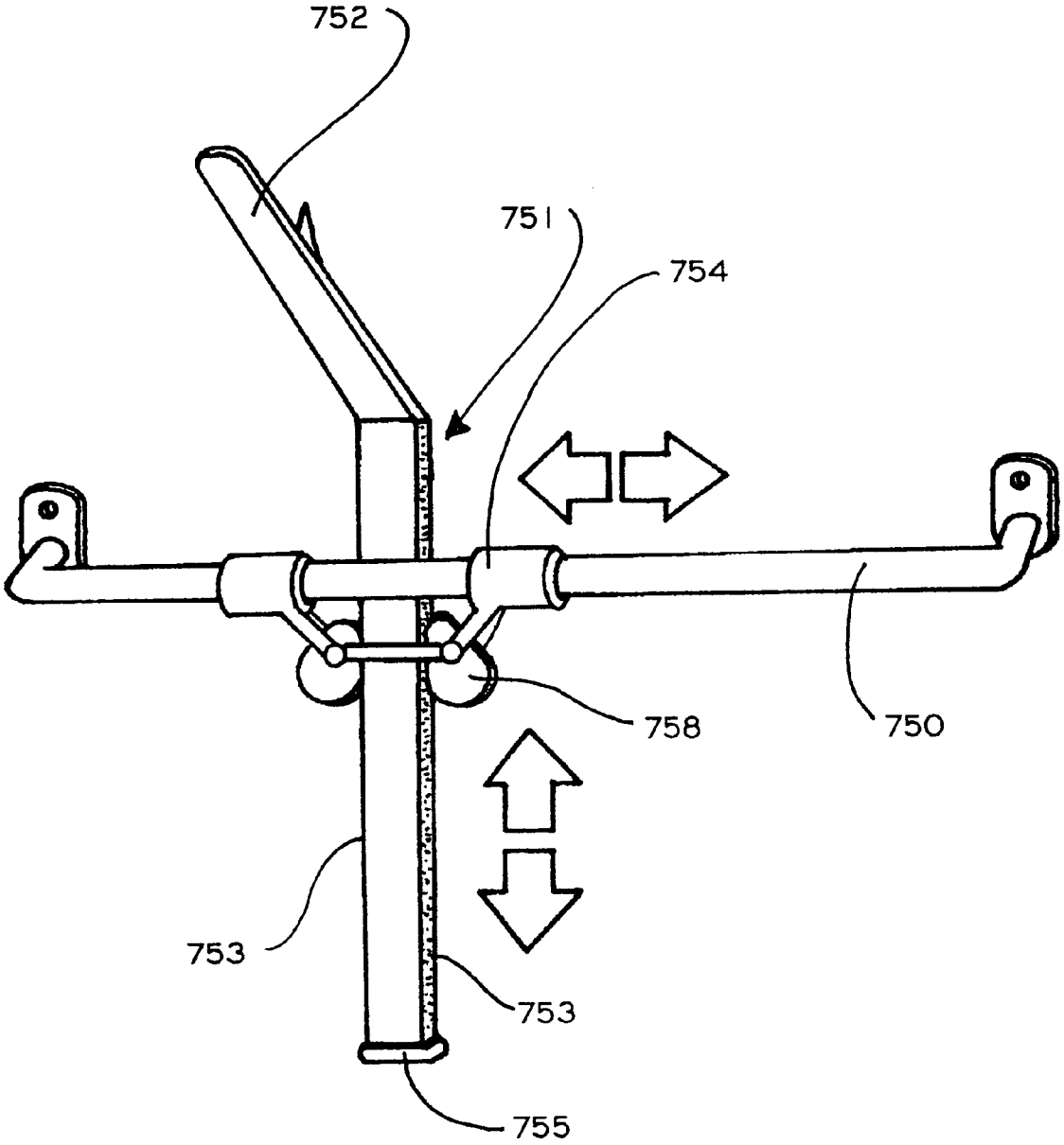
FIG. 43 is a top front right perspective view of an embodiment providing two-way, in situ adjustment activated by upward or possibly inward pressure, and locked by quick downward pressure or possibly outward pressure, showing rockers which prevent downward movement of the hook-bearing rod when under load.

FIG. 43 shows an embodiment that may be activated for vertical adjustment by upward and/or inward pressure, and locked against vertical adjustment by quick downward pressure and/or outward pressure. In this embodiment, an upwardly pointing hook assembly is mounted on a horizontal bar 750 statically attached to the wall. Hook bearing rod 751 includes hook 752 and is vertically adjustably connected to bar 750 via horizontal sliders 754 and vertical rockers 758. Rockers 758 are oblong or another non-circular shape to prevent downward movement of hook-bearing rod 751 when under load. Rockers 758 may also be rubber or toothed to ensure that they catch rod 751 when a load is applied quickly, and they may be slightly biased towards vertical so that they are only caught when a quick movement of rod 751 occurs, but not when rod 751 moves slowly, as is the case with a seat-belt catch mechanism. The sides of rod 751 facing rockers 758 may also include rubber, teeth, or grooves, and the lower end of rod 751 includes a stopper 755 to prevent rod 751 from escaping upwardly during vertical adjustment.

Figure 44:
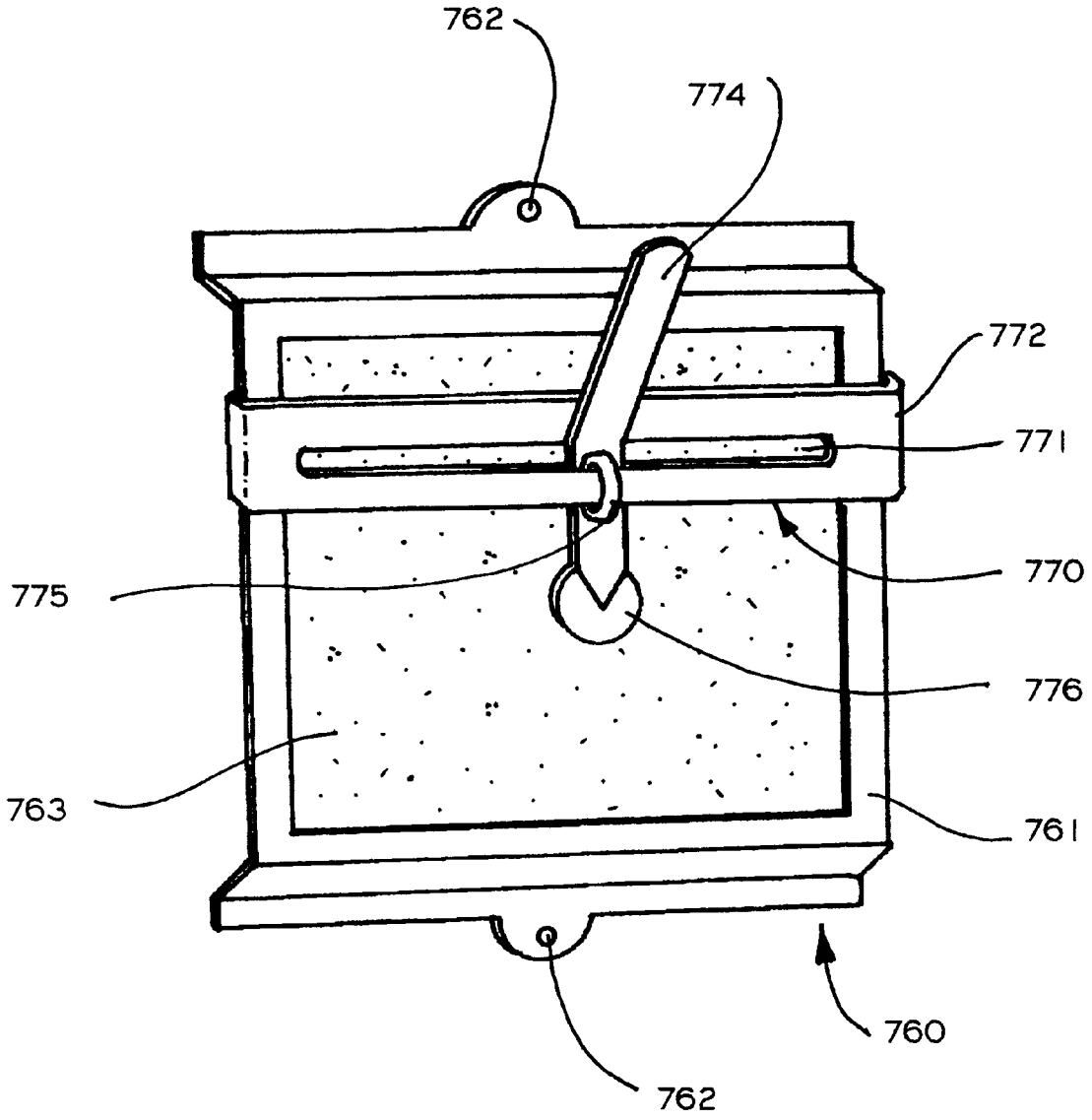
FIG. 44 is a top front left perspective view of an embodiment providing two-way, in situ adjustment activated by inward pressure, showing a brake shoe/tooth that engages anywhere on a large brake pad when under load.

FIG. 44 shows an embodiment that is activated by inward pressure. In this embodiment, rail assembly 760 mounts to the wall via nail/screw eyelets 762, and includes vertical guide rails 761 and a large brake pad 763. Vertically sliding assembly 770 includes sliding grips 772 and a horizontal slot 771 along which ring 775 (which is connected to hook 774 and brake shoe/tooth 776) slides horizontally. Brake shoe/tooth 776 engages anywhere on the surface of large brake pad 763 when under load, but disengages when hook 774 is pressed inwardly (towards wall) due to the torque transmitted to brake shoe/tooth 776. Both brake shoe/tooth 776 and large brake pad 763 can be chosen from materials most suitable for secure gripping.

FIGS. 45, 45A, and 45B show an embodiment activated by outward pressure. The device primarily consists of a flexible, hook bearing rubber disk 820 sandwiched between an annular top bezel 805 and a wall mount 801. Mount 801 is attached to the wall at nail/screw eyelets 803 (of which there are at least two) and annular bezel 805 is connected to mount 801 at connectors 804 (of which there are at least two) a uniform distance away from mount 801 that is about the same as the thickness of disk 820. When hook 810 is pulled outward, hook-bearing rubber disk 820 snaps away from the adhering central inside area (not shown) of mount 801 (primarily at central area 821), allowing it to move with respect to mount 801 and bezel 805. Rubber disk 820 snaps back into engagement with the adhering central inside area of mount 801 when outward pressure on hook 810 is released. Rubber disk 820 is prevented from escaping or falling out of the central opening of annular bezel 805 by virtue of extension ears or tabs 826. Tabs 826 are part of disk 820 and extend out past the edges of bezel 805 when hook 810 is positioned at the center of the central opening of bezel 805, and are sized such that a substantial part of each tab 826 is always between annular bezel 805 and mount 801, no matter how far to one edge of the central opening of bezel 805 hook 810 is positioned. Disk 820 should be of a taut, resilient material that snaps back into place against the central area of mount 801 as soon as outward pressure is released from hook 810.

Figure 46:
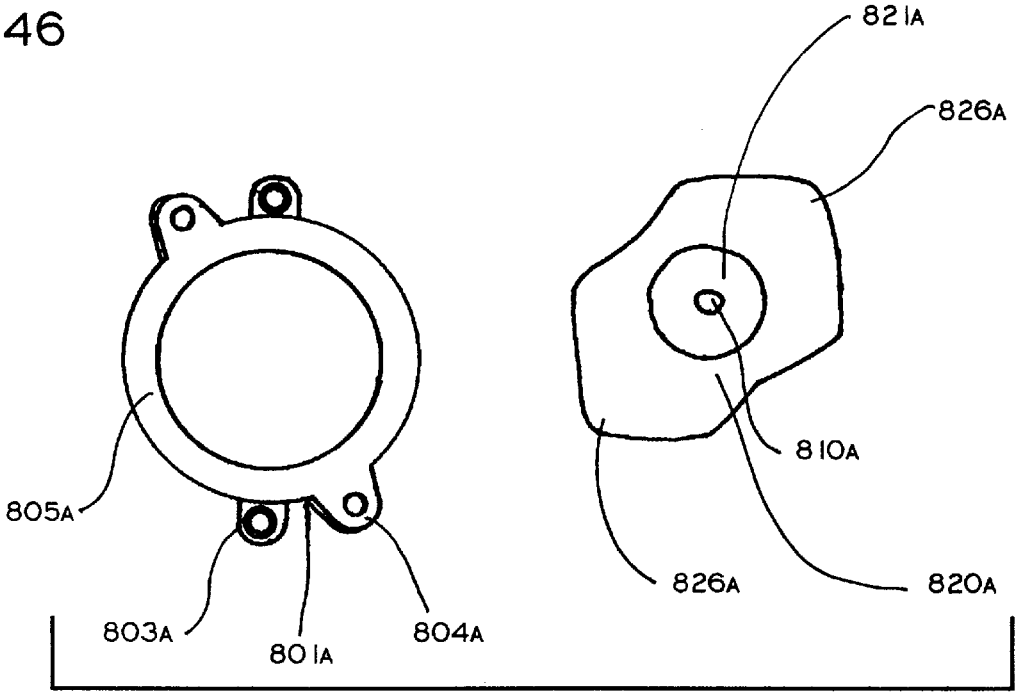
FIGS. 46 and 46A are a frontal exploded view and a frontal transparent view of two embodiments similar to that of FIG. 45 but having two instead of three ears, showing how the mount, disk, and bezel are put together.
Figure 46A:
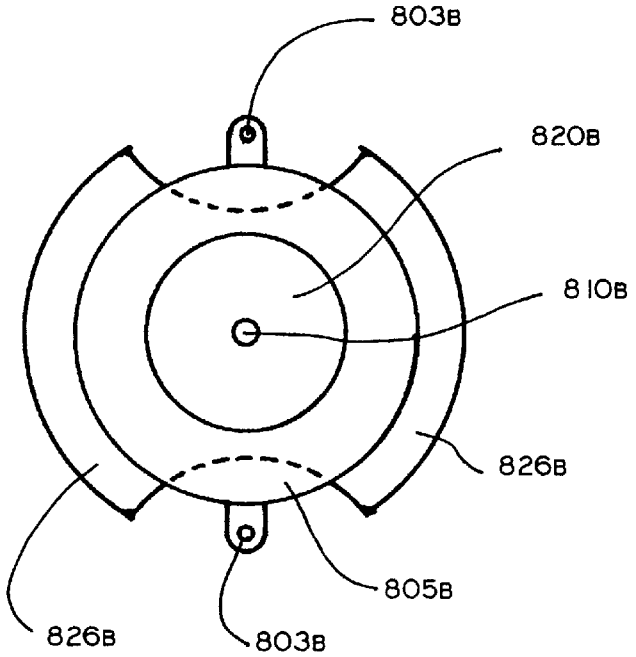

FIGS. 46 and 46A show a couple of embodiments that are similar to that of FIGS. 45, 45A, and 45B but which have two instead of three ears 826*a* or 826*b*. Parts similar to those in the embodiment of FIG. 45, 45A, and 45B are numbered the same except with an a or b appended.

Figure 47:
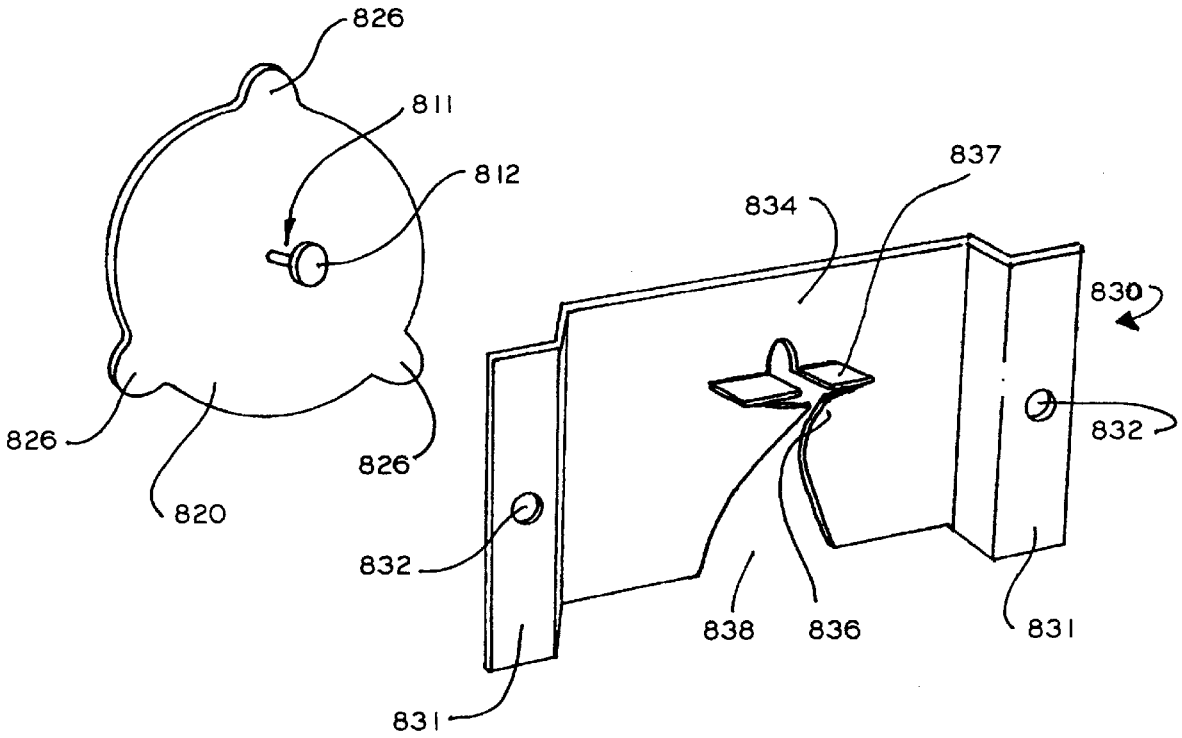
FIGS. 47 and 47A are a partial front left perspective view of a modified hook, and a front top perspective and reverse top perspective view of a hanger, that are for use with embodiments similar to those of FIGS. 45 and 46, showing how the modified hook has a disk at its end, how the hanger is attached to the rear of the picture frame, and how the hook end locks in place in the slot in the hanger.
Figure 47A:
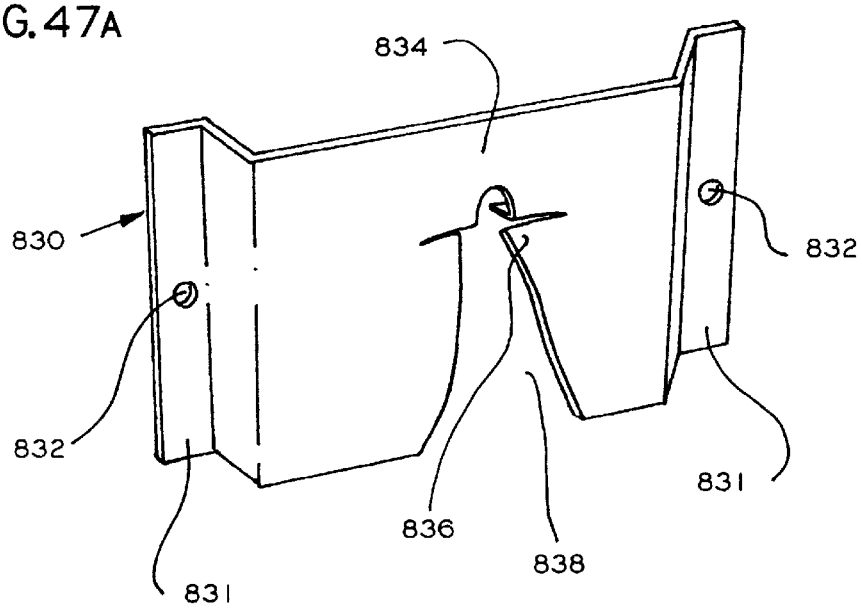

FIGS. 47 and 47A show a front and reverse view of a hanger 830 and a front view of a disk 820 bearing a modified wall-mounted hook 811 that can be used in an embodiment such as those shown in FIGS. 45 and 46, in order to allow the desired application of an outward activation force on modified hook 811, and yet also allow hanger 830 and modified hook 811 to be easily and readily released from each other. Modified hook 811 has a small disk 812 at its end, and is part of disk 820 which is in turn part of an adjustable assembly mounted to the wall (see FIGS. 45 and 46). Hanger 830 is attached through pin/screw eyelets 832 to the rear of an item to be hung, with lower surfaces 831 being generally flush with the rear of the item to be hung. Upper surface 834 faces hook 811 and disk 812 which it receives in opening 838 by being positioned over hook 811 and disk 812 and lowered until hook 811 reaches the uppermost extent of opening 838. Thereupon, hook 811 and disk 812 lock in place in hanger 830, unless the hanging item (and consequently hanger 830) is pushed inwardly toward the wall and then pulled upwardly. This is because disk 812 is physically obstructed by flanges 837 which are flat and substantially lying in the horizontal plane orthogonal to the wall and hanging item. Disk 812 is not obstructed by flanges 837 when the hanging item and hanger 830 are being lowered over hook 811 because of bent guides 836 which gradually extend from the plane of upper surface 834 to slightly past the reach of flanges 837 whereat guides 836 end. As the hanger is lowered over hook 811, bent guides 836 pull the hanging item slightly in towards the wall until the end of guides 836 is reached by hook 811 and disk 812, at which point hook 811 and disk 812 pass flanges 837 and the hanging item is free to naturally pull slightly back outward by gravity. This keeps disk 812 in a position that is physically obstructed by flanges 837 from direct vertical movement until the hanging item is pushed in towards the wall.

Figure 48:
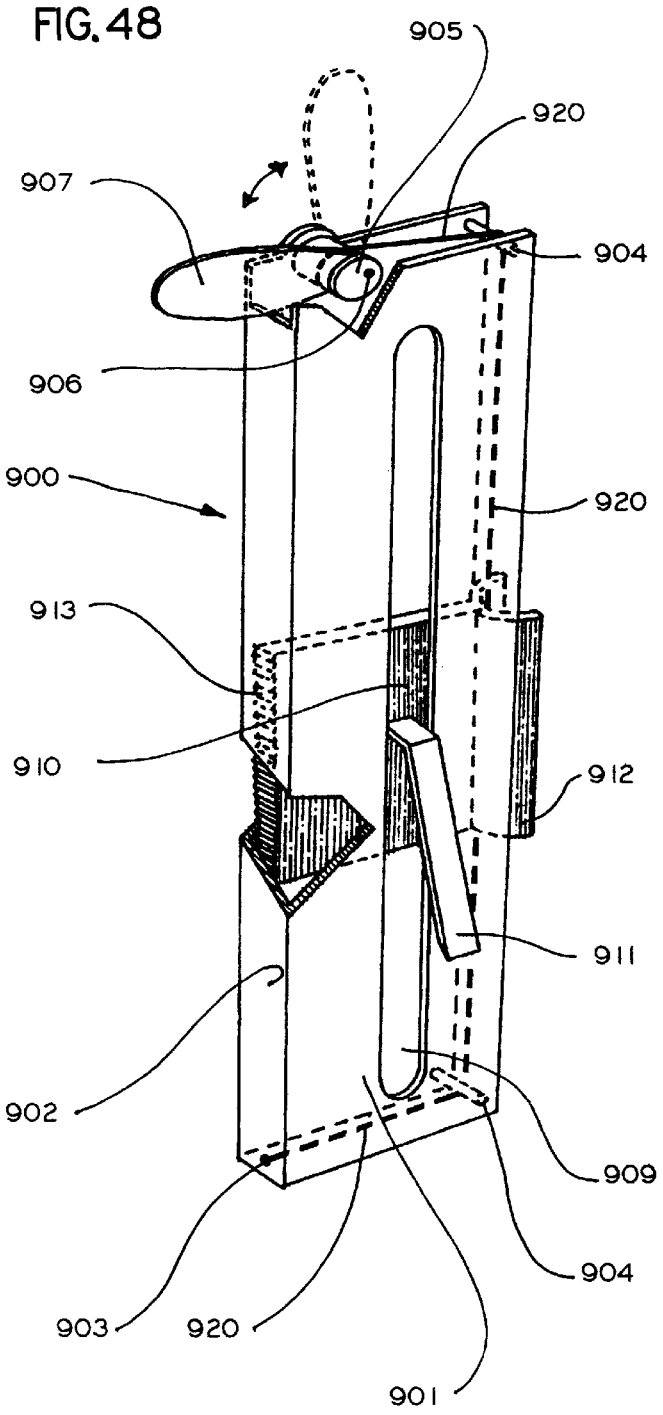
FIG. 48 is a top front left transparent view of an embodiment providing for two-way, in situ adjustment, showing how the vertical adjustability is activated and deactivated by a finger locking mechanism.
Figure 49:
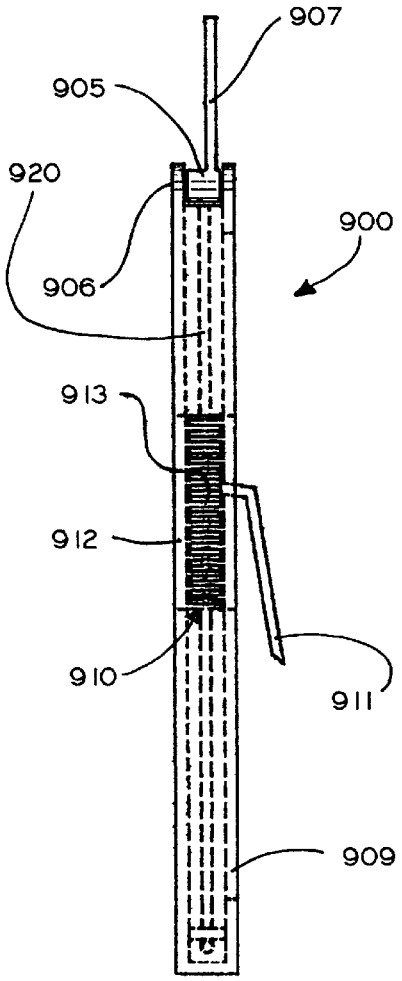
FIG. 49 is a side transparent view of the embodiment shown in FIG. 48.

FIGS. 48 and 49 illustrate a taut cable and finger locking embodiment 900. This embodiment includes a vertical locking box 901 which is generally prism-shaped with a thin cross-section (FIG. 49) and is attached to the rear of an item to be hung, and includes a vertically adjustable hook 911 which points downwardly and mounts on the wall, such as on a bar like the one shown in FIG. 1. Box 901 has a closed top and bottom and four sides; the side shown on the left in FIG. 48 is closed, while the opposite side (right) has an opening running substantially down its length. The side of box 901 which faces the wall (shown in the front in FIG. 48) has a slot 909 running vertically down its center for most of its length. Hook plate 910 slides vertically along the hollow interior of box 901 with attached hook 911 projecting through slot 909. The interior of box 901 that is shown on the left side of FIG. 48 includes a brake pad 902 which opposes brake teeth 913 of hook plate 910. Hook plate 910 includes on its other side cable catch channel 912, which slidingly projects through the vertical opening on that side of box 901. Box 901 also includes at its bottom end a fixed cable attachment point 903 and cable guide 904. At its top end box 901 has another cable guide 904 and an axle 906 which is connected to, but free to revolve within its connection to, box 901. Axle 906 is fixedly attached to cable wheel 905 which in turn is fixedly connected to manual locking lever 907. Cable 920 is attached to an appropriate point on the outer diameter of wheel 905 and runs around the top side to the right side to the bottom end of box 901, passing over guides 904 and cable catch channel 912, and terminating at fixed attachment point 903 to which it is attached. When lever 907 is rotated to its counterclockwise position shown in FIG. 48, cable 920 cinches in against cable catch channel 912 (which can be coated with rubber to increase gripping), forcing hook plate 910 to the left which causes brake teeth 913 to impinge upon brake pad 902, fixing hook plate 910 in its vertical position, along with hook 911. When lever 907 is rotated somewhat clockwise as viewed in FIG. 48 to its other position (shown in phantom), cable 920 is loosened from channel 912, allowing hook 911 (and consequently plate 910) to slide up or down through slot 909 as desired. Wheel 905 may be oblong and its surrounding surface on box 901 may be formed so that wheel 905 and lever 907 have two desired positions which require some amount of force to "get over the hump" and move between. Lever 907 may be placed as far as possible towards the wall-facing part of wheel 905, to allow box 901 to be placed further inwardly on the reverse side of the item to be hung without lever 907 hitting the item. Lever 907 can be sized such that is easily reachable, but just out of view behind the outer extent of the edge of the item to be hung when lever 907 is in its locked position (shown in solid in FIG. 48). Additionally, or alternatively, the connection between lever 907 and wheel 905 may be detachable, so that lever 907 can be removed from assembly 900 after adjustment, stored, and reconnected if further adjustment is desired. Also, channel 912 may have a cable guard (not shown) which closes the opening of channel 912 thereby preventing cable 920 from falling out.

Figure 50:
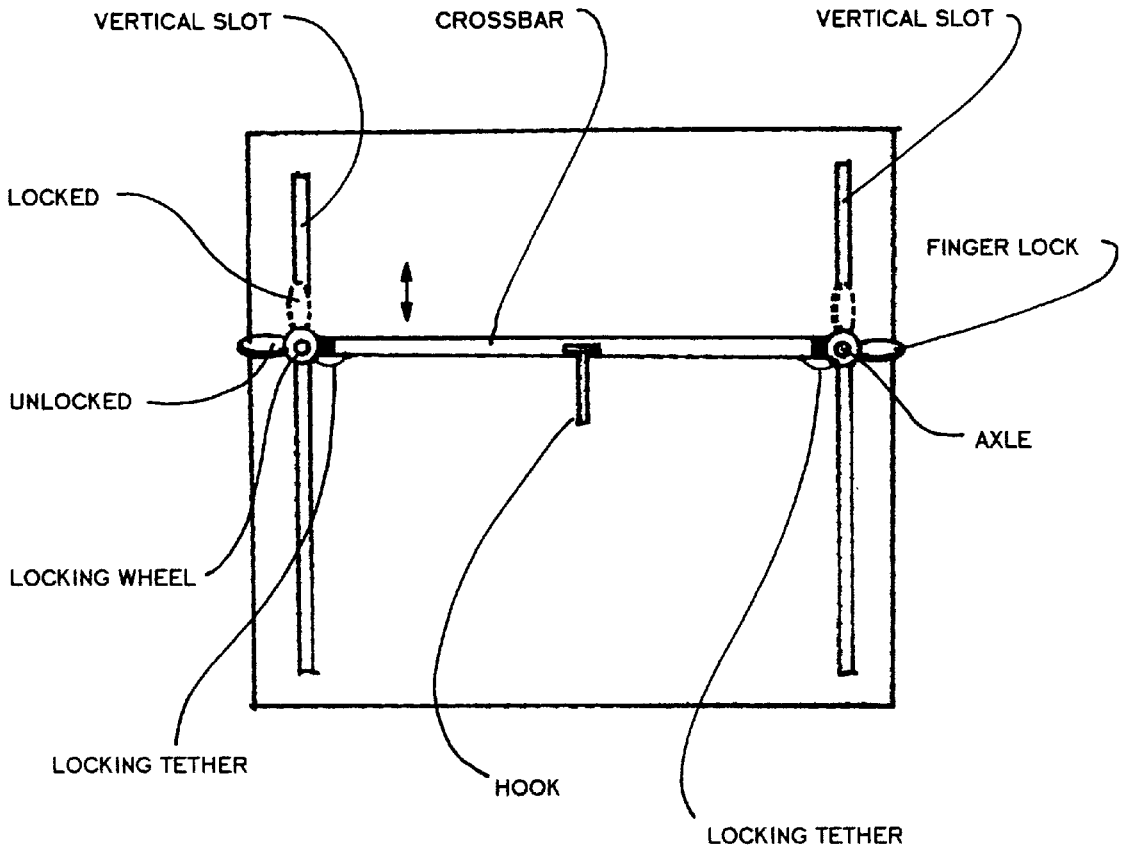
FIG. 50 is a frontal view of an embodiment providing two-way, in situ vertical adjustability, showing how the vertical adjustability is activated and deactivated by finger locks at the edge of the frame.

There are many other embodiments of the invention that are readily conceivable (in light of the above) wherein vertical adjustment is manually locked (meaning that the user must manipulate something other than the hanging item itself). As shown in FIG. 50, such an embodiment may utilizing a locking cable or rod, or other similar means, wherein vertical adjustability is activated and deactivated by finger locks at the edge of the frame. The finger locks could be on both sides of the frame, and could slide up and down the frame edges along with a downwardly-pointing hook (positioned centrally between the locks), and lock at any desired vertical level. The entire device could also be manufactured into the rear of frames (rather than placed on the rear of a frame), so that the sliding finger locks could be neatly and flushly incorporated into the frame edges.

In the embodiment shown in FIG. 50, two locking wheels are connected to central axles which run into vertical slots in the rear of the frame. The ends of the axles opposite the wheels have a cap that is larger in diameter than the rest of the axle. Likewise, the slots are larger beneath the rear surface of the frame, and the endcaps of the axles, which are too large to escape through the slots, are retained below the surface of the slots. Finger locks are fixedly attached to the outer diameter of the locking wheels, and rotate in the plane of the frame along with the wheels. A crossbar runs between the locking wheels, and includes a fixed, downwardly pointing hook at its center. A tether attaches each end of the crossbar to an attachment point on the outer diameter of the locking wheels. Viewing the rear of the item to be hung (as in FIG. 50), when the finger locks are pulled upwards, the locking wheels rotate, pulling the tethers taut, and pulling the locking wheels and their axles into tension with the inside facing edges of the vertical slots. Consequently, the axles lock in place in the slots, locking the crossbar and the downwardly pointing hook in their vertical position. The locking wheels may be configured and biased to prefer two positions, locked or unlocked, as described with regard to FIGS. 48 and 49.

FIG. 51 and 52 show two embodiments that allow for placement of an item off-center from a stud. FIG. 51 shows an embodiment that is fixed and left-oriented, while FIG. 52 shows an embodiment that is horizontally adjustable and right-oriented. The main purpose of these embodiments of the invention is to allow a picture to be placed at a desired lateral position on the wall, even though there is not a stud exactly at the centerline through that position. Each embodiment is shaped somewhat like a "T" with one arm having a hook 1001 projecting upwardly and somewhat outwardly therefrom. Both embodiments are to be secured to a stud at two points 1003 which are vertically aligned. In any embodiment of this type, there must be at least two points of attachment to the stud, or else the whole hook assembly 1000 or 1005 would tend to rotate downward on the wall, or come out of or rip the wall. Although it is not to bear the brunt of the hanging weight, a point of attachment near hook 1001, and away from the stud may also be provided (in addition to or in lieu of the opposite arm extension and wall pad 1002) in the fixed embodiment in order to ensure that base of hook 1001 remains flat against the wall. In the adjustable embodiment of FIG. 60, horizontal bar 1009 slides horizontally through aperture 1007 in vertical bar 1008, but is stopped at its right-most extent by stoppers 1006.

General Discussion Regarding Various Embodiments of the Invention

With virtually all of the embodiments described above, and with most applications, any physical obstruction ("gap") and angle of pitch between the hanging item and the wall (or other hanging surface) should be kept below a degree that would be functionally detrimental or aesthetically unpleasing. Table 1 provides rough estimates, for variously sized items, of the maximum aesthetically acceptable gap between the hanging item and wall at the top of the item. Corresponding pitch angles are also shown (in horizontal inch per vertical inch).

TABLE 1

MAXIMUM ACCEPTABLE GAP AT TOP OF HANGING ITEM

| Vertical Frame Size | Maximum Acceptable Gap | Corresponding Pitch Angle |
|---|---|---|
| 8" | .38" | .048 |
| 9" | .40" | .044 |
| 10" | .42" | .042 |
| 12" | .44" | .037 |
| 16" | .52" | .033 |

For many embodiments employing a wall bar such as that depicted in FIGS. 1 and 1A, the maximum gap at the top of the frame will tend to occur when the item is hung at the top of its vertical adjustment range. Given such an adjustable assembly of known dimensions, the actual gap at the top of the frame can be estimated over the entire range of vertical adjustment from the following equation: Gap=d+(t/b)(d−s), where d is the distance from the frame to the wall at hook-level; t is the distance between the top of the frame and the hook; b is the distance between the bottom of the frame and the hook; and s is the thickness of spacer pads at the bottom of the frame, if any. The value for t can be attained by adding the distance between the frame top and the highest hook position to the overall length of vertical adjustability (i.e., the distance from the highest hook position to the lowest). The value for b can be obtained by subtracting the value for t from the total vertical length of the frame.

As an example, Table 2 provides estimates of the maximum gap distances at the top of a frame provided with various configurations of an embodiment such as those shown in FIGS. 15–21. Table 2 is based on the following set of assumptions:

(1) the box is mounted so the uppermost hook position is ½" below the top of the frame;

(2) the inner cavity of the box has a thickness of 3/32" (with 5/64" flippers and 1/16" wings or tabs residing therein);

(3) the rear box wall has a thickness of 1/64";

(4) the wall bar has a thickness of 3/64";

(5) the gauge of the hook gap is 5/64";

(6) the extra leeway between the wall bar and the wall (in addition to that provided for the thickness of the hook) is 1/32";

(7) the box does not stretch away from the rear of the frame at any point;

(8) the spacer pads are at the lowest section of the rear of the frame; and (9) the thickness of the spacer pads is taken as when compressed under normal load.

With appropriate allowances for different assumptions, other embodiments of the present invention may be similarly analyzed.

TABLE 2

ESTIMATED GAP AT TOP OF FRAME FOR LIGHT AND HEAVY VERSIONS OF AN EMBODIMENT LIKE THAT DEPICTED IN FIGS. 17–24

Gap = d + (t/b)(d − s)

| Frame Size | Adjustability | t | b | Gap |
|---|---|---|---|---|
| HEAVY DUTY BOX AND HOOK (3/64" hook and box front plate) Total depth of box and hook plus extra space between wall bar and wall = maximum of 10/32" no spacers at bottom (s = 0) unrecessed (d = 10/32") Gap = (5 + 5t/b)/16 | | | | |
| 8 | 2 | 2.5 | 5.5 | 0.45 |
| 9 | 2.5 | 3 | 6 | 0.47 |
| 11 | 2.5 | 3 | 8 | 0.43 |
| 12 | 3 | 3.5 | 8.5 | 0.44 |
| 13 | 3 | 3.5 | 9.5 | 0.43 |
| 16 | 3.5 | 4 | 12 | 0.42 |
| 3/32" spacers (s = 3/32") unrecessed Gap = (7t/b + 10)/32 | | | | |
| 8 | 2 | 2.5 | 5.5 | 0.41 |
| 9 | 2.5 | 3 | 6 | 0.42 |
| 11 | 2.5 | 3 | 8 | 0.39 |
| 12 | 3 | 3.5 | 8.5 | 0.40 |
| 13 | 3.5 | 4 | 9 | 0.41 |
| 16 | 3.5 | 4 | 12 | 0.39 |
| 4/32" spacers (s = 4/32") unrecessed Gap = (3t/b + 5)/16 | | | | |
| 8 | 2 | 2.5 | 5.5 | 0.40 |
| 9 | 2.5 | 3 | 6 | 0.41 |
| 11 | 2.5 | 3 | 8 | 0.38 |
| 12 | 3.5 | 4 | 8 | 0.41 |
| 13 | 3.5 | 4 | 9 | 0.40 |
| 16 | 3.5 | 4 | 12 | 0.38 |
| no spacers fully recessed (d = 5/32") Gap = (5t/b + 5)/32 | | | | |
| 7 | 2.5 | 3 | 4 | 0.27 |
| 9 | 2.5 | 3 | 6 | 0.23 |
| 12 | 2.5 | 3 | 9 | 0.21 |
| 9 | 3.5 | 4 | 5 | 0.28 |
| 14 | 4.5 | 5 | 9 | 0.24 |
| 18 | 5.5 | 6 | 12 | 0.23 |
| 3/32" spacers fully recessed Gap = (2t/b + 5)/32 | | | | |
| 6 | 2.5 | 3 | 3 | 0.22 |
| 9 | 2.5 | 3 | 6 | 0.19 |
| 12 | 2.5 | 3 | 9 | 0.18 |
| 9 | 3.5 | 4 | 5 | 0.21 |
| 13 | 4.5 | 5 | 8 | 0.20 |
| 14 | 5.5 | 6 | 8 | 0.20 |
| 4/32" spacers fully recessed Gap = (t/b + 5)/32 | | | | |
| 7 | 2.5 | 3 | 4 | 0.18 |
| 10 | 3.5 | 4 | 6 | 0.18 |
| 9 | 4.5 | 5 | 4 | 0.20 |
| 9.5 | 5.5 | 6 | 3.5 | 0.21 |
| 12 | 6.5 | 7 | 5 | 0.20 |
| 16 | 7.5 | 8 | 8 | 0.19 |
| LIGHT DUTY BOX AND HOOK (1/32" hook and box front plate) Total depth of box and hook plus extra space between wall bar and wall = maximum of 9/32" no spacers at bottom (s = 0) unrecessed (d = 9/32") Gap = (9t/b + 9)/32 | | | | |
| 8 | 2 | 2.5 | 5.5 | 0.41 |
| 9 | 2.5 | 3 | 6 | 0.42 |
| 10 | 2.5 | 3 | 7 | 0.40 |
| 12 | 3.5 | 4 | 8 | 0.42 |
| 13 | 3.5 | 4 | 9 | 0.41 |
| 16 | 3.5 | 4 | 12 | 0.38 |
| 3/32" spacers (s = 3/32") unrecessed Gap = (6t/b + 9)/32 | | | | |
| 8 | 2 | 2.5 | 5.5 | 0.37 |
| 9 | 2.5 | 3 | 6 | 0.38 |
| 10 | 2.5 | 3 | 7 | 0.36 |
| 11 | 3.5 | 4 | 7 | 0.39 |
| 13 | 3.5 | 4 | 9 | 0.36 |
| 16 | 3.5 | 4 | 12 | 0.34 |

TABLE 2-continued

ESTIMATED GAP AT TOP OF FRAME FOR LIGHT AND HEAVY VERSIONS OF AN EMBODIMENT LIKE THAT DEPICTED IN FIGS. 17–24
Gap = d + (t/b)(d − s)

| Frame Size | Adjustability | t | b | Gap |
|---|---|---|---|---|
| 4/32" spacers (s = 4/32") unrecessed Gap = (5t/b + 9)/32 | | | | |
| 8 | 2 | 2.5 | 5.5 | 0.35 |
| 9 | 2.5 | 3 | 6 | 0.36 |
| 10 | 2.5 | 3 | 7 | 0.35 |
| 11 | 3.5 | 4 | 7 | 0.37 |
| 13 | 3.5 | 4 | 9 | 0.35 |
| 16 | 3.5 | 4 | 12 | 0.33 |
| no spacers fully recessed (d = 4.5/32") Gap = (9t/b + 9)/64 | | | | |
| 7 | 2.5 | 3 | 4 | 0.25 |
| 9 | 2.5 | 3 | 6 | 0.21 |
| 12 | 2.5 | 3 | 9 | 0.19 |
| 12 | 3.5 | 4 | 8 | 0.21 |
| 14 | 4.5 | 5 | 9 | 0.22 |
| 20 | 7.5 | 8 | 12 | 0.23 |
| 3/32" spacers fully recessed Gap = (3t/b + 9)/64 | | | | |
| 8 | 3.5 | 4 | 4 | 0.19 |
| 11 | 4.5 | 5 | 6 | 0.18 |
| 15 | 5.5 | 6 | 9 | 0.17 |
| 16 | 7.5 | 8 | 8 | 0.19 |
| 17 | 7.5 | 8 | 9 | 0.18 |
| 22 | 9.5 | 10 | 12 | 0.18 |
| 4/32" spacers fully recessed Gap = (t/b + 9)/64 | | | | |
| 8 | 3.5 | 4 | 4 | 0.16 |
| 11 | 4.5 | 5 | 6 | 0.15 |
| 14 | 4.5 | 5 | 9 | 0.15 |
| 14 | 5.5 | 6 | 8 | 0.15 |
| 17 | 7.5 | 8 | 9 | 0.15 |
| 22 | 9.5 | 10 | 12 | 0.15 |

From Table 2, it can be seen that, assuming the vertical length of the wall facing portion of the hook to be about a half an inch, because there is a 1/32" leeway between the hook and wall, the hook's end should not forcefully impinge on the wall at any of the above calculated pitch angles. For this to happen, the pitch angle would have to exceed 0.06 hi/vi.

Besides the gap and corresponding angle of pitch, the following considerations may also be relevant in comparing embodiments of the present invention including those specific to a picture-type hanging scenario:

(1) the device should be capable of securing a hanging position that is not easily disturbed by vibration or the like;

(2) the mode of adjustment should be fairly easy to understand and accomplish;

(3) the hanging item should not be too susceptible to undesirable disengagement from the wall support during adjustment;

(4) the device should be sufficiently durable so as to allow a reasonable life cycle of adjustments; and (5) visible overhang of the mounting device past the hanging item's edges should be minimized.

Relative to embodiments of the present invention for use in a typical picture hanging-type context, it can be appreciated that, in practice, it is almost mandatory that there be two points of attachment to the vertical surface in order to allow horizontal adjustability. If only one point of attachment is provided, the torque generated in the plane of the vertical surface by an item hanging with its center of gravity not exactly above the point of attachment will tend to cause rotation around the point of attachment, which results in the item hanging seriously off-level, or simply falling off altogether. Because vertical adjustment does not shift a hanging item's horizontal center of gravity, plural points of attachment to the vertical surface are not requisite in embodiments that are only vertically adjustable.

It should further be noted that in the horizontally adjustable embodiments of the present invention, a spirit level may be incorporated into the invention, as is well known in the art, to ensure proper horizontal leveling of the portion of the apparatus that affixes to the wall.

Finally, it is noted that the particular embodiments discussed in detail herein as a means of explaining and enabling the invention shall in no way be construed as limiting the scope of the claims that follow; instead, the following claims and their legal equivalents are intended to cover the full scope and spirit of the invention that is taught herein. By way of example, many of the particular nuances and features that are described with regard to only certain embodiments herein are obviously applicable to or interchangeable with those of other embodiments. Further, many features that are well known in the art are not discussed herein as it will become readily apparent to one of ordinary skill in the art reading this specification that such features are applicable without need for description thereof.

I claim:

1. A device for adjustably mounting or connecting an item to a support, comprising:

a) a first portion including an affixed part that is securely affixed to the support;

b) a second portion including an attached part that is fixedly attached to or incorporated into the reverse side of the item;

c) wherein one of said first and second portions is a vertically adjustable portion and the other of said first and second portions is a non-vertically-adjustable portion, said vertically adjustable portion including a vertically static part and a locking interface, said locking interface being:

i) lockably and continuously vertically adjustably coupled to said vertically static part;

ii) releasably engaged with said non-vertically-adjustable portion; and iii) formed to respond to a first selected force or series of forces transmitted through the item and/or through a conveniently accessible portion of the device by temporarily unlocking with respect to said vertically static part;

wherein, upon transmission of said first selected force or series of forces, upward or downward force on the item causes in situ, automatic, substantially continuous adjustment to the vertical position of said locking interface relative to said vertically static part.

2. The device of claim 1, wherein said locking interface and said non-vertically-adjustable portion are formed to release engagement from each other in response to a second selected force or series of forces transmitted through the item and/or through a conveniently accessible portion of the device.

3. The device of claim 1, wherein one or both of said first and second portions is further formed to allow horizontal adjustment to the position of engagement between said first and second portions.

4. The device of claim 1, wherein said first selected force or series of forces comprises a force or series of forces transmitted through the item.

5. The device of claim 4, wherein said vertically adjustable portion is said second portion, and wherein said attached part of said second portion is a vertical guide that is also said vertically static part of said vertically adjustable portion, said locking interface being lockable at any one of a substantially continuous plurality of vertical positions along a length of said vertical guide.

6. The device of claim 5, wherein, throughout said substantially continuous plurality of vertical positions, the device does not noticeably protrude past the edges of the item when viewed frontally.

7. The device of claim 5, wherein said affixed part of said first portion comprises a horizontally oriented hanger.

8. The device of claim 7, wherein said locking interface includes a downwardly pointing hook formed to engage said horizontally oriented hanger at a plurality of locations along a horizontal length of said hanger.

9. The device of claim 5, wherein said vertical guide is formed to be partially or wholly recessed into a depression in the reverse side of the item.

10. The device of claim 5, wherein said vertical guide is formed to be manufactured as part of, or retrofitted as part of a bulk process into, the reverse side of the item.

11. The device of claim 5, wherein said vertical guide is formed to be fixedly attached by a consumer or vendor to the reverse side of the item.

12. The device of claim 11, further comprising means for attaching said vertical guide to the reverse side of a frame having a standard, predetermined frame size.

13. The device of claim 11, further comprising means for attaching said vertical guide to the reverse side of a frame having any one of a plurality of sizes.

14. The device of claim 11, wherein said vertically adjustable portion further comprises a frame-back attached to said vertical guide, said frame-back being formed to fit flushly with the reverse side of the item.

15. The device of claim 1, wherein said vertically adjustable portion is said first portion and said vertically static part is a vertical guide, said locking interface being vertically movable, when unlocked, to any one of a substantially continuous plurality of lockable vertical positions within or along said vertical guide.

16. The device of claim 15, wherein said vertical guide is also said affixed part, and said locking interface comprises:

a) a horizontal hook slide connected to said vertical guide in a vertically sliding and lockable manner; and b) an upwardly pointing hook connected to said hook slide in a horizontally sliding manner.

17. The device of claim 15, wherein said affixed part comprises a horizontal guide, and wherein said vertical guide and said locking interface are horizontally slidingly connected to said horizontal guide.

18. The device of claim 15, wherein said second portion includes conventional means commonly placed on or incorporated into the reverse side of items that are typically hung, such as taut wire, brackets, or universal frame edging.

19. A device for adjustably mounting or connecting an item to a support, comprising:

a) a first portion including an affixable part formed to be securely affixed to the support;

b) a second portion including an attachable part formed to be fixedly attached to or incorporated into the reverse side of the item;

c) wherein one of said first and second portions is a vertically adjustable portion and the other of said first and second portions is a non-vertically-adjustable portion, said vertically adjustable portion including a vertically static part and a locking interface, said locking interface being:

i) lockably and continuously vertically adjustably coupled to said vertically static part;

ii) releasably engageable with said non-vertically-adjustable portion; and iii) formed to respond, when engaged with said non-vertically-adjustable portion, to a first selected force or series of forces transmitted through the item and/or through a conveniently accessible portion of the device by temporarily unlocking with respect to said vertically static part;

wherein, upon transmission of said first selected force or series of forces, upward or downward force on the item causes in situ, automatic, substantially continuous adjustment to the vertical position of said locking interface relative to said vertically static part when said locking interface is engaged with said non-vertically adjustable portion.

20. A device for mounting an item on a substantially vertical flat surface comprising:

a) a first portion including an affixable part formed to be securely affixed to the flat surface;

b) a second portion including an attachable part formed to be fixedly attached to or incorporated into the reverse side of the item;

c) wherein one of said first and second portions is a vertically adjustable portion and the other of said first and second portions is a non-vertically-adjustable portion, said vertically adjustable portion including a vertically static part and a locking interface, said locking interface being:

i) lockably and continuously vertically adjustably coupled to said vertically static part;

ii) releasably engageable with said non-vertically-adjustable portion; and iii) formed to respond, when engaged with said non-vertically-adjustable portion, to a first selected force or series of forces transmitted through the item and/or through a conveniently accessible portion of the device by temporarily unlocking with respect to said vertically static part;

wherein, upon transmission of said first selected force or series of forces, upward or downward force on the item causes in situ, automatic, substantially continuous adjustment to the vertical position of said locking interface relative to said vertically static part when said locking interface is engaged with said non-vertically adjustable portion.

* * * * *

UNITED STATES PATENT AND TRADEMARK OFFICE

CERTIFICATE OF CORRECTION

PATENT NO. : 6,032,915
DATED : March 7, 2000
INVENTOR(S) : Thomas J. Brindisi

It is certified that error appears in the above-identified patent and that said Letters Patent is hereby corrected as shown below:

Title page,
After the filing date item [22], insert

-- Related U.S. Application Data

[60] Benefit claimed of provisional Ser. No. 60/013,671, Mar. 19, 1996. --

Signed and Sealed this

Second Day of October, 2001

*Attest:*

Nicholas P. Godici

NICHOLAS P. GODICI
*Acting Director of the United States Patent and Trademark Office*

*Attesting Officer*